US011513449B2

(12) United States Patent
Fukushima et al.

(10) Patent No.: US 11,513,449 B2
(45) Date of Patent: Nov. 29, 2022

(54) NON-CONTACT DEVELOPER BIAS VOLTAGE CONTROL FOR IMAGE FORMING APPARATUS

(71) Applicant: CANON KABUSHIKI KAISHA, Tokyo (JP)

(72) Inventors: Naoki Fukushima, Shizuoka (JP); Nobuyoshi Yoshida, Shizuoka (JP); Issei Imamura, Shizuoka (JP); Shunsuke Matsushita, Kanagawa (JP); Yosuke Kishi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/952,239

(22) Filed: Nov. 19, 2020

(65) Prior Publication Data

US 2021/0173321 A1 Jun. 10, 2021

(30) Foreign Application Priority Data

Dec. 4, 2019 (JP) ..... JP2019-219647
Dec. 4, 2019 (JP) ..... JP2019-219650
Dec. 18, 2019 (JP) ..... JP2019-227810

(51) Int. Cl.
*G03G 15/02* (2006.01)
*G03G 15/08* (2006.01)

(52) U.S. Cl.
CPC ..... *G03G 15/0266* (2013.01); *G03G 15/0851* (2013.01)

(58) Field of Classification Search
CPC ..... G03G 15/0266; G03G 15/065; G03G 2215/021; G03G 15/0283; G03G 15/5004
See application file for complete search history.

(56) References Cited

U.S. PATENT DOCUMENTS

| | | | | |
|---|---|---|---|---|
| 6,266,508 | B1 * | 7/2001 | Nakagawa | G03G 15/065 399/285 |
| 8,175,475 | B2 | 5/2012 | Inami et al. | |
| 9,411,259 | B2 | 8/2016 | Hayashi et al. | |
| 9,411,260 | B2 | 8/2016 | Mitsui et al. | |
| 10,295,932 | B2 | 5/2019 | Kanai et al. | |
| 2010/0129102 | A1 * | 5/2010 | Fujihara | G03G 15/065 399/55 |
| 2017/0060061 | A1 * | 3/2017 | Takeuchi | G03G 15/065 |
| 2018/0341192 | A1 * | 11/2018 | Kanazawa | G03G 15/0266 |

FOREIGN PATENT DOCUMENTS

| | | | |
|---|---|---|---|
| JP | H07-28335 | A | 1/1995 |
| JP | H08-286475 | A | 11/1996 |
| JP | 2005-078015 | A | 3/2005 |
| JP | 2006-171787 | A | 6/2006 |
| JP | 2009-128732 | A | 6/2009 |
| JP | 2018-132567 | A | 8/2018 |

* cited by examiner

*Primary Examiner* — Jessica L Eley
(74) *Attorney, Agent, or Firm* — Venable LLP

(57) ABSTRACT

An image forming apparatus detects a first current value and a second current value of currents flowing between an image bearing member and a developer carrying member. When a difference between the detected first current value and the detected second current value exceeds a threshold in a state in which the image bearing member and the developer carrying member are rotated and a first developing voltage is applied to the developer carrying member, a controller controls AC voltage applied to the developer carrying member.

20 Claims, 23 Drawing Sheets

(a) COMP. EX.

(b) EMB.1

(a)

(b)

(a)

(b)

NON-CONTACT DEVELOPER BIAS VOLTAGE CONTROL FOR IMAGE FORMING APPARATUS

FIELD OF THE INVENTION AND RELATED ART

The present invention relates to an image forming apparatus for forming an image on a recording medium by using an electrophotographic type.

In the image forming apparatus, such as a printer, using the electrophotographic type (electrophotographic process) in order to develop an electrostatic latent image formed on an image bearing member, various developing devices have been used. As an example of types of the developing devices, a non-contact developing type in which the image bearing member and a developer carrying member opposing the image bearing member are provided with a predetermined interval (gap) has been known.

In the non-contact developing type, a developing bias (voltage) in a combination form of a DC voltage and an AC voltage is applied to the developer carrying member, so that charged toner moves (flies) from the developer carrying member to the image bearing member, and the electrostatic latent image formed on the image bearing member is developed into a toner image. The toner image formed on the image bearing member is transferred and fixed on a recording medium such as a sheet.

Incidentally, in the non-contact developing type, the image bearing member and the developer carrying member are driven, so that the gap formed between the image bearing member and the developer carrying member fluctuates in some cases. By the fluctuation of the gap, an electric field strength between the image bearing member and the developer carrying member fluctuates, so there was a problem such that density non-uniformity of an image formed occur.

In order to solve this problem, by increasing a peak-to-peak voltage (peak-to-peak value) of the AC voltage of the developing bias, the toner sufficiently moves from the developer carrying member to the image bearing member, so that it is possible to suppress an occurrence of the image density non-uniformity. However, when the peak-to-peak voltage of the AC voltage of the developing bias is increased, a potential difference between itself and a surface potential of the image bearing member becomes large. For that reason, electric discharge occurs between the developer carrying member and the image bearing member, and by the discharge, current value leakage such that a discharge current value flows (hereinafter, referred to as leakage) occurs, so there was a problem such that noise generates on the image to be formed.

The peak-to-peak voltage of the AC voltage at which the leakage occurs changes depending on the gap, atmospheric pressure and the like, and therefore, the peak-to-peak voltage changes depending on a change in individual image forming apparatus and an operation (use) environment.

For that reason, in Japanese Laid-Open Patent Application (JP-A) 2005-78015, the peak-to-peak voltage (peak-to-peak value) of the AC voltage of the developing bias applied to between the image bearing member and the developer carrying member is gradually increased from a value at which the leakage does not occur. Then, impedance is measured on the basis of a current value of a current value flowing between the image bearing member and the developer carrying member, so that an occurrence of the leakage is detected from a measured value of the impedance and the current value.

However, in JP-A 2005-78015, in order to detect the occurrence of the leakage between the image bearing member and the developer carrying member, there is a need to measure the impedance in advance, so that there was a problem such that a time required for setting a developing bias at a value at which the leakage does not occur becomes long.

SUMMARY OF THE INVENTION

A principal object of the present invention is to provide an image forming apparatus capable of shortening a time required for setting a developing bias (voltage) at a value at which leakage does not occur.

According to an aspect of the present invention, there is provided an image forming apparatus comprising: a rotatable image bearing member; a charging member configured to electrically charge the image bearing member; a rotatable developer carrying member provided so as to oppose the image bearing member in non-contact with the image bearing member and configured to carry a developer; an applying portion configured to apply, to the developer carrying member, a developing voltage in a combination form of a DC voltage and an AC voltage; a detecting portion configured to detect a first current value and a second current value of currents flowing between the image bearing member and the developer carrying member; and a controller configured to control the applying portion, wherein when a difference between the first current value and the second current value which are detected by the detecting portion exceeds a threshold in a state in which the image bearing member and the developer carrying member are rotated and the developing voltage is applied to the developer carrying member, the controller controls the AC voltage applied to the developer carrying member.

According to another aspect of the present invention, there is provided an image forming apparatus comprising: a rotatable image bearing member; a charging member configured to electrically charge the image bearing member; a rotatable developer carrying member provided so as to oppose the image bearing member in non-contact with the image bearing member and configured to carry a developer; an applying portion configured to apply, to the developer carrying member, a developing voltage in a combination form of a DC voltage and an AC voltage; a detecting portion configured to detect a current value of a current flowing between the image bearing member and the developer carrying member; and a controller configured to control the applying portion, wherein when a certain elapsed from timing when the AC voltage applied to the developer carrying member changes from a negative to a positive or from the positive to the negative in a state in which the image bearing member and the developer carrying member are rotated and the developing voltage is applied to the developer carrying member, the controller controls the AC voltage applied to the developer carrying member, on the basis of the current value detected by the detecting portion.

According to another aspect of the present invention, there is provided an image forming apparatus comprising: a rotatable image bearing member; a charging member configured to electrically charge the image bearing member; a rotatable developer carrying member provided so as to oppose the image bearing member in non-contact with the image bearing member and configured to carry a developer; a developer accommodating chamber configured to accommodate the developer; a developing chamber in which the developer carrying member is provided so as to be rotatable;

a developing frame provided with an opening for establishing communication between the developer accommodating chamber and the developing chamber and configured to support the developer carrying member; a rotatable member provided in the developing frame and configured to rotate in interrelation with the developer carrying member; a sealing member configured to seal the opening provided in the developing frame and configured to be partially fixed to the rotatable member; a process cartridge mountable to and dismountable from the image forming apparatus; an applying portion configured to apply, to the developer carrying member, a developing voltage in a combination form of a DC voltage and an AC voltage; a detecting portion configured to detect a first current value and a second current value of currents flowing between the image bearing member and the developer carrying member; and a controller configured to control the AC voltage so that the controller detects whether or not the current value detected by the detecting portion exceeded a threshold in a state in which the developing voltage is applied to the developer carrying member during detection of the current value and then so that the current value is the threshold or less, wherein a time required for controlling the AC voltage so that the AC voltage is the threshold or less is shorter than a time from a start of unsealing of the opening by winding up the sealing member through rotation of the rotatable member until the unsealing of the opening is ended.

According to a further aspect of the present invention, there is provided an image forming apparatus comprising: a rotatable image bearing member; a charging member configured to electrically charge the image bearing member; a rotatable developer carrying member provided so as to oppose the image bearing member in non-contact with the image bearing member and configured to carry a developer; an applying portion configured to apply, to the developer carrying member, a developing voltage in a combination form of a DC voltage and an AC voltage; a detecting portion configured to detect a first current value and a second current value of currents flowing between the image bearing member and the developer carrying member; and a controller configured to control the applying portion, wherein the controller controls the AC voltage applied to the developer carrying member, on the basis of a difference between the first current value and the second current value which are detected by the detecting portion exceeds a threshold in a state in which the image bearing member and the developer carrying member are rotated and the developing voltage is applied to the developer carrying member, and on the basis of the first current value.

Further features of the present invention will become apparent from the following description of exemplary embodiments with reference to the attached drawings.

Figure 3:
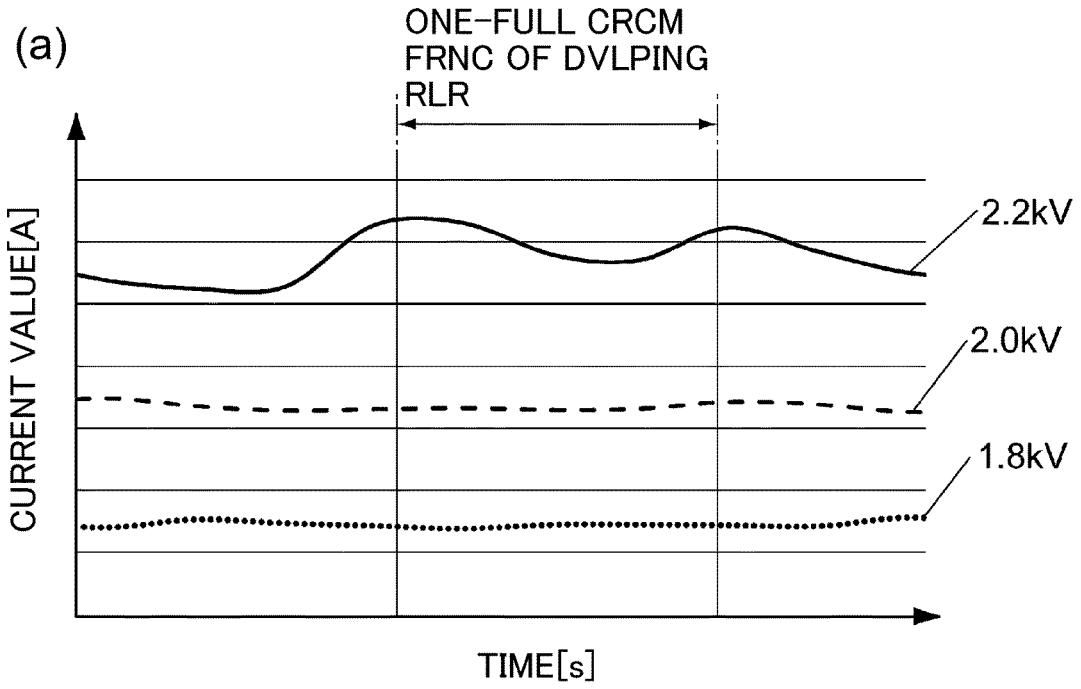
Figure 3:
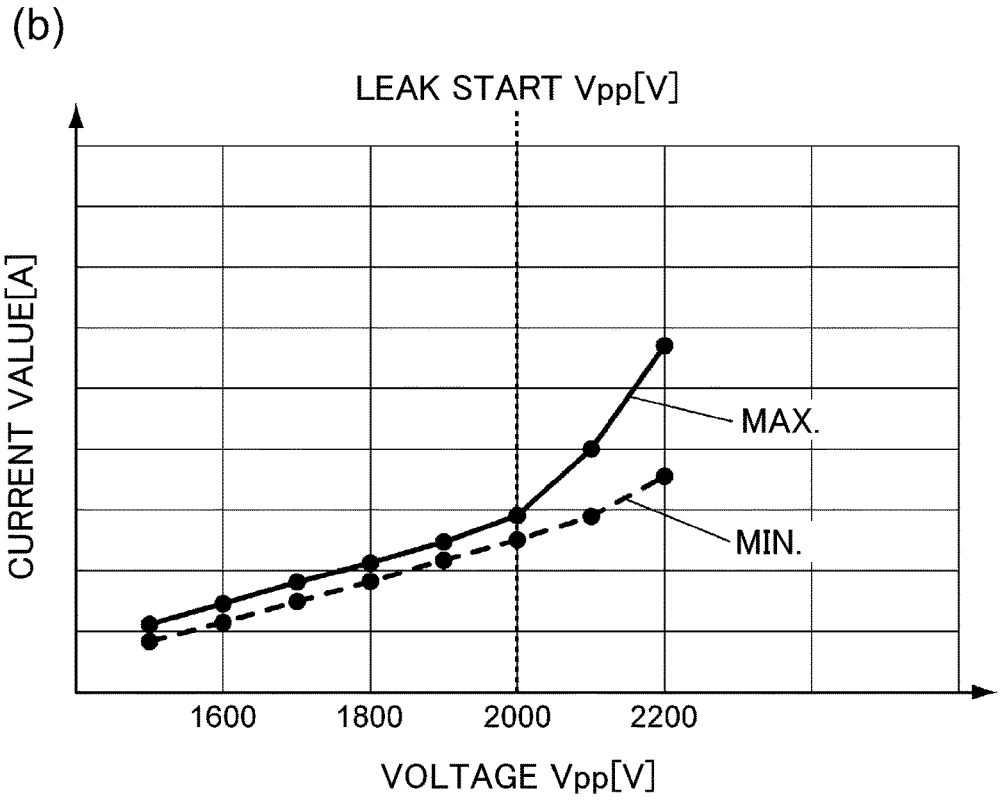

Part (a) of FIG. 3 is a waveform graph (chart) of current values when a peak-to-peak voltage Vpp is changed, and part (b) of FIG. 3 is a relationship view of an AC voltage and a difference between a maximum value and a minimum value of a current value in an embodiment 1.

Figure 4:
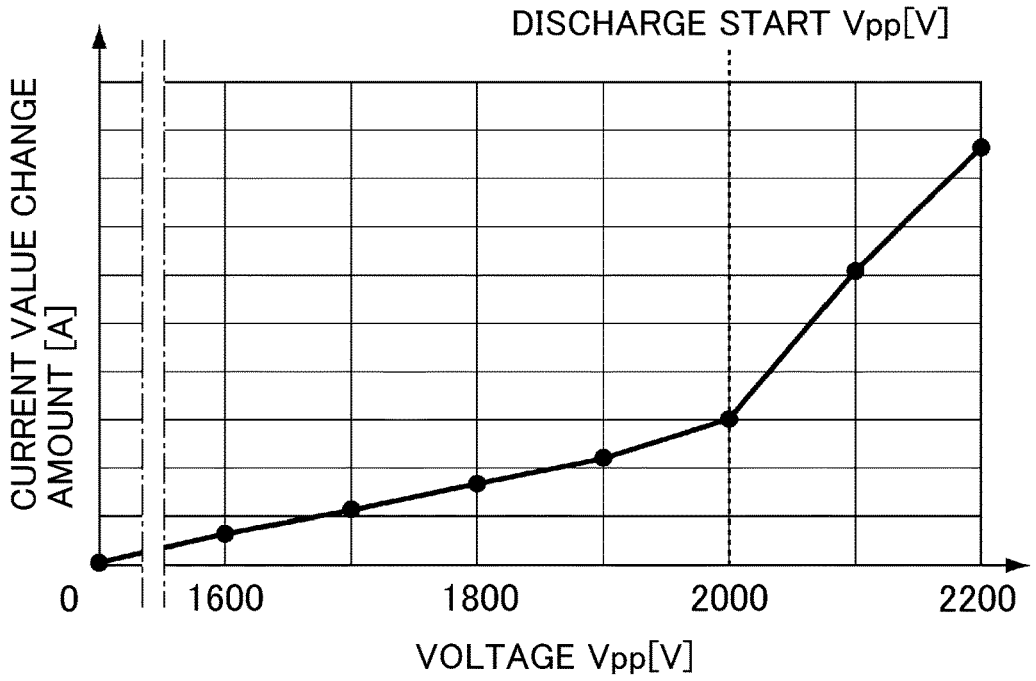
Figure 4:
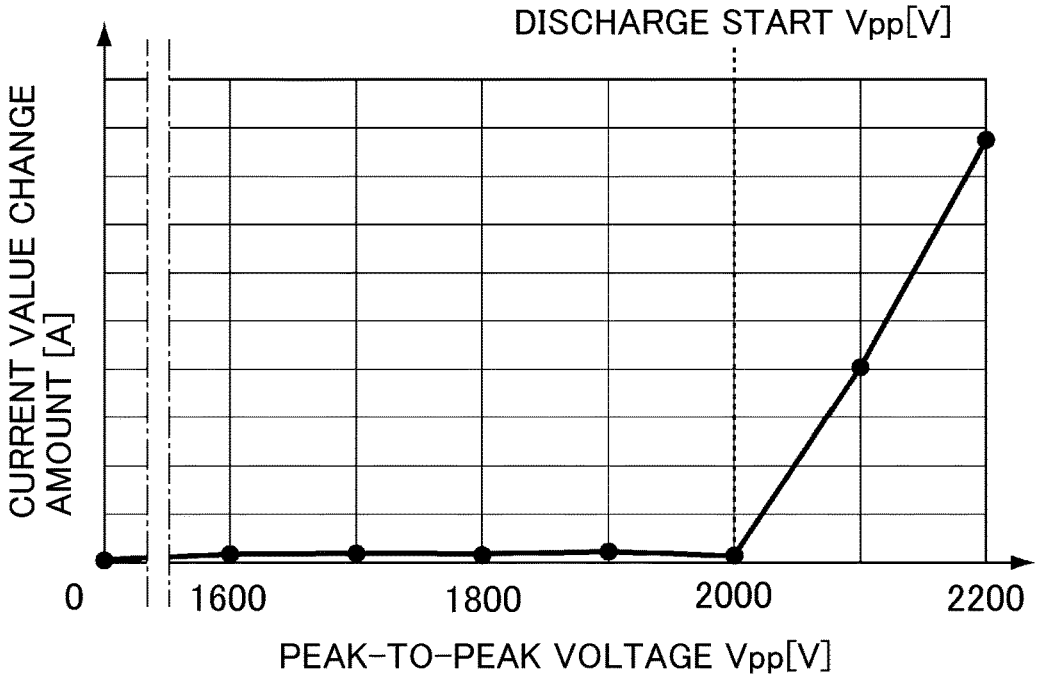

Part (a) of FIG. 4 is a relationship view of an AC voltage and a current value in a comparison example, and part (b) of FIG. 4 is a relationship view of an AC voltage and a change amount of the current value in the embodiment 1.

Figure 5:
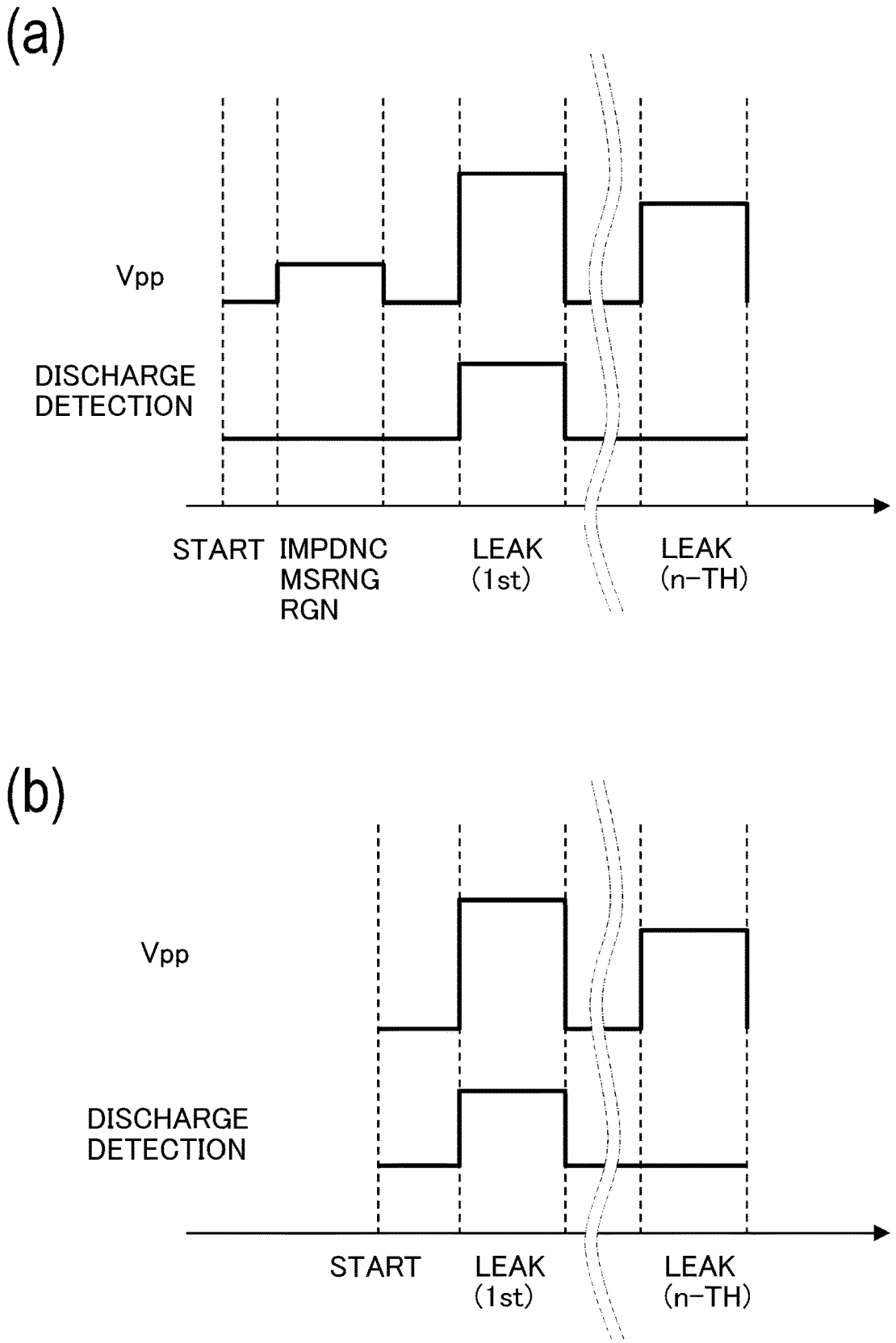

Part (a) of FIG. 5 is a timing chart of AC voltage setting during detection of an occurrence of discharge in the comparison example, and part (b) of FIG. 5 is a timing chart of AC voltage setting during detection of an occurrence of discharge in the embodiment 1.

Figure 6:
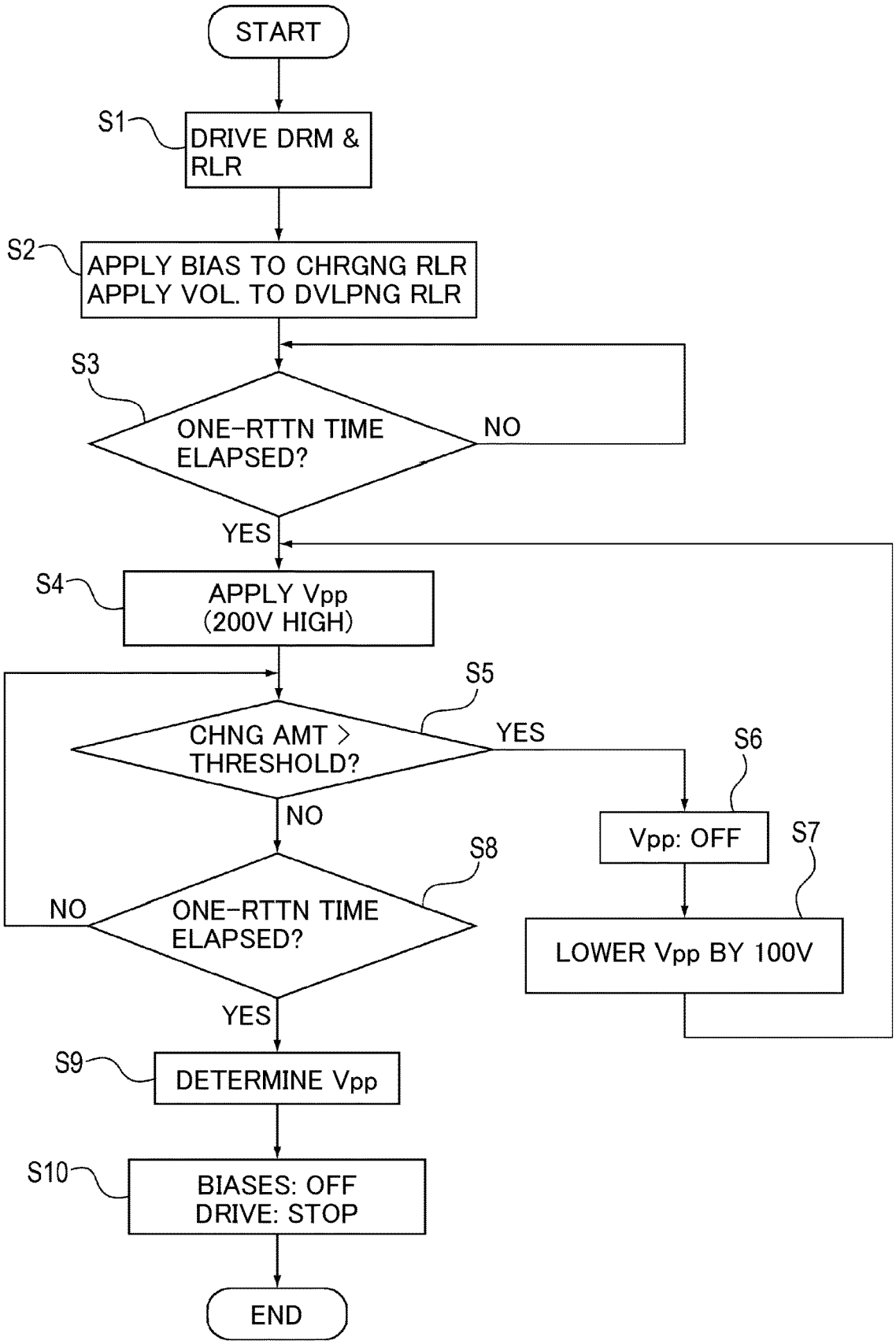

FIG. 6 is a flow chart showing discharge detection control in the embodiment 1.

Figure 7:
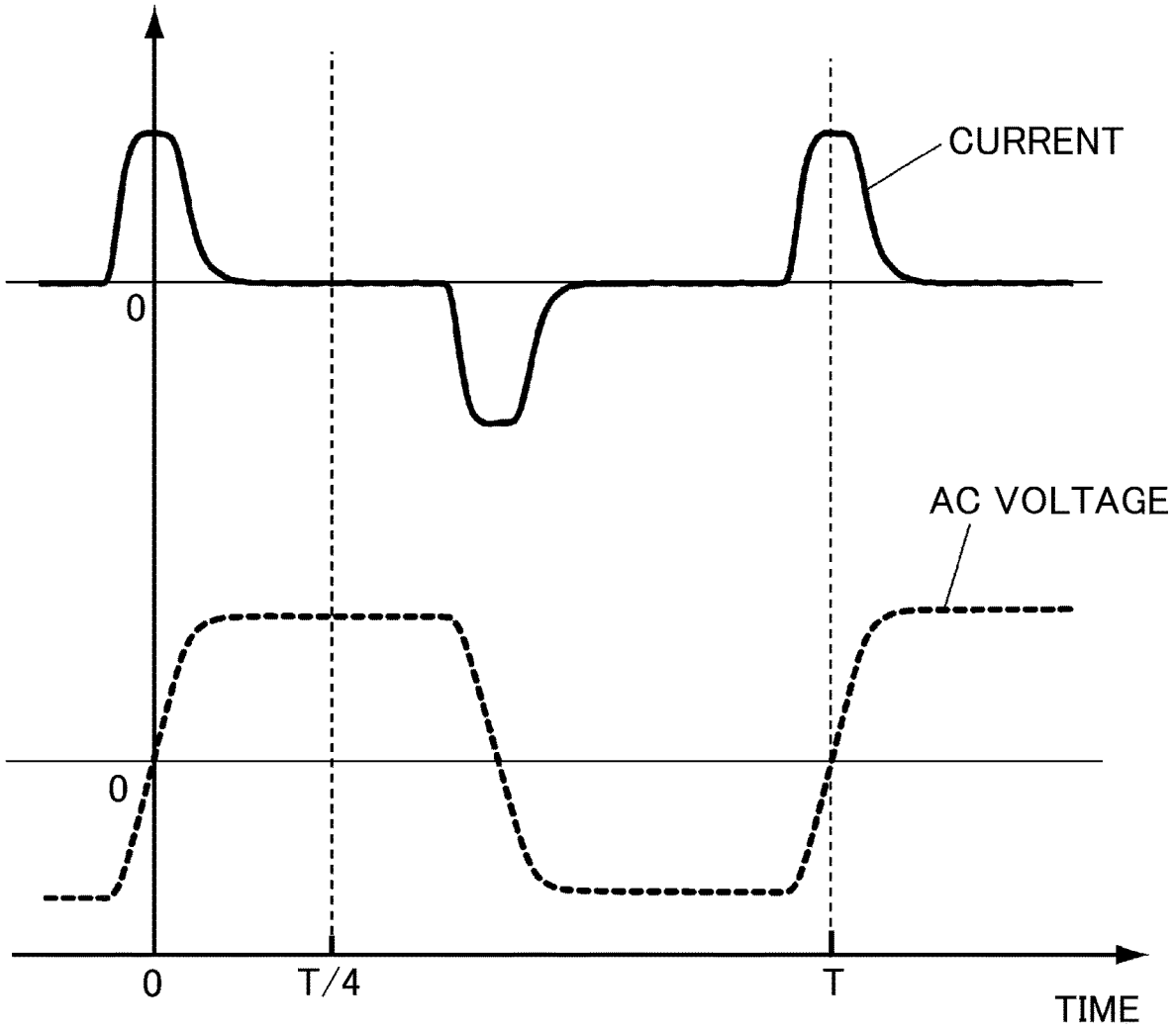

FIG. 7 is a waveform chart of an AC voltage and a current value under application of a developing bias in an embodiment 2.

Figure 8:
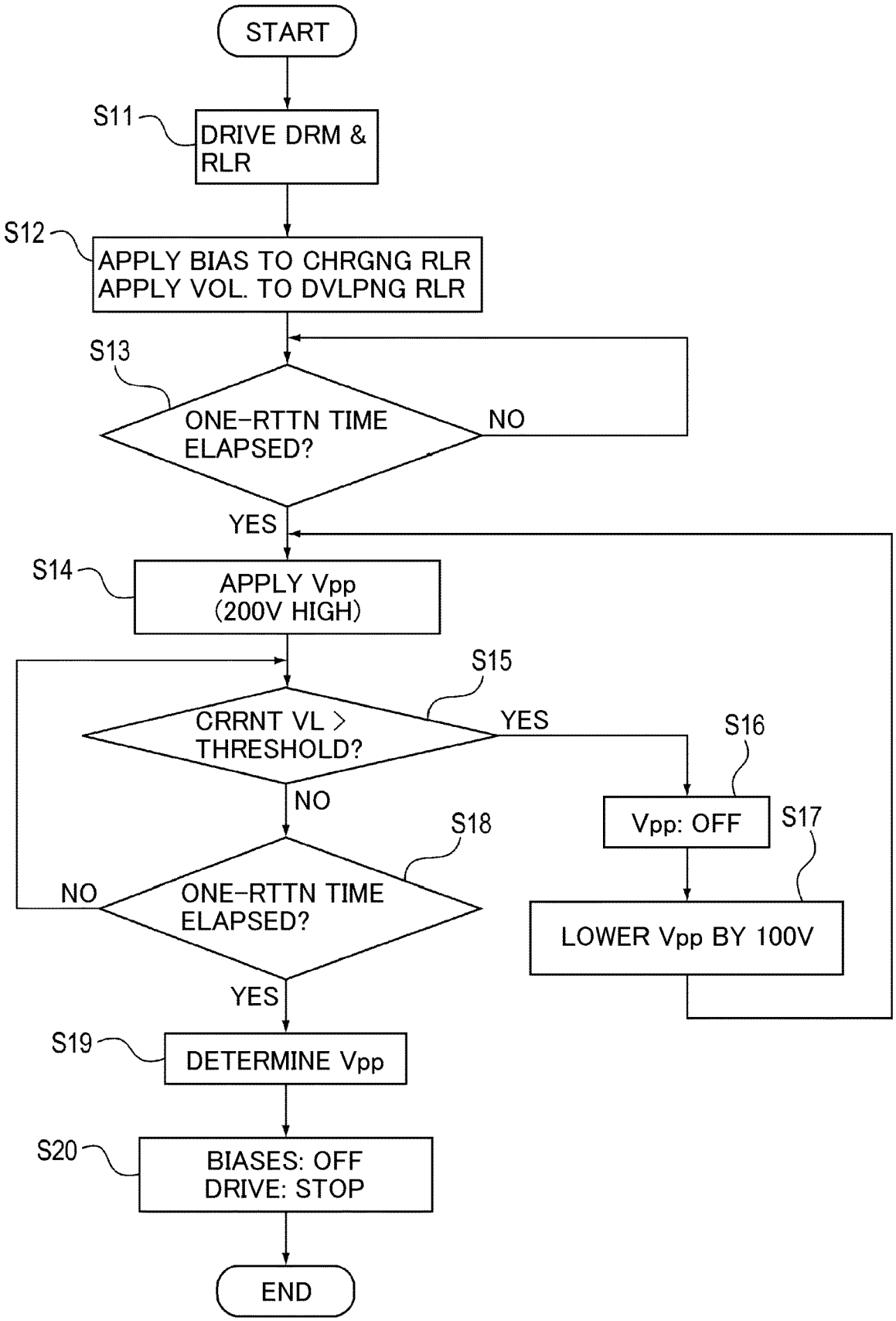

FIG. 8 is a flowchart showing discharge detection control in the embodiment 2.

Figure 9:
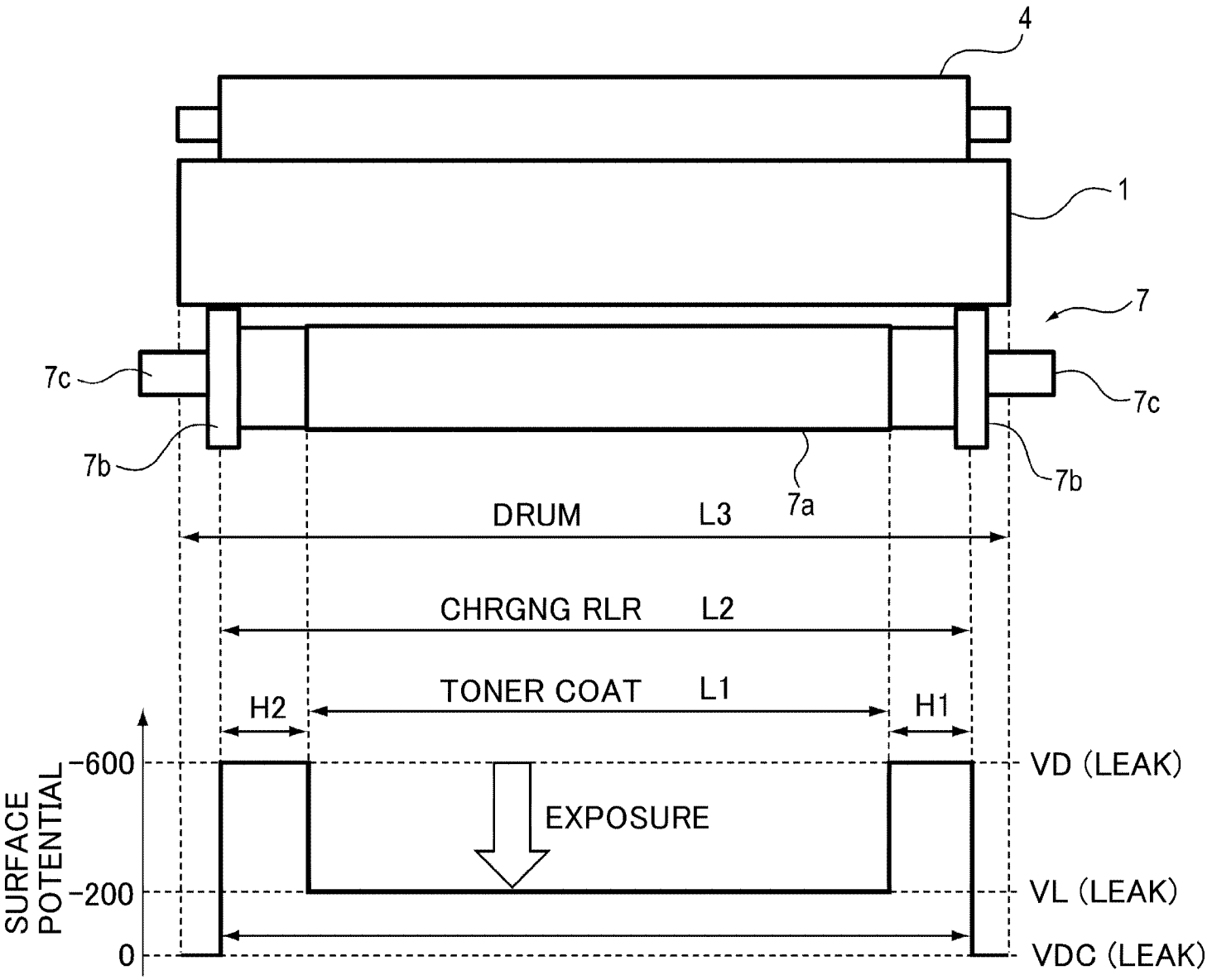

FIG. 9 is a schematic view for illustrating a size relationship between members of an image forming portion in an embodiment 3.

Figure 10:
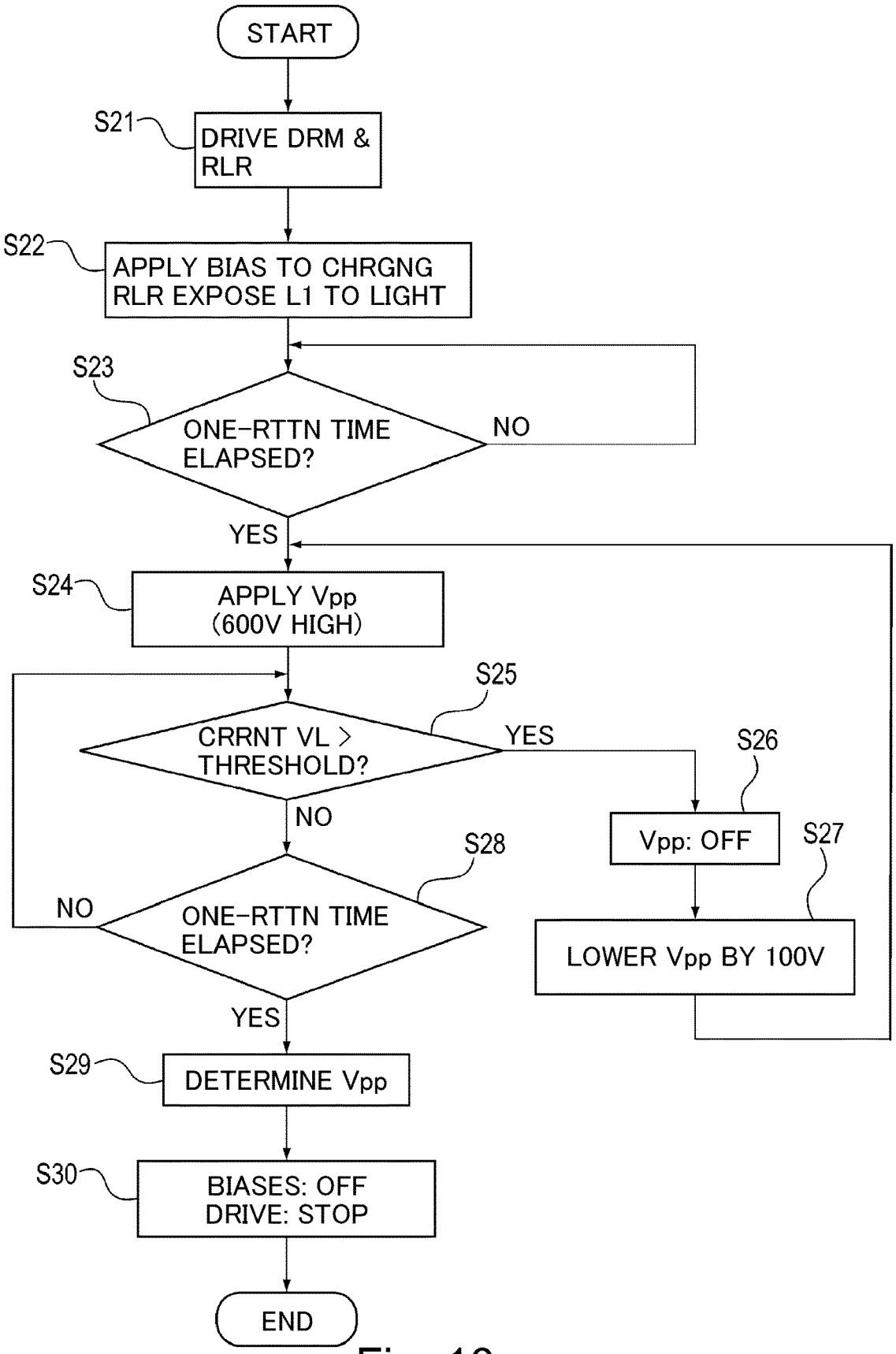

FIG. 10 is a flowchart showing discharge detection control in the embodiment 3.

Figure 11:
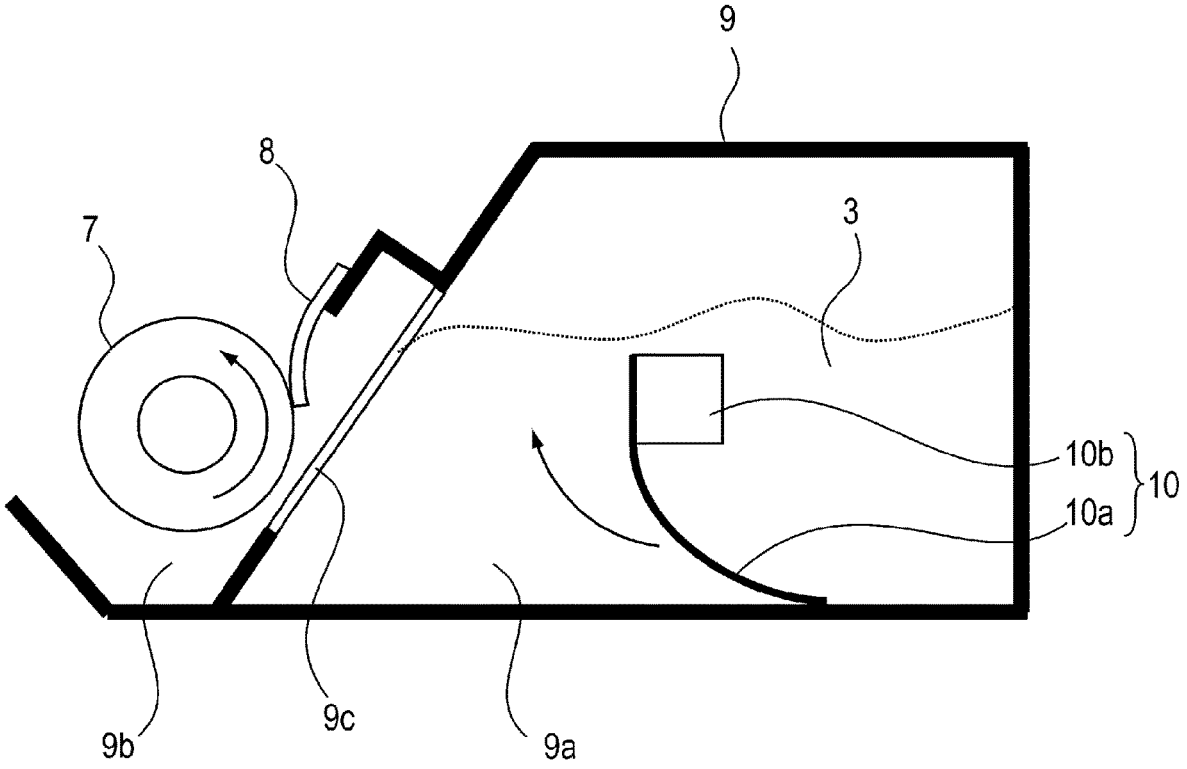

FIG. 11 is a sectional view of a developing container in an embodiment 4.

Figure 12:
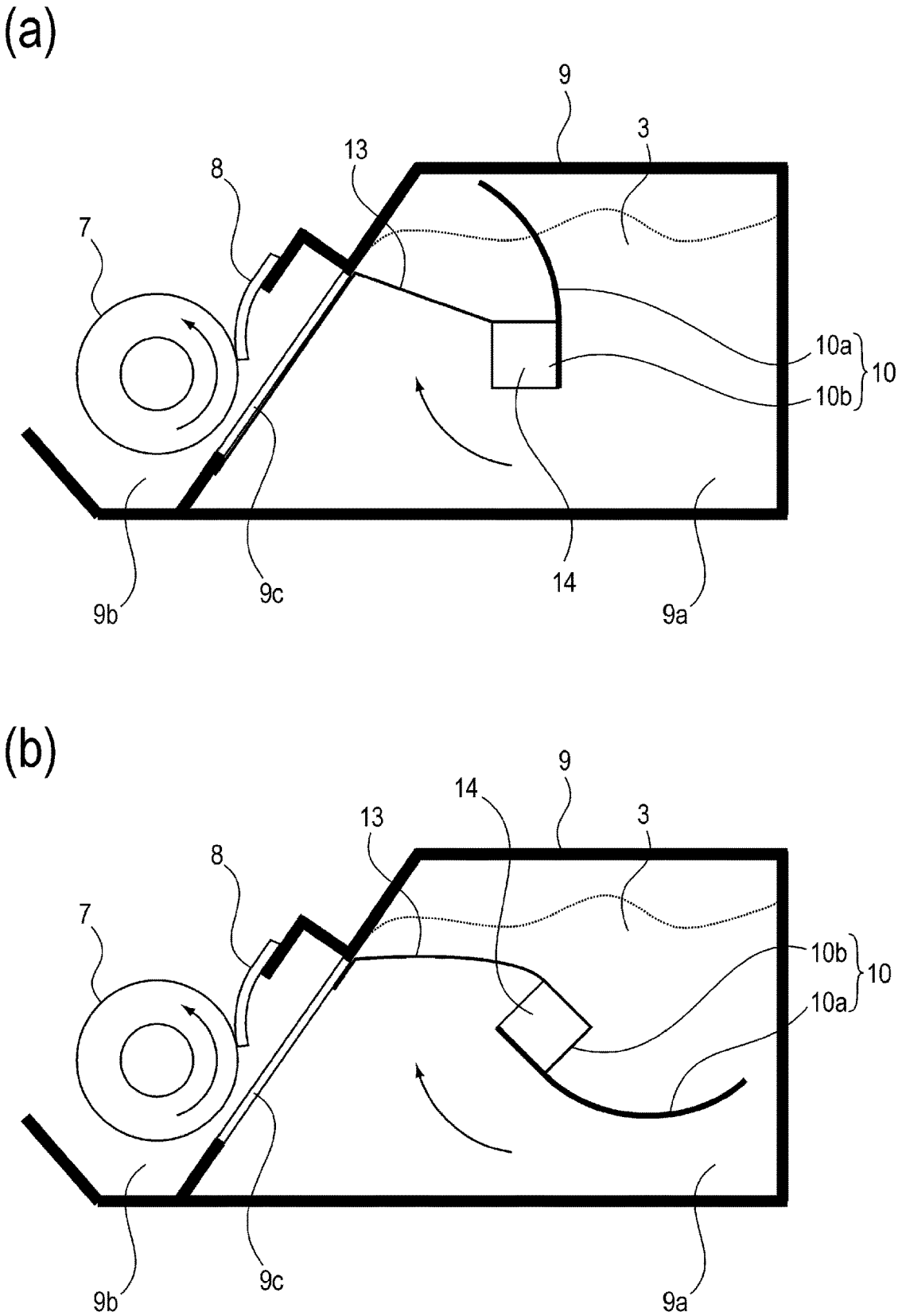

Parts (a) and (b) of FIG. 12 are schematic views relating to toner seal winding-up in the embodiment 4.

Figure 13:
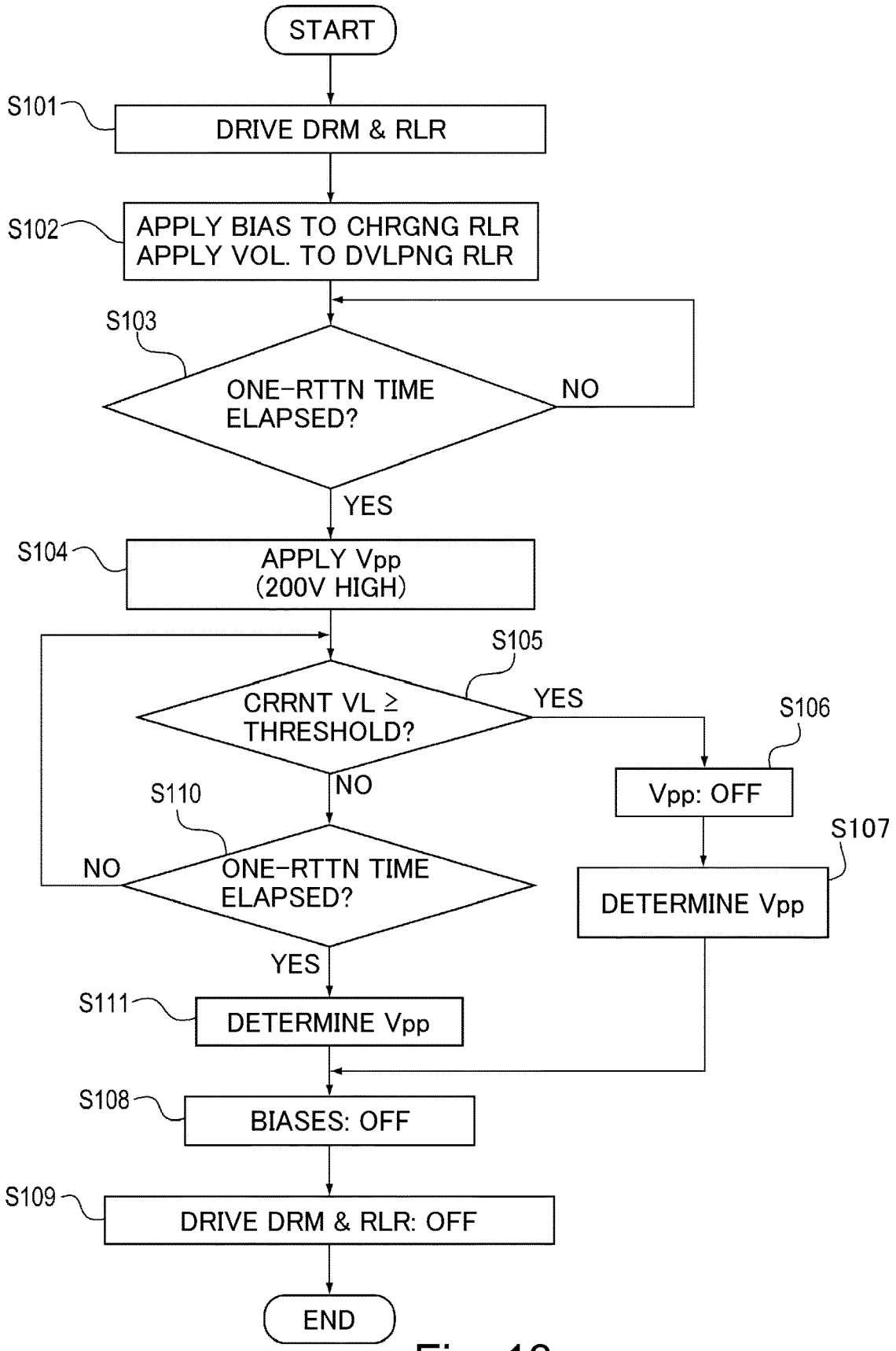

FIG. 13 is a flowchart showing a flow of a discharge occurrence detecting operation in the embodiment 4.

Figure 14:
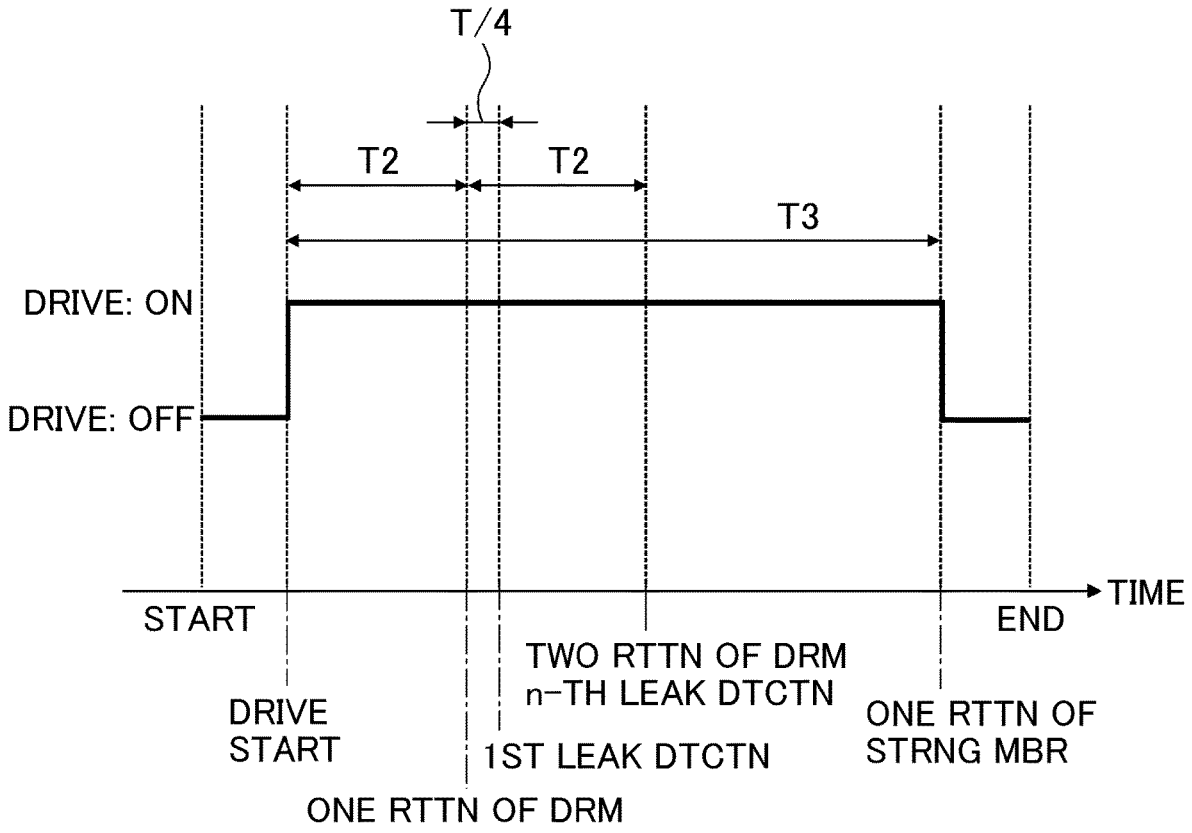

FIG. 14 is a timing chart showing drive timing of the discharge detecting operation in the embodiment 4.

Figure 15:
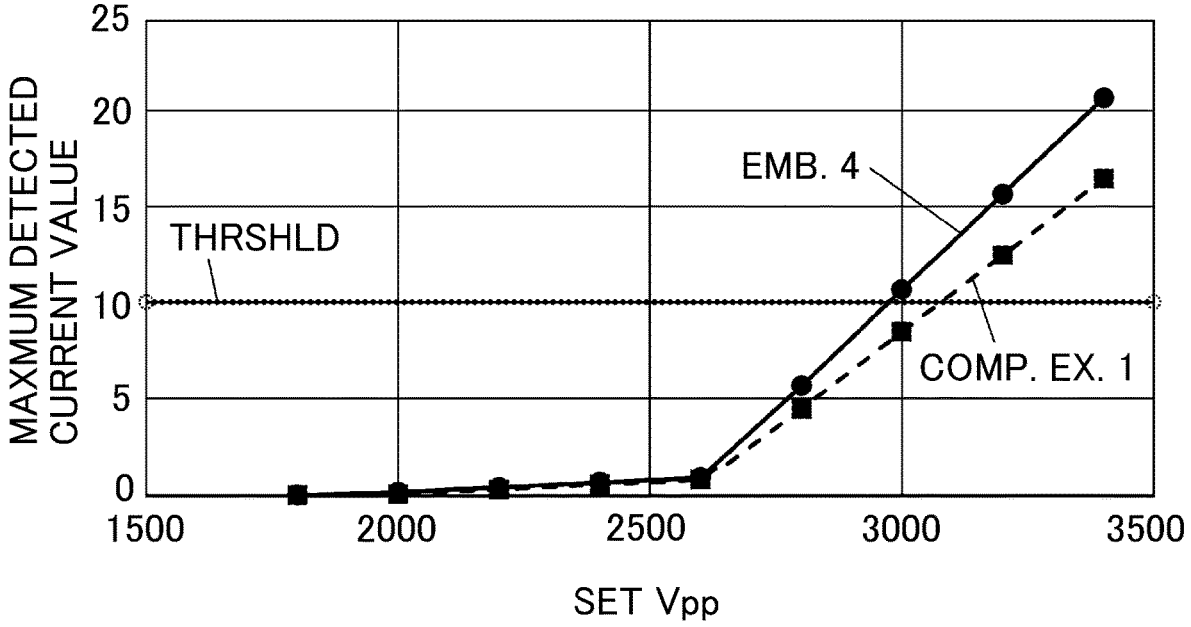

FIG. 15 is a relationship graph of a peak-to-peak voltage Vpp set during detection of the discharge operation and a detected current value in the embodiment 4 and a comparison example 1.

Figure 16:
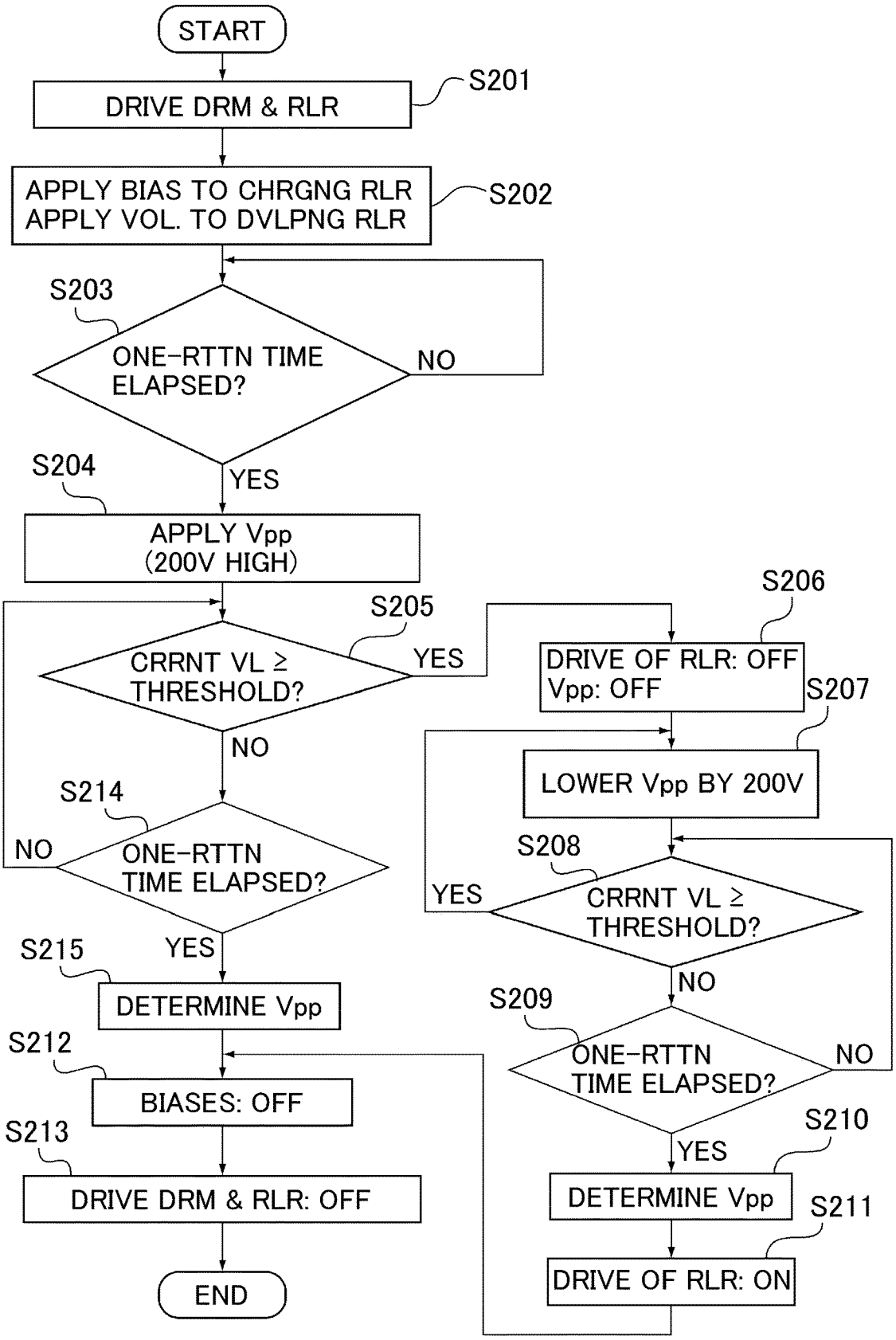

FIG. 16 is a flowchart showing a flow of a discharge occurrence detecting operation in an embodiment 5.

Figure 17:
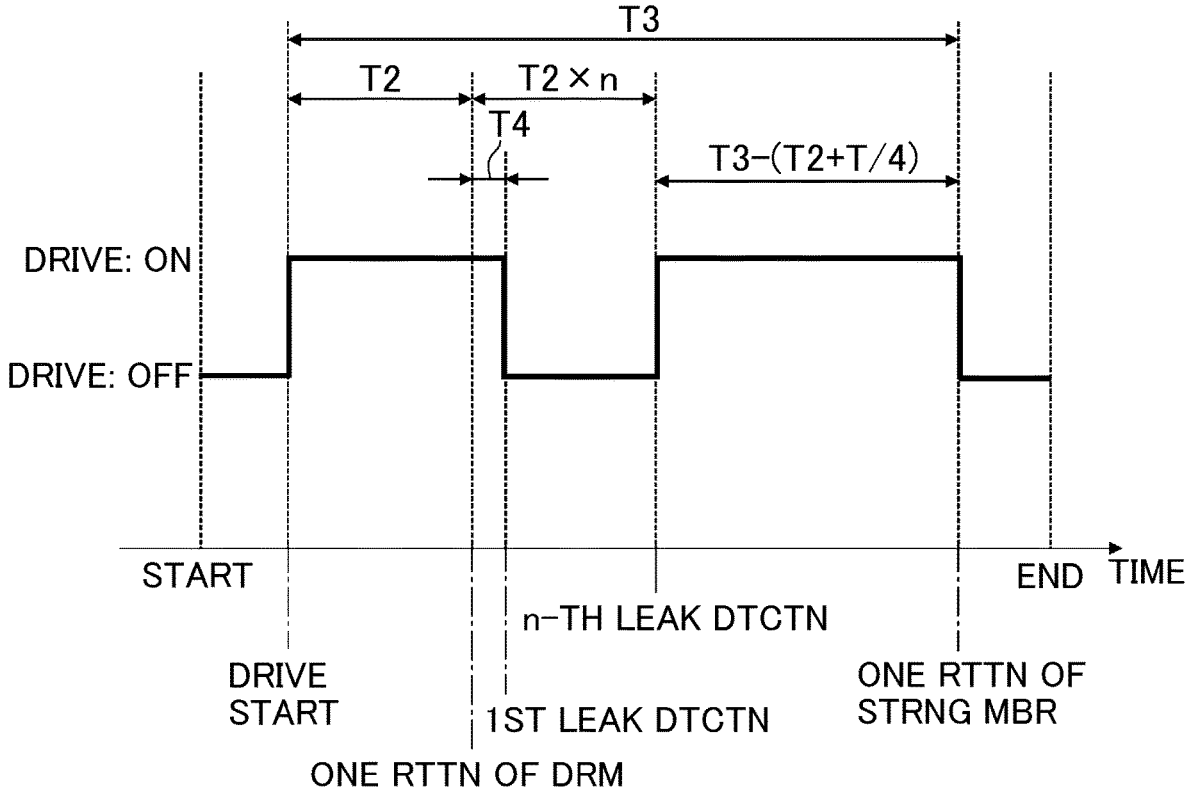

FIG. 17 is a timing chart showing drive timing of the discharge detecting operation in the embodiment 5.

Figure 18:
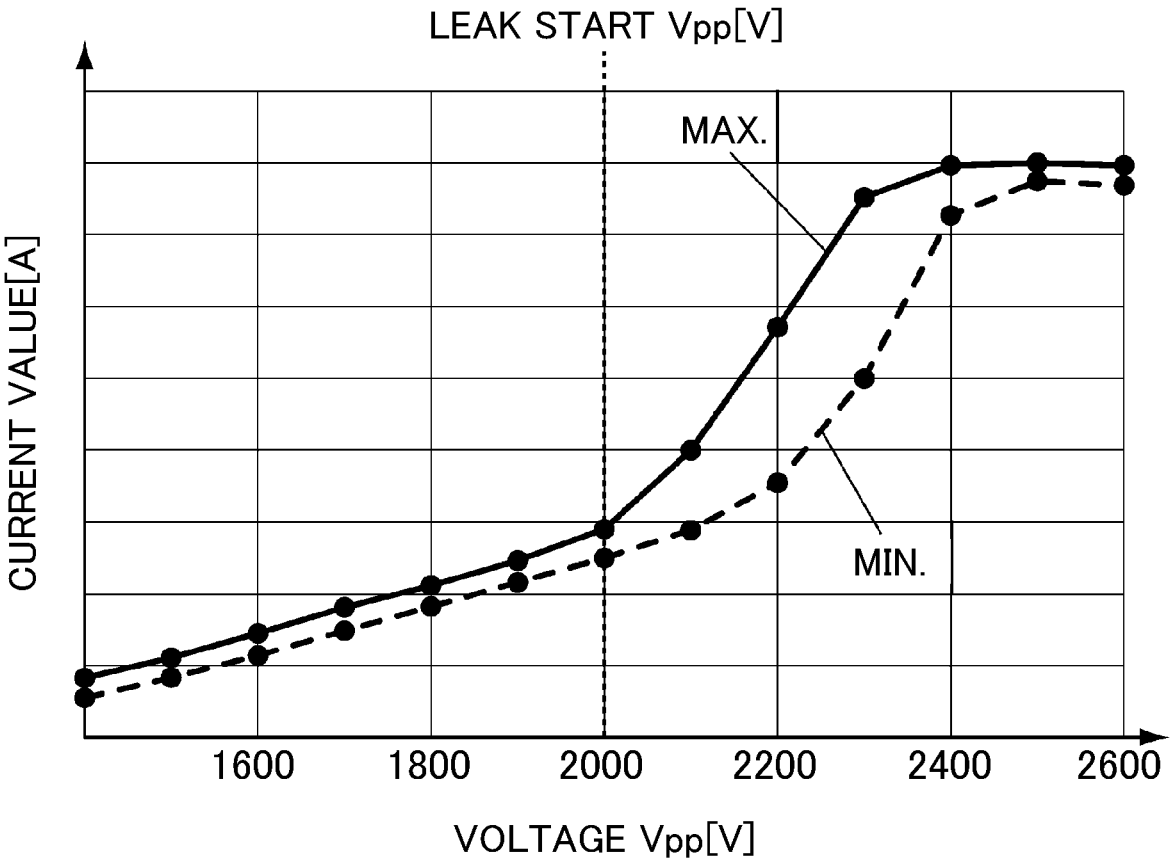

FIG. 18 is a relationship graph between an AC voltage and a current value in an embodiment 6.

Figure 19:
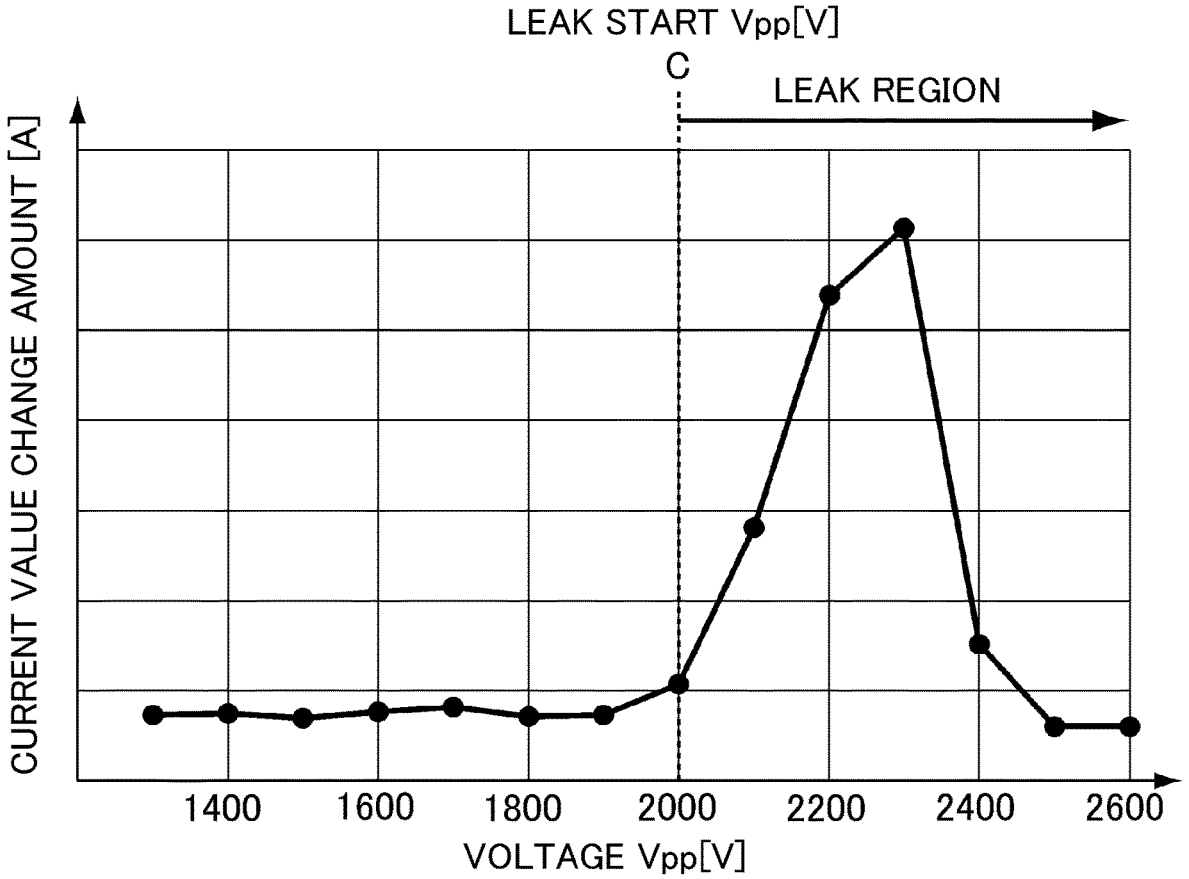

FIG. 19 is a relationship graph between the AC voltage and a change amount of the current value in the embodiment 6.

Figure 20:
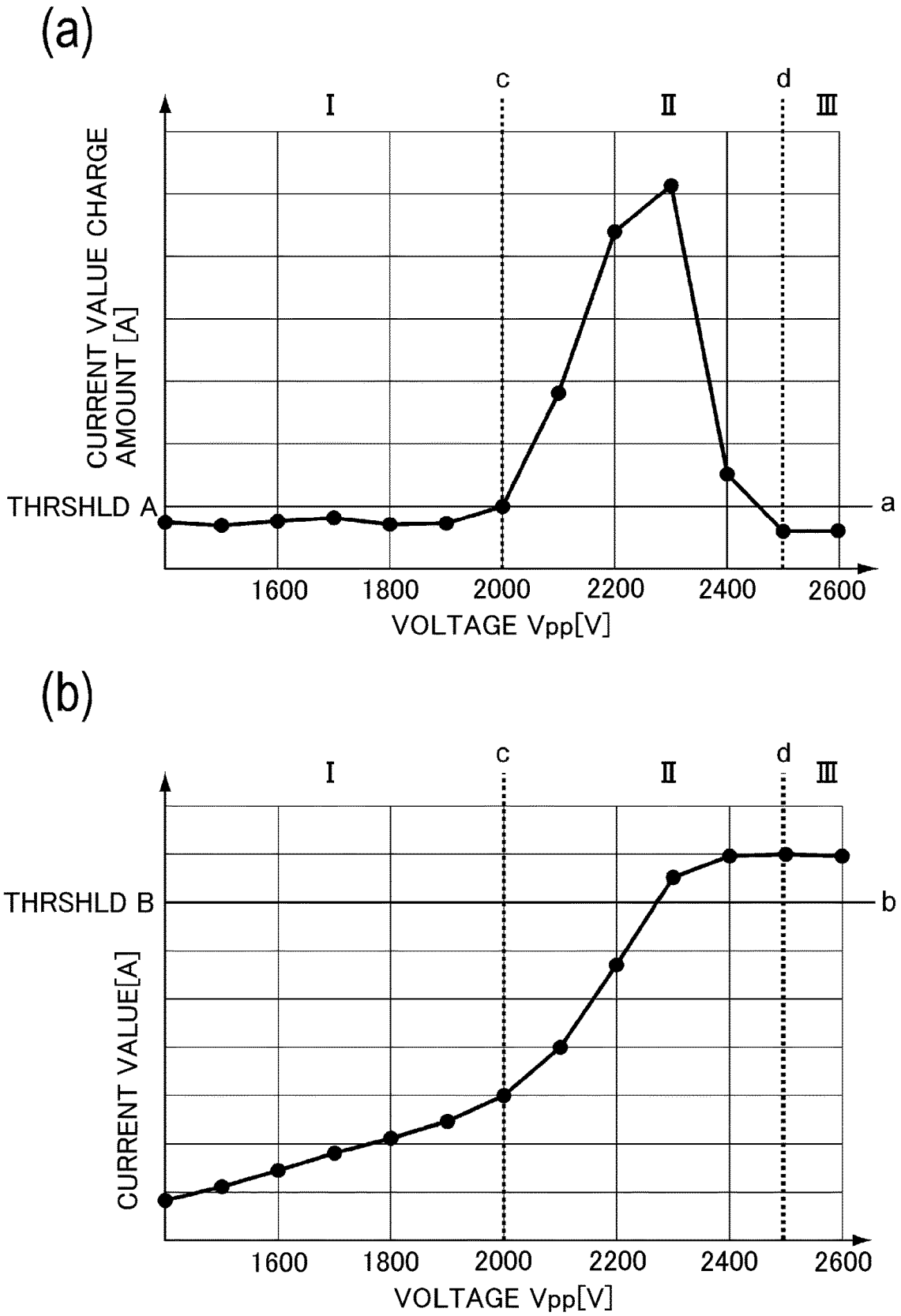

Part (a) of FIG. 20 is a relationship graph between a peak-to-peak voltage Vpp and a leakage discrimination threshold of a current value in the embodiment 6, and part (b) of FIG. 20 is a relationship graph between the peak-to-peak voltage Vpp and a leakage discrimination threshold of a change amount of the current value in the embodiment 6.

Figure 21:
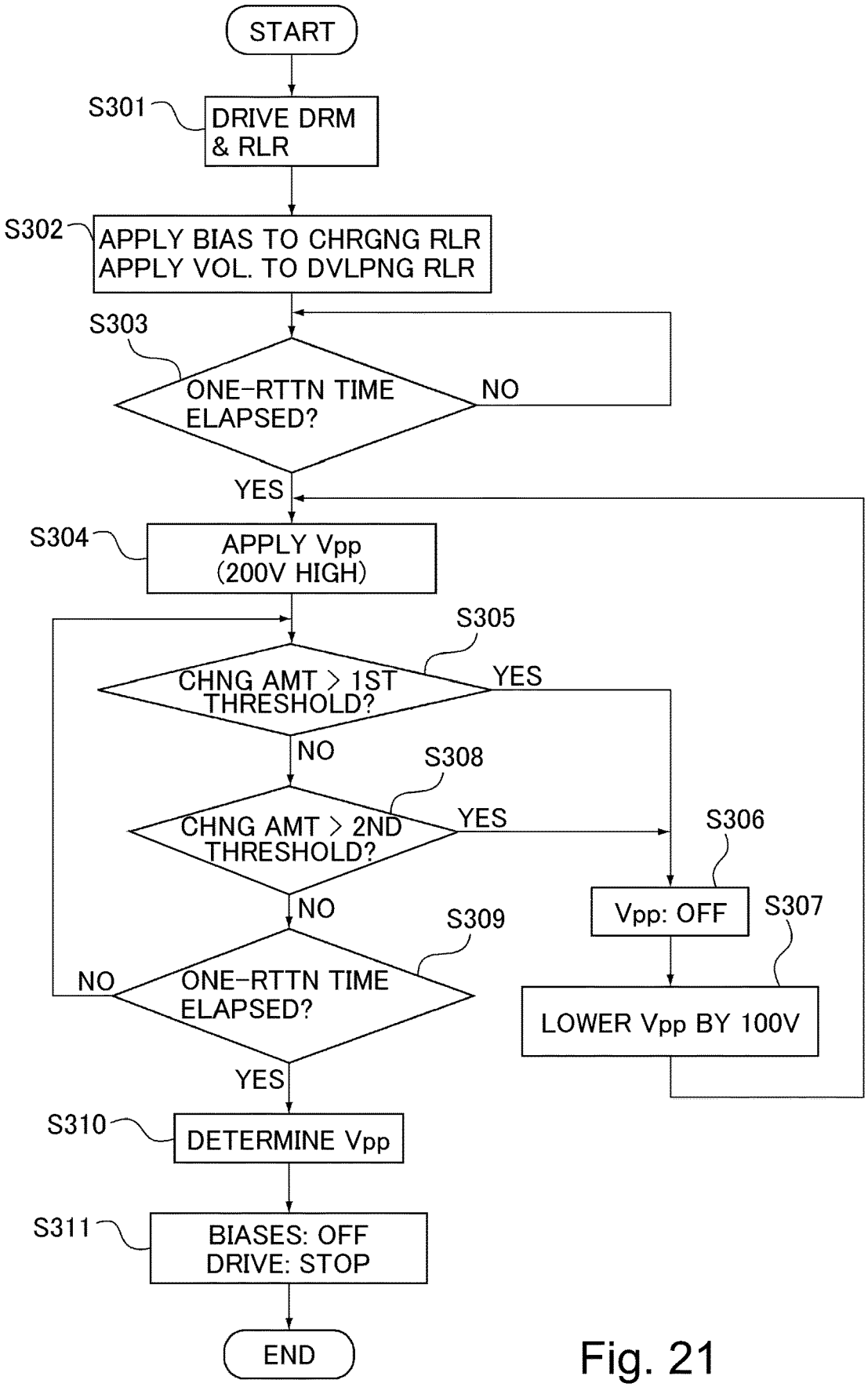

FIG. 21 is a flowchart of discharge detection control in the embodiment 6.

Figure 22:
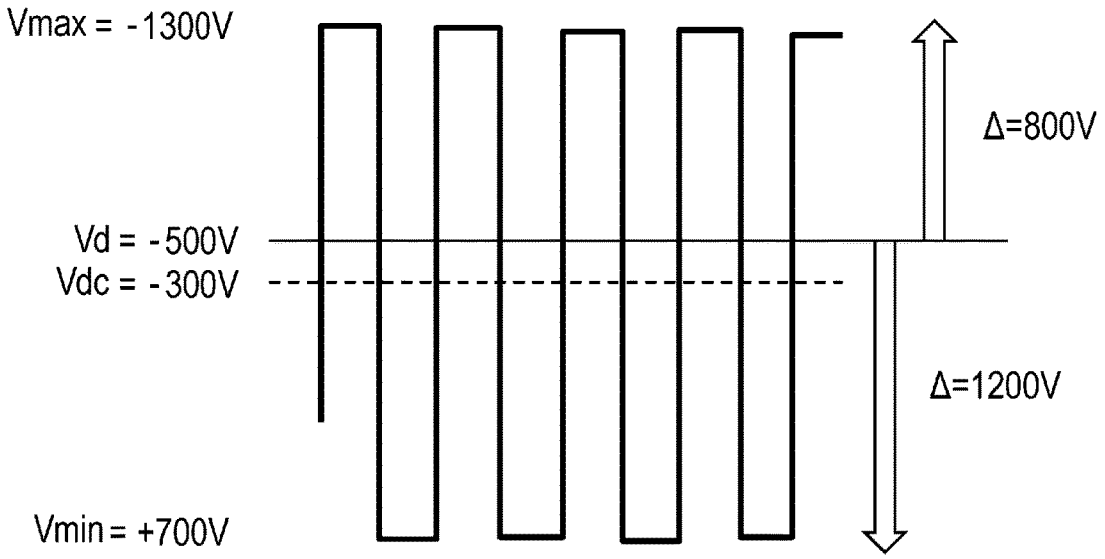
Figure 22:
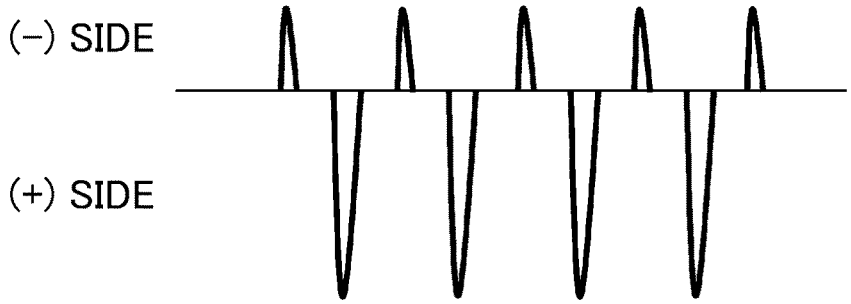

Parts (a) and (b) of FIG. 22 are relationship charts of potentials of a photosensitive drum and a developing roller in the embodiment 6.

Figure 23:
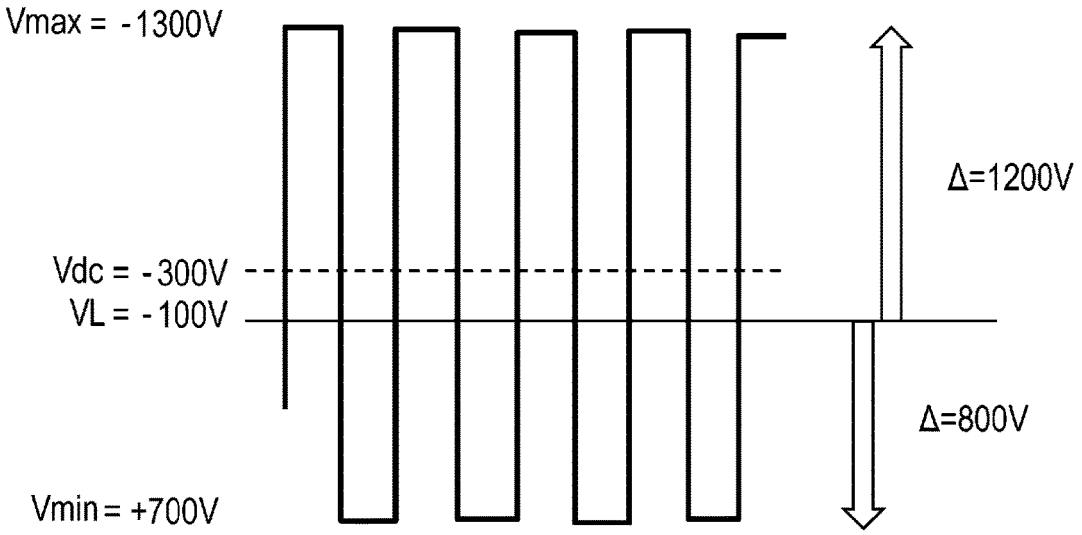
Figure 23:
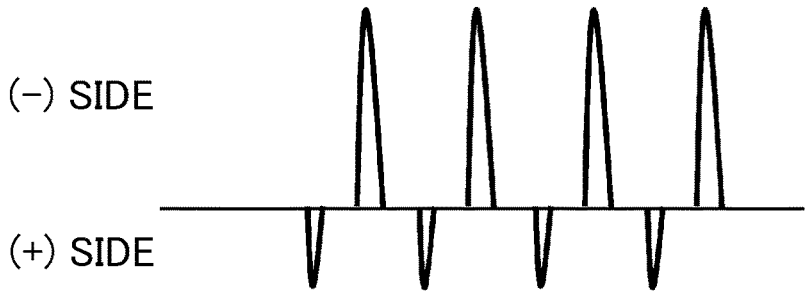

Parts (a) and (b) of FIG. 23 are relationship charts of potentials of the photosensitive drum and the developing roller in the embodiment 6.

DESCRIPTION OF THE EMBODIMENTS

In the following, embodiments of the present invention will be specifically described exemplarily. However, dimensions, materials, shapes, and relative arrangement of constituent elements described in the following embodiments should be appropriately changed depending on structures and various conditions of apparatuses to which the present invention is applied, and the scope of the present invention is not intended to be limited to the following embodiment.

Figure 1:
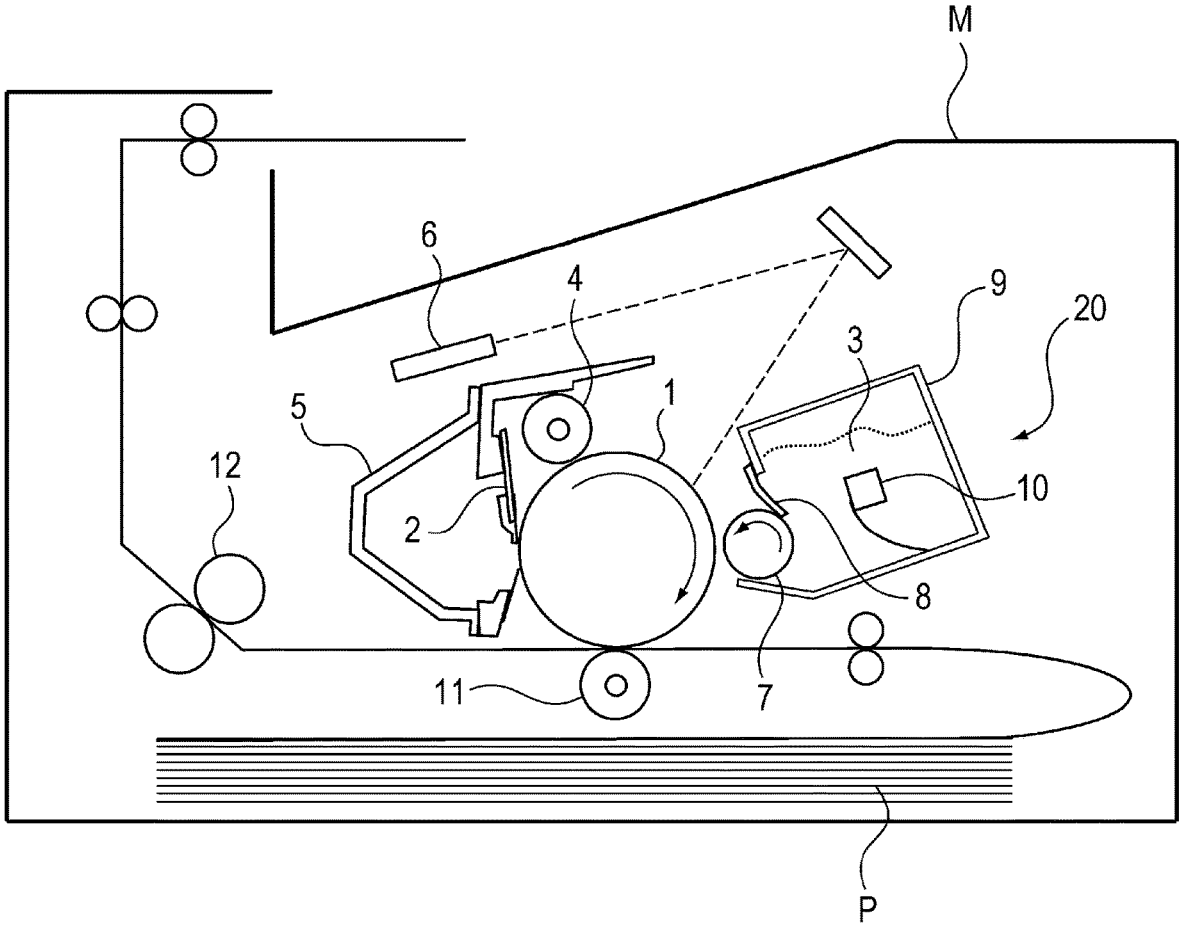
FIG. 1 is a sectional view of an image forming apparatus.

With reference to FIG. 1, a general structure of an image forming apparatus will be described together with an image forming operation. FIG. 1 is a schematic sectional view showing the general structure of the image forming apparatus according to an embodiment 1 of the present invention.

<Image Forming Apparatus>

The image forming apparatus is a laser (beam) printer using an electrophotographic type, and a process cartridge 20 is constituted so as to be mountable to and dismountable from an apparatus main assembly M. Here, the apparatus main assembly M refers to constituent elements excluding the process cartridge 20 from the image forming apparatus. Further, the image forming apparatus to which the present invention is applicable is not limited to those described herein. For example, the present invention is also applicable to a color laser printer which includes a plurality of process cartridges 20 and which forms a color image by transferring a plurality of toner images through an intermediary transfer belt (intermediary transfer member).

A photosensitive drum 1 is an image bearing member (member to be charged) including an OPC (organic photoconductor) photosensitive layer formed on an outer peripheral surface of an electroconductive drum and which is rotationally driven in an arrow direction of FIG. 1 at a predetermined process speed by drive transmission thereto from an unshown driving mechanism in the apparatus main assembly.

A charging roller 4 as a charging member electrically changes uniformly a surface of the photosensitive drum 1 to a predetermined polarity and a predetermined potential. A laser beam scanner 6 as an exposure portion subjects the charged photosensitive drum 1 to scanning exposure (irradiation) to laser light depending on image information, so that an electrostatic latent image is formed on the surface of the photosensitive drum 1.

A developing device as a developing portion develops the electrostatic latent image, formed on the surface of the photosensitive drum 1, with toner as a developer. The developing device is constituted by a developing roller 7, a developing blade 8 and a developing container 9. The developing roller 7 is provided opposed to the photosensitive drum 1 and is a developer carrying member for supplying the toner to the photosensitive drum 1. The developing blade 8 is a regulating member for regulating a layer thickness of the toner carried on the developing roller 7 and for imparting electric charges to the toner. The developing container 9 is a developer accommodating portion for accommodating the toner supplied to the photosensitive drum 1.

The developing roller 7 is rotationally driven in an arrow direction of FIG. 1 by drive transmission from an unshown driving source in the apparatus main assembly. On the surface of the developing roller 7, a toner layer (magnetic chain) to which the electric charges are imparted by the developing blade 8 is formed. Then, to the developing roller 7, a developing bias in a combination form of a DC voltage and an AC voltage is applied, so that the toner image carried on the developing roller 7 is moved (flown) to the photosensitive drum 1 by an electric field of the developing bias, and thus the electrostatic latent image formed on the surface of the photosensitive drum 1 is developed into a toner image.

On the other hand, a recording medium P is fed by an unshown feeding roller, and in a nip between the photosensitive drum 1 and a transfer roller 11, the toner image (developer image) formed on the photosensitive drum 1 is transferred onto the recording medium P. The recording medium P on which the toner image is transferred is separated from the surface of the photosensitive drum 1 and is sent to a fixing device 12, in which the transferred toner image is heated and pressed, and thus is fixed on the recording medium P.

Toner remaining on the surface of the photosensitive drum 1 without being transferred onto the recording medium P is removed by a cleaning blade 2 as a cleaning portion for cleaning the photosensitive drum 1 in contact with the photosensitive drum 1 and is accommodated in a cleaning container 5. Thereafter, the surface of the photosensitive drum 1 is charged again by the charging roller 4, and the above-described steps are repeated, so that a series of image forming cycles is carried out.

In this embodiment, the photosensitive drum 1, the charging roller 4, the cleaning blade 2, the cleaning container 5, the developing roller 7, the developing blade 8, and the developing container 9 are integrally assembled into the process cartridge 20. Further, the process cartridge 20 is mountable to and dismountable from the apparatus main assembly M of the image forming apparatus.

<Discharge Detection Constitution Between Photosensitive Drum and Developing Roller.

Figure 2:
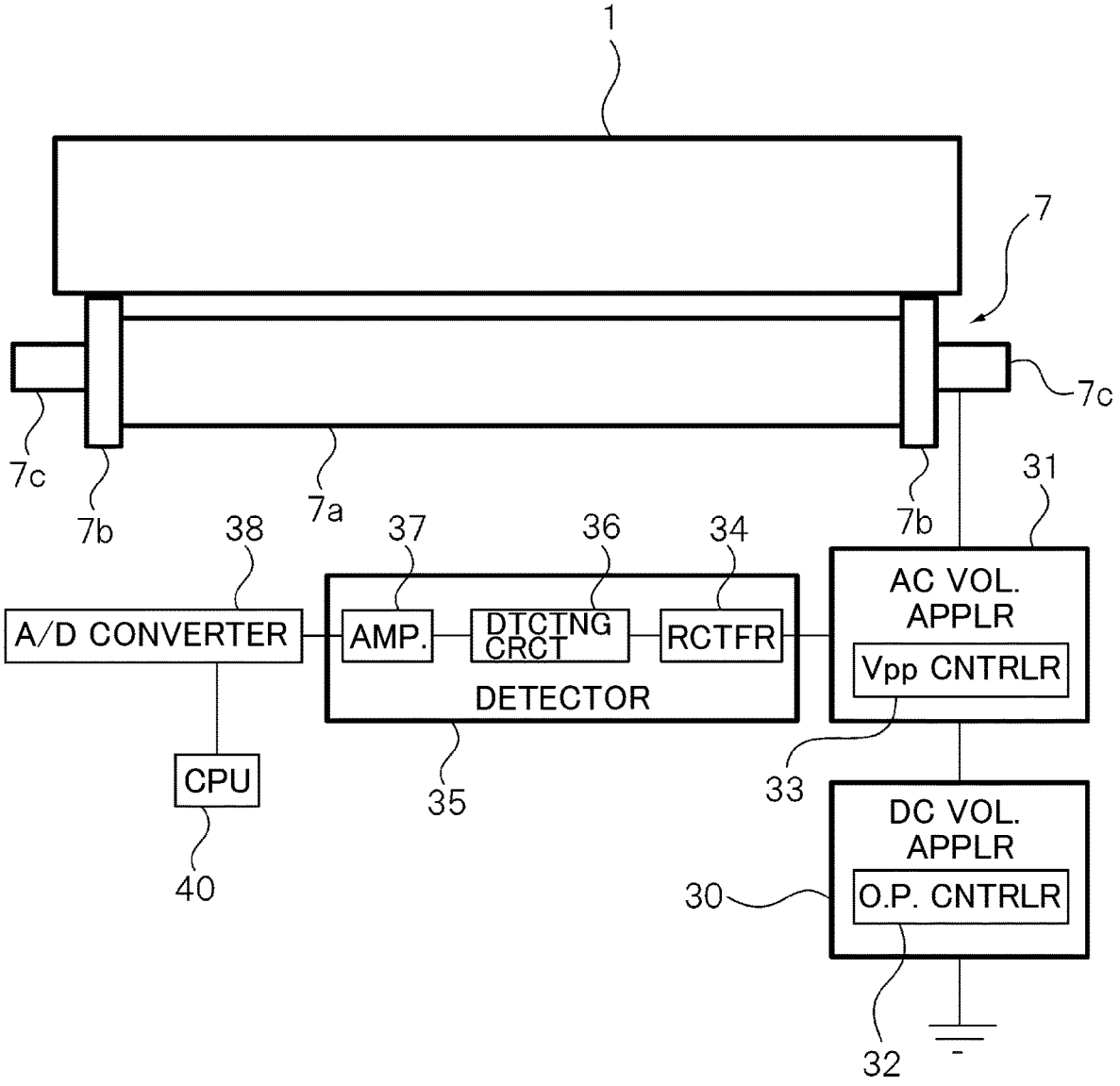
FIG. 2 is a schematic view for illustrating a constitution relating to developing bias application and electric discharge detection.

Next, with reference to FIG. 2, a constitution relating to application of the developing bias to the developing roller 7 and detection of electric discharge between the photosensitive drum 1 and the developing roller 7 will be described. FIG. 2 is a schematic view for illustrating the constitution relating to the developing bias application and the discharge detection.

As shown in FIG. 2, the developing roller 7 includes a sleeve 7*a* for carrying the toner during image formation, and into opposite end portions of the sleeve 7*a* with respect to a longitudinal direction, circular caps 7*b* are engaged. The developing roller 7 is rotationally driven about a roller shaft 7*c*. In this embodiment, an outer diameter of the photosensitive drum 1 is 30 mm, and an outer diameter of the developing roller 7 is 15 mm smaller than the outer diameter of the photosensitive drum 1, and both the photosensitive drum 1 and the developing roller 7 are rotationally driven at a peripheral speed of 300 mm/s.

Further, the developing roller 7 is provided with a predetermined gap (SD gap) between itself and the photosensitive drum 1 so as to be opposite the photosensitive drum 1 in a non-contact state. In this embodiment, the caps 7*b* have an outer diameter larger than the sleeve 7*a*, so that outer peripheral surfaces of the caps 7*b* contact the surface of the photosensitive drum 1. By this, the predetermined gap is provided between the developing roller 7 and the photosensitive drum 1, so that the developing roller 7 and the photosensitive drum 1 are opposed to each other in the non-contact state. In this embodiment, as the predetermined gap, the SD gap of 200 μm is provided.

Incidentally, a constitution in which the predetermined gap is provided between the developing roller 7 and the photosensitive drum 1 is not limited thereto. For example, a constitution in which the predetermined gap is provided between the developing roller 7 and the photosensitive drum 1 by a frame rotatably supporting the developing roller 7 and the photosensitive drum 1 may also be employed.

Further, to the roller shaft 7*c* of the developing roller 7, in order to supply the toner to the photosensitive drum 1, a DC voltage applying portion 30 and an AC voltage applying portion 31 are connected. The DC voltage applying portion 30 and the AC voltage applying portion 31 are applying portions for applying, to the developing roller 7, a developing bias in a combination form of a DC voltage and an AC voltage.

The DC voltage applying portion 30 is a circuit for generating a DC component applied to the developing roller 7, and output thereof is inputted to the AC voltage applying portion 31. Further, the DC voltage applying portion 30 includes an output controller 32. The output controller 32 controls a value of a bias outputted from the DC voltage applying portion 30, depending on an instruction of a CPU 40 as a controller.

Further, the AC voltage applying portion 31 is a circuit for outputting an AC voltage with an average (areal center value) of the DC voltage outputted from the DC voltage applying portion 30. The AC voltage applying portion 31 outputs, for example, an AC voltage in a rectangular waveform shape (pulse shape) including a frequency f=2.5 kHz and a duty of 50%. Further, the AC voltage applying portion 31 includes a Vpp controller 33. The Vpp controller 33 controls Vpp which is a peak-to-peak voltage (peak-to-peak value) of the AC voltage, depending on instruction of the CPU 40 as the controller.

A detecting portion 35 is a detecting portion for detecting a current value of a current flowing between the photosensitive drum 1 and the developing roller 7. The detecting portion 35 is constituted by a rectifying portion 34, a detecting circuit 36 and an amplifier 37. The rectifying portion 34 rectifies the current flowing between the developing roller 7 and the photosensitive drum 1 during application of the developing bias in the combination form of the DC voltage and the AC voltage. The detecting circuit 36 converts the rectified current into a voltage. The amplifier 37 amplifies a converted voltage signal and outputs the amplified voltage signal as a discharge detection signal to the CPU 40. An A/D converter 38 subjects the discharge detection signal from the amplifier 37, to A/D conversion. The CPU 40 recognizes a magnitude of a current value generating between the developing roller 7 and the photosensitive drum 1, on the basis of the output of the amplifier 37 subjected to the A/D conversion by the A/D converter 38, and outputs a current value of the current averaged in a periodic time T of the AC voltage. Here, the CPU 40 outputs (calculates) the current value (average) averaged in 4 ms which is a 10 periodic time T. Although described later, the CPU 40 is a controller for controlling a developing bias applied to the developing roller 7, on the basis of the current value detected by the detecting portion 35.

<Detection of Leak(age) Current Value>

With reference to FIG. 3, detection (discharge detection) of a leak current value by the detecting portion 35 will be described. Part (a) of FIG. 3 is a waveform graph of current values when the peak-to-peak voltage Vpp is changed, and part (b) of FIG. 3 is a relationship graph between the AC voltage and a change amount (difference between a maximum value and a minimum value) of the current value in the embodiment 1.

In part (a) of FIG. 3, the current values of currents flowing between the developing roller 7 and the photosensitive drum 1 when the peak-to-peak voltage Vpp of the AC voltage in the developing bias is changed are plotted, and an abscissa represents a time and an ordinate represents the current value after being rectified.

As a measuring condition, the photosensitive drum 1 and the developing roller 7 are driven by unshown driving mechanisms. Then, a surface potential of the photosensitive drum 1 is made −500 V by applying a charging bias to the charging roller 4, and a DC voltage of −300 V is applied to the developing roller 7 by the DC voltage applying portion 30. Then, a peak-to-peak voltage Vpp of the AC voltage is applied to the developing roller 7 by the AC voltage applying portion 31. At this time, as shown in part (b) of FIG. 3, the peak-to-peak voltage Vpp is increased stepwise from 1600 V by 200 V with a predetermined time interval (1 s in this embodiment), and a relationship between a time in each of the peak-to-peak voltages Vpp and an output value of the current value is plotted. At the AC voltages Vpp of 1.8 kV and 2.0 kV, the leak current does not generate, but at the AC voltage Vpp of 2.2 kV, the leak current generates. Compared with during non-generation of the leak current, during generating of the leak current, the leak current fluctuates at a rotation period of the developing roller 7. This is because a region where the leak current generates fluctuates at the rotation period of the developing roller 7. The distance (SD gap) between the developing roller 7 and the photosensitive drum 1 fluctuates depending on non-uniformity of a shape of the cap 7*b*.

When the developing roller 7 is rotated, at the rotation periods of the developing roller 7 and the photosensitive drum 1, the distance between the developing roller 7 and the photosensitive drum 1 fluctuates. By the Paschen's law, it is understood that in a gap region of 200 μm which is the distance between the developing roller 7 and the photosensitive drum 1 in this embodiment, a discharge start voltage becomes low when the distance between the developing roller 7 and the photosensitive drum 1 decreases. The distance (SD gap) between the developing roller 7 and the photosensitive drum 1 is not uniform with respect to an axial direction of the developing roller 7, and therefore, the leak current generates in a part, where the distance (SD gap) is short, of the gap region with respect to the axial direction between the developing roller 7 and the photosensitive drum 1. With respect to the axial direction of the developing roller 7, when the SD gap changes, the region where the leak current generates also changes, and therefore, the current value fluctuates depending on the change in region where the leak current generates. Therefore, as shown in part (a) of FIG. 3, in a situation of the peak-to-peak voltage Vpp=2.2 kV of the AC voltage at which the leak current generates, the current value fluctuates at the rotation periods of the photosensitive drum 1 and the developing roller 7. The fluctuation of the current value occurs at a rotation period (157 ms in this embodiment) smaller (shorter) than the rotation period of the photosensitive drum 1. For that reason, the CPU 40 outputs the current value averaged in the periodic time (time of one period or more) of the AC voltage, so that the CPU 40 is capable of discriminating between accidental noise and a current change due to the leakage. Incidentally, in this embodiment, the current value averaged in 4 ms which is the time of 10 periods as the periodic time T of the AC voltage is outputted, but from the viewpoint of noise removal, the periodic time T in which the output is averaged may also be increased up to several tens of ms.

In this embodiment, compared with a time of 157 ms (time T1) until the developing roller 7 rotates through one-full-circumference, a time of 314 ms (time T2) until the photosensitive drum 1 rotates through one-full-circumference is long. For that reason, the CPU 40 which is the controller makes comparison with a threshold by using a current value change amount which is a difference between a maximum value and a minimum value of an output value (average) of a current value in the time T2 which is long in one rotation time and in which the photosensitive drum 1 rotates through one-full-circumference. In part (b) of FIG. 3, progression (solid line) of the maximum value of the output value of the current value when the peak-to-peak voltage Vpp of the AC voltage is changed and progression (broken line) of the minimum value of the output value of the current value when the peak-to-peak voltage Vpp is changed are plotted. Incidentally, a relationship between the AC voltage and the current value change amount which is the difference between the maximum value and the minimum value of the output value of the current value is shown in part (b) of FIG. 4. In part (b) of FIG. 3, the abscissa represents the peak-to-peak voltage Vpp of the AC voltage applied to the developing roller 7, and the ordinates represents the maximum value (solid line) and the minimum value (broken line) of the current value (output value) in the time in which the photosensitive drum 1 rotates one-full-circumference. A difference between the maximum value and the minimum value of this current value is the current value change amount. As a measuring condition, the photosensitive drum 1 and the developing roller 7 are driven by the unshown driving mechanisms. Then, a surface potential of the photosensitive drum 1 is made −500 V by applying a charging bias to the charging roller 4, and a DC voltage of −300 V is applied to the developing roller 7 by the DC voltage applying portion 30. Then, a peak-to-peak voltage Vpp of the AC voltage is applied to the developing roller 7 by the AC voltage applying portion 31. At this time, the peak-to-peak voltage Vpp is increased stepwise from 1600 V by 200 V with a predetermined time interval (1 s in this embodiment), and the maximum value and the minimum value of the current value at each of the peak-to-peak voltages Vpp are plotted. This difference between the maximum value and the minimum value of the current value at each of the peak-to-peak voltages Vpp is the current value change amount. When the peak-to-peak voltage Vpp in the developing bias is increased stepwise, relative to the current value change amount during non-generation of the leakage, the current value change amount abruptly increases at leak generation timing. That is, it is understood that the leakage does not generate when the current value change amount is threshold or less (2.0 kV or less in this embodiment) which is a predetermined value, but the leakage generates when the current value change amount exceeds the threshold.

From the above, the CPU 40 which is the controller is capable of detecting generation or non-generation of the leakage of the current at a predetermined peak-to-peak voltage Vpp from the current value change amount of the current flowing between the photosensitive drum 1 and the developing roller 7.

Next, with reference to parts (a) and (b) of FIG. 4, a relationship between the peak-to-peak voltage Vpp of the AC voltage and the current value change amount in a comparison example and the embodiment 1 will be described. Part (a) of FIG. 4 is a graph showing a relationship between the peak-to-peak voltage Vpp of the AC voltage and the current value change amount in the comparison example. Part (b) of FIG. 4 is a graph showing a relationship between the peak-to-peak voltage Vpp of the AC voltage and the current value change amount in the embodiment 1. Incidentally, the current value change amount shown in part (b) of FIG. 4 represents the difference between the maximum value and the minimum value of the current value shown in part (b) of FIG. 3.

In the constitution of the comparison example, an integrated value of an absolute value of the current value of the current flowing between the photosensitive drum 1 and the developing roller 7 in a period of the periodic time T of the AC voltage is the output value. The abscissa represents the peak-to-peak voltage Vpp of the AC voltage, and the ordinate represents the output value.

As a measuring condition, the photosensitive drum 1 and the developing roller 7 are driven by unshown driving mechanisms. Then, a surface potential of the photosensitive drum 1 is made −500 V by applying a charging bias to the charging roller 4, and a DC voltage of −300 V is applied to the developing roller 7 by the DC voltage applying portion 30. Then, a peak-to-peak voltage Vpp of the AC voltage is applied to the developing roller 7 by the AC voltage applying portion 31. At this time, the peak-to-peak voltage Vpp is increased gradually, and a relationship between the peak-to-peak voltage Vpp and the output value of the current value is plotted. In part (a) of FIG. 4, it is understood that even when the peak-to-peak voltage Vpp is a voltage not more than the discharge start voltage Vpp which is the threshold, the output value which is the current value increases in proportion to the peak-to-peak voltage Vpp.

A slope of the output value at the peak-to-peak voltage Vpp which is the threshold or less (discharge start voltage or less) is determined by impedance between the photosensitive drum 1 and the developing roller 7 and therefore changes depending on the SD gap or the like. For that reason, the output value varies depending on variation in component part of the cap 7*b* and abrasion due to durable use of the cap 7*b*. Therefore, a current value at which the leakage generates cannot be accurately calculated when the SD gap fluctuates due to abrasion and variation in component part of the cap 7*b* in a use status. In order to discriminate the generation and non-generation of the leakage with accuracy, there is a need to acquire the impedance between the photosensitive drum 1 and the developing roller 7 by using the peak-to-peak voltage Vpp at which the leakage does not generate. For detection of the leakage, there is a need to measure the impedance at the peak-to-peak voltage Vpp at which the leakage does not generate, and therefore, it takes much time to detect the generation of the leakage.

On the other hand, the constitution in this embodiment is as described above with reference to part (b) of FIG. 3. In the constitution in this embodiment, discrimination of the generation or non-generation of the leakage is made by using the current value change amount which is the difference between the maximum value and the minimum value of the output value (average) of the current value in the time T2 in which the photosensitive drum 1 rotates through one-full-circumference. As shown in part (b) of FIG. 4, it is understood that the current value change amount is substantially unchanged at the voltage which is not more than the discharge start voltage Vpp which is the threshold. Further, it is understood that the current value change amount abruptly increases when the peak-to-peak voltage Vpp exceeds the discharge start voltage Vpp which is the threshold. That is, it is understood that the leakage does not generate at the voltage more than the threshold (i.e., not more than the discharge start voltage Vpp) at which the current value change amount is a predetermined value, but the leakage generates when the voltage exceeds the predetermined value. Therefore, by determining the developing bias (AC voltage) applied to the developing roller 7 on the basis of the current value change amount of the current flowing between the photosensitive drum 1 and the developing roller 7, variation in current value due to the fluctuation of the SD gap or the like can be eliminated. For that reason, in this embodiment, without measuring the impedance between the photosensitive drum 1 and the developing roller 7, the developing bias (AC voltage) applied to the developing roller 7 from the current value change amount of the current value flowing between the photosensitive drum 1 and the developing roller 7 at an arbitrary applied voltage can be determined, so that a time requiring for setting the developing bias at a developing bias at which the leakage does not generate can be shortened.

<Setting of AC Voltage in Discharge Occurrence Detecting Operation>

Next, on the basis of parts (a) and (b) of FIG. 5, timing of each of applied voltages during a discharge driving operation of the image forming apparatus according to the embodiment 1 will be described in comparison with the comparison example. Part (a) of FIG. 5 is a timing chart as to setting of the AC voltage Vpp during detection of discharge occurrence and the leak current in the comparison example, and part (b) of FIG. 5 is a timing chart as the setting of the AC voltage Vpp during detection of discharge occurrence and the leak current in the embodiment 1.

Part (a) of FIG. 5 shows the constitution of the comparison example, and part (b) of FIG. 5 shows the constitution of the embodiment 1. In the constitution of the comparison example shown in part (a) of FIG. 5, compared with the constitution of the embodiment 1 shown in part (b) of FIG. 5, first, a measuring time for measuring the impedance between the photosensitive drum 1 and the developing roller 7 is needed. The impedance between the photosensitive drum 1 and the developing roller 7 changes depending on the image formation of the SD gap by the drive of the photosensitive drum 1 and the developing roller 7. For that reason, in the period of the time T2 in which the photosensitive drum 1 rotates through one-full-circumference, the current flowing between the photosensitive drum 1 and the developing roller 7 is measured, and then the impedance is acquired by using a current value which is the maximum value at timing when the SD gap is narrowest. A subsequent operation will be described with reference to part (b) of FIG. 5 since the setting of the voltage Vpp and the timing are similar to those in the embodiment 1.

The voltage Vpp during the discharge occurrence detecting operation is determined on the basis of the voltage Vpp during the image formation. As regards the voltage Vpp during the image formation, as initial setting, the voltage Vpp is set at 1.8 kV. When the voltage Vpp exceeds 1.8 kV, so-called white void such that the toner is deposited on a white background portion of the recording medium P is deteriorated, and therefore, an upper limit of the voltage Vpp is set at 1.8 kV.

As regards the voltage Vpp during the detection of the discharge occurrence, in consideration that the discharge start voltage which is the threshold changes depending on a change in temperature and humidity during sheet passing and the fluctuation of the SD gap, the voltage Vpp during an initial discharge occurrence detecting operation is set at 2.0 kV obtained by adding an offset value of 200 V to 1.8 kV. That is, the AC voltage Vpp applied to the developing roller 7 when compared with the threshold is an AC voltage (2.0 kV in this embodiment) which is higher than the AC voltage (1.8 kV in this embodiment) applied to the developing roller 7 during the image formation. In the case where the CPU 40 discriminated that the current value change amount of the current flowing between the photosensitive drum 1 and the developing roller 7, on the basis of the output value (average) of the current value when the voltage Vpp during the initial discharge occurrence detection is set at 2.0 kV, the CPU 40 does not change the voltage Vpp during image formation. On the other hand, in the case where the CPU 40 discriminated that the current value change amount of the current flowing between the photosensitive drum 1 and the developing roller 7 exceeds the threshold, as shown in part (b) of FIG. 5, the AC voltage Vpp applied to the developing roller 7 is lowered stepwise to the voltage Vpp at which the current value change amount is the threshold or less. Then, the voltage Vpp obtained by subtracting the offset value of 200 V from the voltage Vpp at which the current value change amount is the threshold or less is set again at the applied voltage Vpp during image formation. By this, it is possible to prevent occurrence of the leakage during image formation.

Further, as in this embodiment, by employing the constitution in which the voltage Vpp during detection of the discharge occurrence is lowered stepwise, compared with the conventional control of acquiring the discharge start voltage by increasing the voltage Vpp, the time required for setting the developing bias at which the leakage does not occur can be shortened. As a reason therefor, in the constitution in which the voltage Vpp is lowered stepwise, detection is ended at the time when discrimination that the current value change amount is the threshold or less at the voltage Vpp as the initial condition during leak detection was made, and therefore, the detection is ended at the voltage Vpp as a single condition in the shortest time. On the other hand, in the conventional constitution in which the voltage Vpp is gradually increased, the voltage Vpp is gradually increased from the voltage Vpp at which the leakage does not generate with reliability. For that reason, in the conventional constitution, there is a need that voltages Vpp falling under at least two conditions including the voltage Vpp at which the current value change amount is threshold or less with reliability and the voltage Vpp intended to be used in the image formation are compared with the threshold. From the above, by employing the constitution in which the voltage Vpp during the detection of the discharge occurrence is lowered stepwise, the time required for setting the developing bias at the developing bias where the leakage does not generate can be shortened.

<Flowchart of Discharge Occurrence Detecting Operation>

Next, with reference to FIG. 6, a flow of control of the discharge occurrence detecting operation of the image forming apparatus according to embodiment 1 will be described.

FIG. 6 is a flow chart showing an example of the flow of the control of the discharge occurrence detecting operation of the image forming apparatus according to the embodiment 1. In the discharge occurrence detecting operation described below, whether or not the current value change amount of the current flowing between the photosensitive drum 1 and the developing roller 7 exceeded is discriminated, and on the basis of a result thereof, the developing bias applied to the developing roller 7 is set. The discharge occurrence detecting operation is executed by the CPU 40 (FIG. 2) which is the controller. Incidentally, this discharge occurrence detecting operation is executed when an installation environment of the image forming apparatus, such as atmospheric pressure, a temperature or a humidity, changes. Or, the discharge occurrence detecting operation is executed in synchronism with a driving time of the developing roller 7 or the photosensitive drum 1 (for example, sheet passing history or exchange timing of the developing device which has a possibility that the SD gap changes). Further, execution timing of the discharge occurrence detecting operation is not limited to the above-described examples, but can be appropriately set.

First, when a power source of the image forming apparatus is turned on and the discharge occurrence detecting operation is started ("START"), by an instruction of the CPU 40, drive of rotatable members such as the photosensitive drum 1 and the developing roller 7 is started by the unshown driving mechanisms (step S1). This drive of each of the rotatable members is continued until the discharge occurrence detecting operation is ended. Then, a charging bias is applied to the charging roller 4, and a DC voltage of −300 V is applied to the developing roller 7 by the DC voltage applying portion 30 (step S2). From the step S2, the time (T2) in which the photosensitive drum 1 rotates through one-full-circumference elapsed (step S3), so that the surface potential of the photosensitive drum 1 becomes −500 V over a full circumference. Then, the AC voltage Vpp applied to the developing roller 7 is set. In consideration of a change in temperature and humidity during sheet passing and a fluctuation is SD gap, the AC voltage Vpp applied to the developing roller 7 is set at an AC voltage Vpp higher than the AC voltage Vpp in setting during image formation by an offset value (step S4). In this embodiment, the AC voltage Vpp applied to the developing roller 7 is set at an AC voltage Vpp 200 V higher than the AC voltage Vpp during image formation. Then, as described above with reference to part (b) of FIG. 4, the CPU 40 discriminates whether or not when the set AC voltage Vpp is applied to the developing roller 7, the current value change amount of the current flowing between the developing roller 7 and the photosensitive drum 1 exceeded the threshold which is the predetermined value (step S5). In this embodiment, the threshold is 1 μA. Here, the current value change amount is a difference between the maximum value and the minimum value of the output value (average) of the current value detected by the detecting portion 35 in the time T2 in which the photosensitive drum 1 rotates through one-full-circumference (one full turn).

Then, in the case where the current value change amount exceeded the threshold in the step S5, the leakage generates between the photosensitive drum 1 and the developing roller 7, and therefore, the CPU 40 puts the AC voltage Vpp of the developing bias in an OFF state (step S6). The reason why the AC voltage Vpp is put in the OFF state is that when development leakage once generates, the development leakage continued by continuous flow of the current, and therefore, the development leakage generating continuously is once discontinued (eliminated). Thus, in the case where the leakage generates, there is a need that setting of the AC voltage Vpp applied to the developing roller 7 during image formation is made smaller than setting of the AC voltage applied to the developing roller 7 during detection of the current value. Therefore, the CPU 40 which is the controller lowers the developing bias (AC voltage Vpp) applied to the developing roller 7 to a voltage lower than the AC voltage during detection of the current value (step S7). In this embodiment, the CPU 40 lowers the AC voltage to a voltage (for example, 1.7 kV) 100 V lower than the AC voltage (for example, 1.8 kV) during image formation. Then, the operation returns to the step S4, the AC voltage applied to the developing roller 7 is set at an AC voltage Vpp higher than a setting-changed AC voltage during image formation by the offset value. Thus, the AC voltage applied to the developing roller 7 during leak detection is lowered from 2.0 kV to 1.9 kV. Then, in the step S5, whether or not the current value change amount exceeds the threshold is checked again.

Incidentally, in the case where the current value change amount exceeded the threshold in the step S5, the CPU 40 lowers stepwise the AC voltage applied to the developing roller 7 during leak detection, and repeats the above-described operation until the current value change amount is threshold or less. That is, in the case where the CPU which is the controller detected in the step S5 that the current value change amount exceeded the threshold, the CPU 40 lowers stepwise the AC voltage applied to the developing roller 7 and then detects again whether or not the current value change amount exceeded the threshold.

In the case where the current value change amount does not exceed the threshold in the step S5, i.e., in the case where the current value change amount is the threshold or less, the operation in the step S5 is repeated in a period of the time T2 in which the photosensitive drum 1 rotates through one-full-circumference from application of the AC voltage Vpp (step S8). In the case where the current value change amount is the threshold or less in the period, the CPU 40 determines that a value lowered from the AC voltage Vpp at that time during leak detection by the offset value (200 V) is the AC voltage Vpp during image formation (step S9). That is, the CPU 40 determines the developing bias applied to the developing roller 7 without changing the developing bias (AC voltage Vpp) applied to the developing roller 7 during image formation. Then, the CPU 40 puts the developing bias and the charging bias in an OFF state, and thereafter, causes the driving mechanisms to stop the drive of the photosensitive drum 1 and the developing roller 7 (step S10), so that the CPU 40 ends the discharge occurrence detecting operation ("END").

From the above, according to this embodiment, by discriminating whether or not the current value change amount of the current flowing between the photosensitive drum 1 and the developing roller 7 exceeded the threshold, it is possible to shorten a time required for setting the developing bias at a developing bias at which the leakage does not generate (i.e., a developing bias at which the current value change amount is the threshold or less).

Incidentally, the SD gap, the charging bias, the developing bias, the threshold of the current value, and the like are not intended to be limited to those described herein unless otherwise specified.

Further, in this embodiment, the constitution in which the average of the current value outputted from the detecting portion 35 in the time of 10 periods (cyclic periods) of the AC voltage is calculated was described as an example, but the periodic time T of the AC voltage is not limited thereto. The periodic time may only be required to be appropriately set.

Further, in this embodiment, the constitution in which comparison with the threshold using the current value change amount is made in the period of the time in which the photosensitive drum 1 rotates through one-full-circumference was described as an example, but the period in which the comparison with the threshold is made is not limited thereto. The period may also be a time in which the photosensitive drum 1 rotates through a plurality of full circumferences or a time in which the developing roller 7 rotates. Further, the comparison with the threshold may also be ended before the photosensitive drum 1 or the developing roller 7 rotates through one-full-circumference. However, the distance (SD gap) between the photosensitive drum 1 and the developing roller 7 fluctuates in a rotation period (cyclic period) of the developing roller 7 and the photosensitive drum 1, and therefore, of the developing roller 7 and the photosensitive drum 1, the member of which one rotation time is longer may preferably be rotated. Further, for the purpose of shortening the time in which the developing roller 7 or the photosensitive drum 1 is rotated may preferably be short.

Further, in this embodiment, the constitution in which the detecting portion 35 shown in FIG. 2 includes the rectifying portion 34 is employed, and the rectifying portion 34 rectifies the current flowing through the developing roller 7, but the present invention is not limited to this constitution. For example, a constitution in which the detecting portion 35 does not include the rectifying portion 34 may also be employed. In this case, the discharge occurrence detecting operation may also be performed in the following manner.

For example, the detecting portion 35 detects a first current value of the current flowing between the photosensitive drum 1 and the developing roller on a positive side of the AC voltage applied to the developing roller 7 or a second current value of the current flowing between the photosensitive drum 1 and the developing roller 7 on a negative side of the AC voltage applied to the developing roller 7. Then, the CPU 40 which is the controller makes comparison with the threshold on the basis of a difference between a maximum value and a minimum value of the first current value or a difference between a maximum value and a minimum value of the second current value, which are detected by the detecting portion 35 in the time in which the developing roller 7 or the photosensitive drum 1 rotates through at least one-full-circumference. In the case where a change amount of the first current value which is the difference detected between the maximum value and the minimum value or a change amount of the second current value which is the difference between the maximum value and the minimum value exceeds the threshold, the CPU 40 lowers setting of the developing bias applied to the developing roller 7 so as to be smaller than setting of the AC voltage applied to the developing roller 7 during detection of the current value. In the case where the change amount of the first current value or the change amount of the second current value is the threshold or less, the CPU 40 does not change the setting of the developing bias applied to the developing roller 7.

Or, the CPU 40 which is the controller calculates a first average of the first current value or a second average of the second current value, which are detected by the detecting portion 35 in the periodic time of the AC voltage. Then, the controller makes comparison with the threshold on the basis of a difference between a maximum value and a minimum value of the calculated first average or a difference between a maximum value and a minimum value of the calculated second average, in the time in which the developing roller 7 or the photosensitive drum 1 rotates through at least one-full-circumference. In the case where a change amount of the first average which is the difference detect the maximum value and the minimum value or a change amount of the second average which is the difference between the maximum value and the minimum value exceeds the threshold, the CPU 40 lowers setting of the developing bias applied to the developing roller 7 so as to be smaller than setting of the AC voltage applied to the developing roller 7 during detection of the current value. In the case where the change amount of the first average or the change amount of the second average is the threshold or less, the CPU 40 does not change the setting of the developing bias applied to the developing roller 7.

Even when such a constitution is employed, the CPU 40 is capable of discriminating the current value change amount of the current flowing between the photosensitive drum 1 and the developing roller 7, and it is possible to shorten the time required for setting the developing bias at which the leakage does not generate (i.e., the developing bias at which the current value change amount is the threshold or less).

In this embodiment, the Vpp during image formation was controlled, but the Vpp is not limited thereto, and may also be a Vpp at any timing when the Vpp is applied. In this embodiment, during leak detection, the Vpp higher than the setting thereof during image formation is applied to the developing roller 7 (step S4 of FIG. 6), and then, the current value change amount of the current flowing between the photosensitive drum and the developing roller was compared with the threshold (step S5 of FIG. 6), but the present invention is not limited thereto. For example, the Vpp set at that time is applied to the developing roller while the Vpp applied to the developing roller is not increased, and then, the current value of the current flowing between the photosensitive drum and the developing roller may also be compared with the threshold. By doing so, even at any timing without being limited to the timing of the Vpp during image formation, the Vpp at that time is applied to the developing roller, so that the current value change amount of the current flowing between the photosensitive drum and the developing roller can be compared with the threshold. In this case, the time required for setting the developing bias at the developing bias at which the leakage does not generate can be further shortened.

Further, in this embodiment, in FIG. 6, the CPU discriminated that the leakage generated when the current value change amount exceeded the threshold (step S5), and the operation gone to the step S6 in which the CPU puts the developing Vpp in the OFF state, but the present invention is not limited thereto. For example, after the photosensitive drum 1 rotates through one-full-circumference from the application (step S4 of FIG. 6) of the Vpp (step S7 of FIG. 6), the CPU may also discriminate whether or not the current value change amount exceeded the threshold (step S5 of FIG. 6). By doing so, although the time required for setting the developing bias at the developing bias at which the leakage does not generate is longer than the time in the above-described embodiment 1, the time can be made shorter than the time in the conventional constitution. Further, it is possible to discriminate between a current change due to accidental noise and a current change due to the leakage resulting from a change in gap between the photosensitive drum and the developing roller, so that detection with high accuracy can be carried out.

Further, in the constitution of the embodiment 1, in order to set the developing Vpp, the difference between the maximum value and the minimum value of the output value (average) of the current value was used as the change amount and was compared with the threshold, but the present invention is not limited to this constitution.

As described in the embodiment 1, when the maximum value and the minimum value are employed as values compared with the threshold, there is a liability that detection accuracy lowers due to noise. Therefore, as a modified embodiment 1, for example, in a histogram, the maximum value of the current value in a period of one-full-circumference or more of the photosensitive drum 1 may be taken as a value of top n %, and the minimum value of the current value in the period may be taken as a value of lower m %. As a specific example of the modified embodiment 1, the output value is a current value averaged every 4 ms, and sampling is made in a period of 400 ms corresponding to one-full-circumference or more of the photosensitive drum 1 (in which 100 data are sampled). Of the sampled data, when n is 97% and m is 3%, the third highest output value of the 100 data is used instead of the maximum value and the third lowest output value is used instead of the minimum value. In the case where a difference between the third highest output value and the third lowest output value is the threshold or less, the CPU is capable of discriminating that the leakage generates. Incidentally, m and n can be appropriately set. Further, instead of the maximum value (minimum value), an average of values which are the top n % (lower m %) or more may also be used.

Further, as a modified embodiment 2, when a slope, which is a change amount of the output value (average) of the current value per unit time, in a graph in which the abscissa represents a time and the ordinate represents the current value or an absolute of the slope exceeds the threshold, the CPU discriminates that the leakage generated. In the case where the leakage does not generate, when the SD gap fluctuates, the current value fluctuates in inverse proportion to the SD gap. In the case where the leakage generated, at a generation position, the current abruptly changes, so that the slope abruptly changes. Therefore, in the case where the current abruptly changes more than the fluctuation in SD gap, the CPU is capable of discriminating that the leakage generated. As regards a threshold of the slope, for example, assuming that the current value changes by 1 μA in a one-full-circumference (one full turn) time (314 ms) of the photosensitive drum by the influence of the SD gap fluctuation and that the fluctuation in SD gap relative to the time is a sine wave, the threshold of the slope can be set at $2\pi/314$ (μA/ms). In part (a) of FIG. 3, when the Vpp is 1.8 kV and 2.0 kV, the slope is in a substantially unchanged state, whereas when the Vpp is 2.2 kV, the slope largely fluctuates.

Further, as a modified embodiment 3, the leakage generation can also be discriminated by checking a standard deviation which is a variation in current value. When the data of the output value (average) of the current value is sampled correspondingly to the one-full-circumference of the photosensitive drum, current output values corresponding to 78 samples can be acquired. In the case where the Vpp is 1.8 kV and 2.0 kV in part (a) of FIG. 3, the current value does not substantially change even when the time elapsed, and therefore, the above-described standard deviation of the current value is small. On the other hand, in the case of the Vpp of 2.2 kV at which the leakage generated, the standard deviation becomes large. Therefore, when the standard deviation of the current value exceeds a threshold, the CPU can discriminate that the leakage generated. As regards the threshold, for example, assuming that the current value changes by 1 μA in the one-full-circumference time (314 ms) of the photosensitive drum by the influence of the SD gap fluctuation and that the fluctuation in SD gap relative to the time is a sine wave, the standard deviation is 0.315 μA. Therefore, as an example of the threshold of the standard deviation, 0.315 μA may also be employed.

Incidentally, in the above-described modified embodiments 1 to 3, a calculating method of each of the parameters is merely an example, and the calculating method is not limited thereto when each of the parameters can be calculated by the calculating method.

An image forming apparatus according to an embodiment 2 will be described with reference to FIGS. 7 and 8. Incidentally, this embodiment is only different in discharge detection control from the embodiment 1, and other constitutions of this embodiment are substantially similar to those of the embodiment 1. Therefore, in this embodiment, constituent elements similar to those of the embodiment 1 are represented by the same reference numerals or symbols and will be omitted from detailed description.

<Detection of Leak Current>

Detection of the leak current by the detecting portion 35, which is a feature of this embodiment will be described with reference to FIG. 7. FIG. 7 is a waveform chart of the AC voltage and the current value in developing bias application in the embodiment 2.

In FIG. 7, a waveform (broken line in the figure) of the AC voltage applied to the developing roller 7 by the AC voltage applying portion 31 during formation of a solid white image and a waveform (solid line in the figure) of the current value of the current flowing between the photosensitive drum 1 and the developing roller 7 are plotted. Electric charges on the surface of the developing roller 7 are moved by a potential difference between the photosensitive drum 1 and the developing roller 7, and therefore, the current flows when the potential of the AC voltage changes. In the constitution of this embodiment, the AC voltage applied by the AV voltage applying portion 31 has a rectangular wave shape, and therefore, at timing of t=0 when the AC voltage changes (in sign) from the negative (−) to the positive (+), the current with the current value flows with the change in potential difference. On the other hand, at timing after a lapse of a certain time from the timing when the AC voltage changes from the negative to the positive, the AC voltage becomes constant, and correspondingly, the current value becomes a value in the neighborhood of zero. Here, the time T is a time of one period (cyclic period), and T=1/f (frequency). Further, as the certain time from the timing when the AC voltage changes from the negative to the positive, timing of t=T/4 is shown as an example.

Incidentally, in this embodiment, timing when the current value of the current flowing between the photosensitive drum 1 and the developing roller 7 is after the lapse of T/4 which is the certain time from the timing when the AC voltage changes from the negative to the positive, but the present invention is not limited thereto. As shown in FIG. 7 by the broken line, the AC voltage changes from a region in which the sign thereof changes from the negative to the positive (or from the positive to the negative) on the positive side (or the negative side) to a region in which the AC voltage becomes constant. The certain time from the timing when the AC voltage changes from the negative to the positive is not limited to T/4 when the certain time is timing corresponding to the region in which the AC voltage becomes constant. Further, the detection timing may also be not only after the lapse of the certain time from the timing when the AC voltage changes from the negative to the positive but also after a lapse of the certain time from timing when the AC voltage changes from the positive to the negative. When the detection timing is timing (when the change in voltage becomes about zero) corresponding to the region in which the AC voltage becomes constant, a similar effect can be obtained even after an arbitrary certain time from the timing when the AC voltage changes from the negative to the positive or from the positive to the negative.

In this embodiment, comparison with the threshold is made by the CPU 40 which is the controller by using the current value detected by the detecting portion when the certain time elapsed from the timing when the AC voltage Vpp applied to the developing roller 7 changes from the negative to the positive. By employing such a constitution, when the AC voltage applied to the developing roller 7 changes, it is possible to directly detect the leak current by the current value of the current flowing between the photosensitive drum 1 and the developing roller 7.

<Flowchart of Discharge Occurrence Detecting Operation>

Next, on the basis of FIG. 8, an example of a flow of control of the discharge occurrence detecting operation of the image forming apparatus according to embodiment 2 will be described.

FIG. 8 is a flow chart showing an example of the flow of the control of the discharge occurrence detecting operation of the image forming apparatus according to the embodiment 2. In the discharge occurrence detecting operation described below, whether or not the current value change amount of the current flowing between the photosensitive drum 1 and the developing roller 7 exceeded is discriminated, and on the basis of a result thereof, the developing bias applied to the developing roller 7 is set. The discharge occurrence detecting operation is executed by the CPU 40 (FIG. 2) which is the controller. Incidentally, this discharge occurrence detecting operation is executed when an installation environment of the image forming apparatus, such as atmospheric pressure, a temperature or a humidity, changes. Or, the discharge occurrence detecting operation is executed in synchronism with a driving time of the developing roller 7 or the photosensitive drum 1 (for example, sheet passing history or exchange timing of the developing device which has a possibility that the SD gap changes). Further, execution timing of the discharge occurrence detecting operation is not limited to the above-described examples, but can be appropriately set.

First, when a power source of the image forming apparatus is turned on and the discharge occurrence detecting operation is started ("START"), by an instruction of the CPU 40, rotation of rotatable members such as the photosensitive drum 1 and the developing roller 7 is started by the unshown driving mechanisms (step S11). This drive of each of the rotatable members is continued until the discharge occurrence detecting operation is ended. Then, a charging bias is applied to the charging roller 4, and a DC voltage of −300 V is applied to the developing roller 7 by the DC voltage applying portion 30 (step S12). From the step S2, the time (T2) in which the photosensitive drum 1 rotates through one-full-circumference elapsed (step S13), so that the surface potential of the photosensitive drum 1 becomes −500 V over a full circumference. Then, the AC voltage Vpp applied to the developing roller 7 is set. In consideration of a change in temperature and humidity during sheet passing and a fluctuation is SD gap, the AC voltage Vpp applied to the developing roller 7 is set at an AC voltage Vpp higher than the AC voltage Vpp in setting during image formation (step S14). In this embodiment, the AC voltage Vpp applied to the developing roller 7 is set at an AC voltage Vpp 200 V higher than the AC voltage Vpp during image formation. Then, as described above with reference to FIG. 7, the CPU 40 discriminates whether or not an absolute value of the current value when the certain time (T/4 in this embodiment) from the timing when the AC voltage changes from the negative to the positive elapsed exceeded the threshold which is the predetermined value (step S15). In this embodiment, the threshold is 10 μA.

Then, in the case where the absolute value of current value exceeded the threshold in the step S15, the leakage generates between the photosensitive drum 1 and the developing roller 7, and therefore, the CPU 40 puts the AC voltage Vpp of the developing bias in an OFF state (step S16). Thus, in the case where the leakage generates, there is a need that setting of the AC voltage Vpp applied to the developing roller 7 during image formation is made smaller than setting of the AC voltage applied to the developing roller 7 during detection of the current value. Therefore, the CPU 40 which is the controller lowers the developing bias (AC voltage Vpp) applied to the developing roller 7 to a voltage lower than the AC voltage during detection of the current value (step S17). In this embodiment, the CPU 40 lowers the AC voltage to a voltage (1.7 kV) 100 V lower than the AC voltage (1.8 kV) during image formation. Then, the operation returns to the step S14, the AC voltage applied to the developing roller 7 is set at an AC voltage 200 V Vpp higher than a setting-changed AC voltage (1.7 kV) during image formation. Thus, the AC voltage applied to the developing roller 7 during leak detection is lowered from 2.0 kV to 1.9 kV. Then, in the step S15, whether or not the absolute value of the current value exceeds the threshold is checked again.

Incidentally, in the case where the absolute value of the current value exceeded the threshold in the step S15, the CPU 40 lowers stepwise the AC voltage applied to the developing roller 7 during leak detection, and repeats the above-described operation until the absolute value of the current value is threshold or less. That is, in the case where the CPU which is the controller detected in the step S15 that the absolute value of the current value exceeded the threshold, the CPU 40 lowers stepwise the AC voltage applied to the developing roller 7 and then detects again whether or not the absolute value of the current value exceeded the threshold.

In the case where the current value (absolute value) does not exceed the threshold in the step S15, i.e., in the case where the current value is the threshold or less, the operation in the step S15 is repeated in a period of the time T2 in which the photosensitive drum 1 rotates through one-full-circumference from application of the AC voltage Vpp (step S18). In the case where the current value is the threshold or less in the period, the CPU 40 determines that a value lowered from the AC voltage Vpp at that time during leak detection by 200 V is the AC voltage Vpp during image formation (step S19). That is, the CPU 40 determines the developing bias applied to the developing roller 7 without changing the developing bias (AC voltage Vpp) applied to the developing roller 7 during image formation. Then, the CPU 40 puts the developing bias and the charging bias in an OFF state, and thereafter, causes the driving mechanisms to stop the drive of the photosensitive drum 1 and the developing roller 7 (step S20), so that the CPU 40 ends the discharge occurrence detecting operation ("END").

From the above, according to this embodiment, the current value of the current flowing between the photosensitive drum 1 and the developing roller 7 is detected and whether or not the absolute value of the current value exceeded the threshold. By this, it is possible to shorten a time required for setting the developing bias at a developing bias at which the leakage does not generate (i.e., a developing bias at which the absolute value of the current value is the threshold or less).

Incidentally, the SD gap, the charging bias, the developing bias, the threshold of the current value, and the like are not intended to be limited to those described herein unless otherwise specified.

Further, in this embodiment, the constitution in which the average of the current value outputted from the detecting portion 35 in the time of 10 periods (cyclic periods) of the AC voltage is calculated was described as an example, but the periodic time T of the AC voltage is not limited thereto. The periodic time may only be required to be appropriately set.

An image forming apparatus according to an embodiment 3 will be described with reference to FIGS. 9 and 10. Incidentally, this embodiment is only different in a size relationship between respective members of the image forming portion and in discharge detection control from the embodiment 2, and other constitutions of this embodiment are substantially similar to those of the embodiment 2. Therefore, in this embodiment, constituent elements similar to those of the embodiment 2 are represented by the same reference numerals or symbols and will be omitted from detailed description.

In the embodiment 2, during the discharge occurrence detecting operation sequence, the surface potential of the photosensitive drum is changed by the electric discharge, so that the electrostatic latent image was developed with the toner and thus the toner was consumed uselessly in some cases. In the embodiment 3, only a current value of the current flowing between an non-exposure region of the photosensitive drum and a region of the developing roller opposing the non-exposure region is compared with the threshold, so that the time required for setting the developing bias to the developing bias at which the leakage does not generate can be shortened without consuming the toner.

<Size Relationship Between Members of Image Forming Portion>

A size (width) relationship between the respective (constituent) members of the image forming portion in the embodiment 3 will be described with reference to FIG. 9. FIG. 9 is a schematic view for illustrating an example of the size (width) relationship between the members of the image forming portion in the embodiment 3. In FIG. 9, with respect to an axial direction of the developing roller 7, a toner coat region L1 is a developer carrying region in which the toner is carried on the developing roller 7. The toner coat region L1 corresponding to a region of the photosensitive drum 1 which opposes the developer carrying region of the developing roller 7 and in which the toner is supplied from the developing roller 7. L2 represents a roller width of the charging roller 4 with respect to an axial direction of the charging roller 4. The roller width of the charging roller 4 corresponds to a charging region of the photosensitive drum 1 in which the photosensitive drum surface is electrically changed by the charging roller 4. L3 represents a drum application width corresponding to a width of a photosensitive layer formed on an outer peripheral surface of the photosensitive drum 1. In the constitution of the embodiment 3, with respect to the axial direction of the developing roller 7, relative to the toner coat region L1 of the developing roller 7, a length (width) relationship (size relationship) with each of the roller width L2 of the charging roller 4 and the drum application width L3 of the photosensitive drum 1 is L1<L2 and L1<L3. That is, with respect to the axial direction of the developing roller 7, the charging region (roller width L2) of the photosensitive drum 1 charged by the charging roller 4 is broader than the toner coat region L1 of the developing roller 7 (L1<L2). Further, the laser beam scanner 6 is capable of exposing the photosensitive drum 1 to light in a region (scanning exposure enable width L4 (not shown)) broader than the toner coat region L1 with respect to the axial direction of the developing roller 7 (L1<L4). Further, a surface potential of the photosensitive drum 1, charged by the charging roller 4, in the charging region (roller width L2) is represented by VD. A surface potential of the photosensitive drum 1, exposed to light by the laser beam scanner 6 is represented by VL. Here, an exposure region of the photosensitive drum 1 exposed to light by the laser beam scanner 6 is a region of the photosensitive drum 1 corresponding to the toner coat region L1 of the developing roller 7 and is a region narrower than the scanning exposure enable region L4 of the laser beam scanner 6. A DC voltage VDC applied to the developing roller 7 is set to satisfy a relationship of: VL<VDC in order to prevent movement of the negatively charged toner 3 from the developing roller 7 to the photosensitive drum 1. Incidentally, in the case where the toner is positively charged, a relationship of: UL>VDC is satisfied.

By satisfying the relationship, a surface potential of the photosensitive drum 1 in each of non-exposure regions H1 and H2 shown in FIG. 9 becomes VD, and a surface potential of the photosensitive drum 1 in the exposure region opposing the toner coat region L1 becomes VL, so that a relationship of: VD<VL<VDC is satisfied. That is, the potential VL of the photosensitive drum 1 in the region opposing the toner coat region L1 falls between the DC voltage VDC applied to the developing roller 7 and the potential VL of the photosensitive drum 1 in the non-exposure region (non-image region) in which the photosensitive drum 1 is not exposed to light by the laser beam scanner 6 in the charging region (roller width L2). Incidentally, in the case where the toner is positively charged, the relationship of: VD>VL>VDC is satisfied. Therefore, a potential difference between the photosensitive drum 1 in the non-exposure regions H1 and H2 and the developing roller 7 opposing the regions H1 and H2 is larger than a potential difference between the developing roller 7 and the photosensitive drum 1 in the region opposing the toner coat region L1 of the developing roller 7. For this reason, the leakage is liable to generate in the non-exposure regions H1 and H2 of the photosensitive drum 1. In this embodiment, there is a need to set the potential difference at a potential difference at which the leakage does not generate with reliability in the toner coat region L1 during leak detection. In this embodiment, in consideration of the variation in SD gap and the atmospheric pressure, the discharge start voltage is calculated on the basis of the Paschen's law, and then the potential difference between VL and VDC with respect to Vpp is determined. In this embodiment, during leak detection, Vpp is 1.2 kV, VD is −600 V, VL is −200 V, and VDC is 0 V. By making such setting, a maximum potential difference ΔVmax between the photosensitive drum 1 and the developing roller 7 is represented by $\Delta Vmax = Vpp/2 + |VDC - VD| = 1200$ V, and thus the potential difference similar to ΔVmax (Vpp=2.0 kV, VD=−500 V, VDC=−300 V) during an initial discharge occurrence detecting operation in the embodiment 2.

From the above, by employing the above-described constitution, it becomes possible to detect generation or non-generation of the leakage in the non-exposure region without generation of the leakage in the toner coat region during the discharge occurrence detecting operation.

<Flowchart of Discharge Occurrence Detecting Operation>

Next, on the basis of FIG. 10, an example of a flow of control of the discharge occurrence detecting operation of the image forming apparatus according to embodiment 3 will be described.

FIG. 10 is a flow chart showing an example of the flow of the control of the discharge occurrence detecting operation of the image forming apparatus according to the embodiment 3.

First, when a power source of the image forming apparatus is turned on and the discharge occurrence detecting operation is started ("START"), by an instruction of the CPU 40, rotation of rotatable members such as the photosensitive drum 1 and the developing roller 7 is started by the unshown driving mechanisms (step S21). This drive of each of the rotatable members is continued until the discharge occurrence detecting operation is ended. Then, a charging bias for electrically charging the surface of the photosensitive drum 1 to a surface potential of −600 V in the charging region of the photosensitive drum 1 is applied to the developing roller 4, and then the surface of the photosensitive drum 1 in the developer carrying region opposing the toner coat region L1 of the developing roller 7 is exposed to light by the laser beam scanner 6, so that the surface potential of the photosensitive drum 1 in the region opposing the toner coat region L1 is set at −220 V (step S22). From the step S22, the time (T2) in which the photosensitive drum 1 rotates through one-full-circumference elapsed (step S23), so that the surface of the photosensitive drum 1 has the set surface potential over a full circumference. Then, the AC voltage Vpp applied to the developing roller 7 is set. In order to set the potential difference at a value similar to ΔVmax during the initial discharge occurrence detecting operation, the AC voltage Vpp applied to the developing roller 7 is set at an AC voltage Vpp lower than the AC voltage Vpp in setting during image formation (step S24). In this embodiment, the AC voltage Vpp applied to the developing roller 7 is set at an AC voltage Vpp 600 V lower than the AC voltage Vpp during image formation. Then, the CPU 40 discriminates whether or not an absolute value of the current value when the certain time T/4 from the timing when the AC voltage changes from the negative to the positive elapsed exceeded the threshold which is the predetermined value (step S25). In this embodiment, the threshold is 10 μA.

Then, in the case where the current value exceeded the threshold in the step S25, the leakage generates between the photosensitive drum 1 and the developing roller 7, and therefore, the CPU 40 puts the AC voltage Vpp of the developing bias in an OFF state (step S26). Thus, in the case where the leakage generates, there is a need that setting of the AC voltage Vpp applied to the developing roller 7 during image formation is made smaller than setting of the AC voltage applied to the developing roller 7 during detection of the current value. Therefore, the CPU 40 which is the controller lowers the developing bias (AC voltage Vpp) applied to the developing roller 7 to a voltage lower than the AC voltage during detection of the current value (step S27). In this embodiment, the CPU 40 lowers the AC voltage to a voltage (1.7 kV) 100 V lower than the AC voltage (1.8 kV) during image formation. Then, the operation returns to the step S24, the AC voltage applied to the developing roller 7 is set at an AC voltage 600 V Vpp lower than a setting-changed AC voltage (1.7 kV) during image formation. Thus, the AC voltage applied to the developing roller 7 during leak detection is lowered from 1.2 kV to 1.1 kV. Then, in the step S25, whether or not the absolute value of the current value exceeds the threshold is checked again.

Incidentally, in the case where the current value exceeded the threshold in the step S25, the CPU 40 lowers stepwise the AC voltage applied to the developing roller 7 during leak detection, and repeats the above-described operation until the current value is threshold or less. That is, in the case where the CPU which is the controller detected in the step S25 that the leakage generated, the CPU 40 lowers stepwise the AC voltage applied to the developing roller 7 and then detects the leakage between the photosensitive drum 1 and the developing roller 7.

In the case where the current value does not exceed the threshold in the step S25, i.e., in the case where the current value is the threshold or less, the operation in the step S25 is repeated in a period of the time T2 in which the photosensitive drum 1 rotates through one-full-circumference from application of the AC voltage Vpp (step S28). In the case where the current value is the threshold or less in the period, the CPU 40 determines that a value increased from the AC voltage Vpp at that time during leak detection by 600 V is the AC voltage Vpp during image formation (step S29). That is, the CPU 40 determines the developing bias applied to the developing roller 7 without changing the developing bias (AC voltage Vpp) applied to the developing roller 7 during image formation. Then, the CPU 40 puts the developing bias and the charging bias in an OFF state, and thereafter, causes the driving mechanisms to stop the drive of the photosensitive drum 1 and the developing roller 7 (step S30), so that the CPU 40 ends the discharge occurrence detecting operation ("END").

From the above, according to this embodiment during the discharge occurrence detecting operation, the surface of the photosensitive drum 1 opposing the toner coat region is exposed to light, and then leak detection is carried out in the non-exposure regions other than the region opposing the toner coat region. By this, it is possible to shorten a time required for setting the developing bias at a developing bias at which useless toner consumption is prevented and the leakage does not generate.

Incidentally, the SD gap, the charging bias, the developing bias, the threshold of the current value, and the like are not intended to be limited to those described herein unless otherwise specified.

In the above-described embodiments, as the exposure portion, the laser beam scanner was used, but the present invention is not limited thereto. For example, an LED array or the like may also be used.

Further, in the above-described embodiments, as the process cartridge mountable in and dismountable form the apparatus main assembly of the image forming apparatus, the process cartridge 20 into which the photosensitive drum 1 and, as process means actable on the photosensitive drum 1, the charging portion, the developing portion and the cleaning portion are integrally assembled was described as an example. However, the process cartridge 20 is not limited thereto, but may also be a process cartridge into which the photosensitive drum 1 and at least one of the charging portion, the developing portion and the cleaning portion are integrally assembled.

Further, in the above-described embodiments, the constitution in which the process cartridge 20 including the photosensitive drum 1 is mountable in and dismountable form the apparatus main assembly of the image forming apparatus was described as an example, but the present invention is not limited thereto. For example, an image forming apparatus in which the photosensitive drum 1 and respective process means actable on the photosensitive drum 1 are incorporated, or an image forming apparatus including the photosensitive drum 1 and the process means actable on the photosensitive drum 1, each of the photosensitive drum 1 and the process means being mountable in and dismountable from the image forming apparatus may also be employed.

Further, in the above-described embodiments, the printer was described as an example of the image forming apparatus, but the present invention is not limited thereto. For example, other image forming apparatuses such as a copying machine, a facsimile machine and a multi-function machine having a combination of functions of these machines may also be used. Or, an image forming apparatus in which a recording medium carrying member is used and toner images of respective colors are transferred superposedly onto the recording medium carried on the recording medium carrying member may also be employed. Or, an image forming apparatus in which an intermediary transfer member is used and in which toner images of respective colors are transferred superposedly onto the intermediary transfer member and then are collectively transferred from the intermediary transfer member may also be employed. By applying the present invention to these image forming apparatuses, it is possible to obtain similar effects.

Then, an embodiment 4 will be described.

<Developing Container>

A structure of the developing container 9 will be described with reference to FIG. 11. FIG. 11 is a sectional view of the developing container 9.

The developing container 9 is a developing (device) frame for supporting the developing roller 7 which is the developer carrying member. The developing container 9 includes a toner accommodating chamber 9*a* which is a developer accommodating chamber for accommodating the toner, a developing chamber 9*b* provided with the developing roller 7 rotating in the counterclockwise direction, and an opening 9*c* which is an opening portion for establishing communication between the toner accommodating chamber 9*a* and the developing chamber 9*b*.

In the developing chamber 9*b*, the developing blade 8 which is the regulating member for regulating a layer thickness of the toner carried on the developing roller 7 is disposed.

In the toner accommodating chamber 9*a*, a stirring member 10 for feeding and stirring the toner is provided so as to be rotatable. The stirring member 10 is constituted by a stirring sheet 10*a* and a stirring shaft 106. One end portion of the stirring sheet 10*a* is mounted on the stirring shaft 10*b*, and the stirring shaft 10*b* is rotated in the clockwise direction, so that the stirring sheet 10*a* is also rotated. By the rotation of the stirring sheet 10*a*, the toner in the toner accommodating chamber 9*a* is stirred and is fed from the toner accommodating chamber 9*a* toward the developing chamber 9*b* through the opening 9*c*.

The toner fed from the toner accommodating chamber 9*a* to the developing chamber 9*b* by the stirring member 10 is supplied to the developing roller 7. The toner supplied to the developing roller 7 is carried on the surface of the developing roller 7, and then a layer thickness of the toner is regulated by the developing blade 8. To the toner regulated by the developing blade 8, proper electric charges are imparted by triboelectric charge.

In the following principal parameters of the developing roller 7, the developing blade 8 and the stirring member 10 will be described.

The developing roller 7 is 14 mm in outer diameter and is formed of a metal-based material such as nickel, aluminum or SUS, and is 0.2-1.0 μm in surface roughness Ra and 385 mm/sec in rotational speed (during normal printing).

The developing blade 8 is formed of a urethane material and is 1.0 mm in thickness.

The stirring member is formed of a polycarbonate material, and is 130 μm in thickness and 60 rpm in rotational speed during normal printing).

<Toner Seal Winding-Up Constitution>

A toner seal winding-up constitution will be described with reference to parts (a) and (b) of FIG. 12. Parts (a) and (b) of FIG. 12 are schematic views for illustrating the toner seal winding-up constitution.

In the case where the developing container 9 is shipped in a brand-new (fresh) state, there is a need to prevent leakage of the toner from the developing container 9 to an outside thereof. For that reason, as shown in part (a) of FIG. 12, in the developing container 9, the opening 9*c* between the toner accommodating chamber 9*a* in which the toner is accommodated and the developing chamber 9*b* in which the developing roller 7 is accommodated is sealed by a toner seal 13 which is a sealing member. A part of the toner seal 13 is fixed on a toner seal winding-up shaft 14 which is a rotatable member as an unsealing member for the toner seal 13. As shown in part (b) of FIG. 12, the toner seal 13 is wound up by the toner seal winding-up shaft 14 through rotation of the toner seal winding-up shaft 14, so that the opening 9*c* is opened (unsealed). Further, in this embodiment, the toner seal winding-up shaft 14 also functions as the stirring shaft 10*b*, and the toner seal winding-up shaft 14 is rotated in interrelation with rotation of the stirring shaft 10*b*, so that the toner seal 13 is wound around the toner seal winding-up shaft 14 by rotation of the stirring member 10 through one-full-circumference. A rotation driving force of the stirring shaft 10*b* is first transmitted from the driving source (not shown) of the apparatus main assembly M to the developing roller 7 and then is transmitted to the stirring shaft 10*b* through gears. That is, the developing roller 7, the stirring shaft 10*b* and the toner seal winding-up shaft 14 are rotated in interrelation with each other. Here, a rotational speed of the stirring sheet 10*a* during the normal printing operation in this embodiment was set at 60 rpm. Accordingly, in the case where the toner seal 13 operates at a peripheral speed during the normal printing operation, the toner seal is wound up in 1 sec. Incidentally, in this embodiment, a constitution in which the toner seal winding-up shaft 14 which is the rotatable member functions as the stirring shaft 10*b* of the stirring member 10 was described as an example, but the present invention is not limited thereto. A constitution in which the toner seal winding-up shaft 14 which is the rotatable member is provided separately from the stirring member 10 in the developing container 9 which is the developing frame so as to be rotatable.

<Detection of Leak Current>

Detection of the leak current by the detecting portion 35 will be described with reference to FIG. 7. FIG. 7 is a waveform chart of the AC voltage and the current value in developing bias application in this embodiment.

In FIG. 7, a waveform (broken line in the figure) of the AC voltage applied to the developing roller 7 by the AC voltage applying portion 31 during formation of a solid white image and a waveform (solid line in the figure) of the current value of the current flowing between the photosensitive drum 1 and the developing roller 7 are plotted. Electric charges on the surface of the developing roller 7 are moved by a potential difference between the photosensitive drum 1 and the developing roller 7, and therefore, the current flows when the potential of the AC voltage changes. In the constitution of this embodiment, the AC voltage applied by the AV voltage applying portion 31 has a rectangular wave shape, and therefore, at timing of t=0 when the AC voltage changes (in sign) from the negative (−) to the positive (+), the current with the current value flows with the change in potential difference. On the other hand, at timing after a lapse of a certain time from the timing when the AC voltage changes from the negative to the positive, the AC voltage becomes constant, and correspondingly, the current value becomes a value in the neighborhood of zero. Here, the time T is a time of one period (cyclic period), and T=1/f (frequency). Further, as the certain time from the timing when the AC voltage changes from the negative to the positive, timing of t=T/4 is shown as an example.

Incidentally, in this embodiment, timing when the current value of the current flowing between the photosensitive drum 1 and the developing roller 7 is after the lapse of T/4 which is the certain time from the timing when the AC voltage changes from the negative to the positive, but the present invention is not limited thereto. As shown in FIG. 7 by the broken line, the AC voltage changes from a region in which the sign thereof changes from the negative to the positive (or from the positive to the negative) on the positive side (or the negative side) to a region in which the AC voltage becomes constant. The certain time from the timing when the AC voltage changes from the negative to the positive is not limited to T/4 when the certain time is timing corresponding to the region in which the AC voltage becomes constant. Further, the detection timing may also be not only after the lapse of the certain time from the timing when the AC voltage changes from the negative to the positive but also after a lapse of the certain time from timing when the AC voltage changes from the positive to the negative. When the detection timing is timing (when the change in voltage becomes about zero) corresponding to the region in which the AC voltage becomes constant, a similar effect can be obtained even after an arbitrary certain time from the timing when the AC voltage changes from the negative to the positive or from the positive to the negative.

In this embodiment, comparison with the threshold is made by the CPU 40 which is the controller by using the current value detected by the detecting portion when the certain time elapsed from the timing when the AC voltage Vpp applied to the developing roller 7 changes from the negative to the positive. By employing such a constitution, when the AC voltage applied to the developing roller 7 changes, it is possible to directly detect the leak current by the current value of the current flowing between the photosensitive drum 1 and the developing roller 7.

The Vpp at which the leakage generates is determined by an impedance between the photosensitive drum 1 and the developing roller 7. Accordingly, the leakage generating Vpp changes on the fluctuation in SD gap by the drive of the photosensitive drum 1 and the developing roller 7, and particularly, the timing when the SD gap becomes narrowest is a condition in which the leakage is most liable to generate. For that reason, the photosensitive drum 1 and the developing roller 7 are rotationally driven and in a time (T2) until the photosensitive drum 1 rotates through one-full-circumference, the above-described detection of the leak current is continuously carried out, so that the generation of the leakage can be discriminated further accurately. Incidentally, in this embodiment, the photosensitive drum 1 is 385 mm/sec in rotational speed and is 30 mm in outer diameter, and therefore, the time T2 until the photosensitive drum 1 rotates through one-full-circumference is 0.25 sec.

<Toner Seal Winding-Up Operation>

Next, a toner seal winding-up operation in this embodiment will be described. The toner seal winding-up operation is an operation performed in the case where the process cartridge is a new one.

First, when a main switch (power source) of the apparatus main assembly M is turned on, the developing roller 7 is rotationally driven by the unshown driving mechanism in accordance with the instruction of the CPU 40. When the drive of the developing roller 7 is started, the rotational driving force is transmitted to the stirring shaft 10*b* of the stirring member 10 through the gears, and in interrelation therewith, the toner seal winding-up shaft 14 is rotated. When the toner seal winding-up shaft 14 rotates through one-full-circumference, the toner seal 13 is wound up by the toner seal winding-up shaft 14, so that the opening 9*c* is unsealed. After the opening 9*c* is unsealed, in accordance with the instruction of the CPU 40, the rotational drive of the developing roller 7 by the driving mechanism is stopped.

A time (T3) required for the toner seal winding-up operation in this embodiment is substantially synonymous with a time required from a start of unsealing of the opening 9*c* by winding up the toner seal 13 through the rotation of the toner seal winding-up shaft 14 until the unsealing is ended. The toner seal 13 rotates in interrelation with the stirring member 10, and therefore, in the case where the toner seal 13 operates at the same rotational speed as that during the normal printing operation, the time T3 required for the toner seal winding-up operation is 1 sec.

<Flowchart of Discharge Occurrence Detecting Operation in Embodiment 4>

Next, with reference to FIGS. 13 and 14, a flow of control of the discharge occurrence detecting operation of the image forming apparatus according to embodiment 1 will be described.

FIG. 13 is a flow chart showing an example of the flow of the discharge occurrence detecting operation of the image forming apparatus according to the embodiment 4. FIG. 14 is a timing chart showing driving timing of the discharge occurrence detecting operation in this embodiment. In the discharge occurrence detecting operation described below, whether or not the current value change amount of the current flowing between the photosensitive drum 1 and the developing roller 7 exceeded is discriminated, and on the basis of a result thereof, the developing bias (AC voltage Vpp) applied to the developing roller 7 is controlled. The discharge occurrence detecting operation is executed by the CPU 40 (FIG. 2) which is the controller. Incidentally, this discharge occurrence detecting operation is performed together with the toner seal winding-up operation performed in the case where the process cartridge 20 is the new one.

First, when a power source of the image forming apparatus is turned on and the discharge occurrence detecting operation is started ("START"), by an instruction of the CPU 40, drive of rotatable members such as the photosensitive drum 1 and the developing roller 7 is started by the unshown driving mechanisms (step S101). This drive of each of the rotatable members is continued for a time until the toner seal winding-up operation is ended since the discharge occurrence detecting operation is interrelated with the toner seal winding-up operation. Then, a charging bias is applied to the charging roller 4, and a DC voltage of −300 V is applied to the developing roller 7 by the DC voltage applying portion 30 (step S102). From the step S102, the time (T2) in which the photosensitive drum 1 rotates through one-full-circumference elapsed (step S103), so that the surface potential of the photosensitive drum 1 becomes −500 V over a full circumference. Then, the AC voltage Vpp applied to the developing roller 7 is set. In consideration of a change in temperature and humidity during sheet passing and a fluctuation is SD gap, the AC voltage Vpp applied to the developing roller 7 is set at an AC voltage Vpp higher than the AC voltage Vpp in setting during image formation by an offset value (step S104). In this embodiment, the AC voltage Vpp applied to the developing roller 7 is set at an AC voltage Vpp 200 V higher than the AC voltage Vpp during image formation. Then, the CPU 40 discriminates whether or not when the set AC voltage Vpp is applied to the developing roller 7, the current value of the current flowing between the developing roller 7 and the photosensitive drum 1 exceeded the threshold which is the predetermined value (step S105). In this embodiment, as described above with reference to FIG. 13, the CPU 40 discriminates whether or not the above-described current value when the certain time T/4 elapsed from the timing when the AC voltage changes from the negative to the positive exceeded the threshold. In this embodiment, the threshold is 10 μA.

Then, in the case where the current value exceeded the threshold in the step S105, the leakage generates between the photosensitive drum 1 and the developing roller 7, and therefore, the CPU 40 puts the AC voltage Vpp of the developing bias in an OFF state (step S106). The reason why the AC voltage Vpp is put in the OFF state is that when development leakage once generates, the development leakage continued by continuous flow of the current, and therefore, the development leakage generating continuously is once discontinued (eliminated). Thus, in the case where the leakage generates, the AC voltage Vpp applied at that time to the developing roller 7 during image formation is set at a predetermined value (step S107). In this embodiment, the predetermined value is set at 1.5 kV which is the AC voltage at which the leakage does not generate, inclusive of the installation environment. Then, the charging bias and the developing bias are turned off (step S108), and thereafter, the drive of the photosensitive drum 1 and the developing roller 7 is stopped (step S109), and thus the discharge occurrence detecting operation is ended ("END"). In this case, a time required for the operation of controlling the developing bias (AC voltage Vpp) by the CPU 40 so as to be the threshold or less is, at the shortest, as shown in FIG. 14, a time (T2+T/4) which is the same of the time T2 in which the photosensitive drum 1 rotates through one-full-circumference and the certain time (T/4) from the timing when the AC voltage changes from the negative to the positive. Here, the time required for the operation of controlling the developing bias by the CPU 40 so as to be the threshold or less is T4.

Here, when one periodic (cyclic) time of the AC voltage is T, the time until the photosensitive drum 1 rotates through one-full-circumference is T2, and the time required for the toner seal winding-up operation is T3, a relationship between these times is T<<T2<T3. In the case where the current value exceeded the threshold in the step S105, the time required for the operation of controlling the developing bias by the CPU 40 so as to be the threshold or less is T4. For that reason, the time T4 is shorter than the time T3 required for the toner seal winding-up operation from a start to and end of the unsealing of the opening 9*c* by winding up the toner seal 13 through the rotation of the toner seal winding-up shaft 14 (T4<T3).

On the other hand, in the case where the current value does not exceed the threshold in the step S105, i.e., in the case where the current value is continuously the threshold or less, the operation in the step S105 is repeated in a period of the time T2 in which the photosensitive drum 1 rotates through one-full-circumference from application of the AC voltage Vpp (step S110). In the case where the current value change amount is the threshold or less in the period, the CPU 40 determines that a value lowered from the AC voltage Vpp at that time during leak detection by the offset value (200 V) is the AC voltage Vpp during image formation (step S111). Then, the CPU 40 puts the developing bias and the charging bias in an OFF state (step S108), and thereafter, causes the driving mechanisms to stop the drive of the rotatable members such as the photosensitive drum 1 and the developing roller 7 (step S109), so that the CPU 40 ends the discharge occurrence detecting operation ("END"). In this embodiment, the time required for the operation of controlling the AC voltage by the CPU 40 so as to be the threshold or less is a time (T2+T2) which is the sum of the time (T2) in which the photosensitive drum 1 rotates through one-full-circumference and the time (T2) in which the photosensitive drum 1 rotates through one-full-circumference.

From the above, as regards the time required for the operation of the controlling the developing bias (AC voltage Vpp) by the CPU 40 so as to be the threshold or less, the time until the operation is ended is longer in the case where the current value does not exceed the threshold in the step S105 than in the case where the current value exceeded the threshold in the step S105 (T4<(T2+T2)).

The above-described discharge occurrence detecting operation is performed in the case where the discharge 20 is the new one. Accordingly, the rotational drive starting from the step S101 is operated in interrelation with the toner seal winding-up operation. For that reason, the operation in the step S109 is executed after not only the setting of the Vpp during image formation in the step S107 or S111 is completed but also the toner seal winding-up operation is completed.

In this embodiment, the time required for the completion of the operation in the step S109 is T2+T2, and therefore, is 0.50 sec. On the other hand, the time T3 required for the toner seal winding-up operation is 1.00 sec. That is, the time (T2+T2) required for the operation of controlling the developing bias (AC voltage Vpp) by the CPU 40 which is the controller so as to be the threshold or less is shorter than the time T3 required for the toner seal winding-up operation from the start to the end of the unsealing of the toner seal 13 by winding up the toner seal 13 through rotation of the toner seal winding-up shaft 14 ((T2+T2)<T3). Accordingly, in this embodiment, the operation of the step S109 is executed before the toner seal winding-up operation is completed.

<Experiment 1>

Here, an experiment conducted by using a comparison example 1 for demonstrating an effect of the embodiment 4 will be described.

In this experiment, in an environment of a temperature of 23° C. and a humidity of 50% RH, in each case where the discharge occurrence detecting operation is performed and in the case where the toner seal winding-up operation is performed, a value set as the Vpp during image formation by the discharge occurrence detecting operation was compared between the embodiment 4 and the comparison example 1. In this experiment, application of the Vpp in the step S104 of the discharge occurrence detecting operation shown in FIG. 13 was carried out in a plurality of settings.

In the comparison example 1, a constitution in which the rotational speed of the photosensitive drum 1 is 130 mm/sec and the rotational speed of the stirring member 10 is 60 rpm is employed. In this constitution, similarly as in the embodiment 4, the time T3 required for the toner seal winding-up operation is 1 sec and the time T2 in which the photosensitive drum 1 rotates through one-full-circumference is 0.73 sec, and therefore, the time (T2+T2) required for the completion of the operation of the step S109 is 1.46 sec. That is, the comparison example 1 has a constitution in which the time T3 required for the toner seal winding-up operation is shorter than the time (T2+T2) required for the operation of controlling the developing bias (AC voltage Vpp) by the CPU 40 so as to be the threshold or less ((T2+T2)<T3).

On the other hand, in the embodiment 4, as described above, the rotational speed of the photosensitive drum 1 is 385 mm/sec and the rotational speed of the stirring member 10 is 60 rpm. For that reason, the time T2 until the photosensitive drum 1 rotates through one-full-circumference is 0.25 sec, so that the time (T2+T2) required for the completion of the operation of the step S109 is 0.50 sec. Accordingly, the embodiment 4 has a constitution in which the time T3 required for the toner seal winding-up operation is longer than the time (T2+T2) required for the operation of controlling the developing bias (AC voltage Vpp) by the CPU 40 so as to be the threshold or less ((T2+T2)<T3).

A result of this experiment is summarized in FIG. 15 and a table 1 appearing hereinafter. FIG. 15 is a graph showing a relationship between the Vpp set during the discharge occurrence detecting operation and the current value detected by the detecting portion in the embodiment 4 and the comparison example 1. In FIG. 15, the abscissa represents the Vpp set during the discharge occurrence detecting operation, and the ordinate represents a maximum value of the current value detected by the detecting portion.

First, FIG. 15 will be described. As a result of the experiment, relative to the Vpp set in the discharge occurrence detecting operation, the current value detected by the detecting portion is different between the embodiment 4 and the comparison example 1. The result was such that when the Vpp is 3000 V, the current value exceeds 10 μA which is the threshold in the constitution of the embodiment 4, whereas the current value does not exceed the threshold in the constitution of the comparison example 1.

As has already been described above, when the toner is interposed in the SD gap, a resistance between the photosensitive drum 1 and the developing roller 7 becomes high due to a toner resistance, and thus the leakage does not readily generate, so that the current value detected in the discharge occurrence detecting operation lowers.

In this experiment, in the embodiment 4, detection of the leak current is ended before the toner seal winding-up operation is completed, and therefore, the toner is not interposed in the SD gap during the detection of the leak current. On the other hand, in the comparison example 1, the toner seal winding-up operation is completed before the detection of the leak current, and therefore, the toner is interposed in the SD gap during the detection of the leak current. That is, the result of this experiment shows a difference whether or not the toner is interposed in the SD gap during leak detection.

TABLE 1

| Vpp | Vpp (IMAGE FORMATION) | | LEAKAGE*2 | |
|---|---|---|---|---|
| (DCDO*1) | EMB. 4 | COMP. EX. 1 | EMB. 4 | COMP. EX. 1 |
| 1800 V | 1600 V | 1600 V | ○ | ○ |
| 2000 V | 1800 V | 1800 V | ○ | ○ |
| 2200 V | 2000 V | 2000 V | ○ | ○ |
| 2400 V | 2200 V | 2200 V | ○ | ○ |
| 2600 V | 2400 V | 2400 V | ○ | ○ |
| 2800 V | 2600 V | 2600 V | ○ | ○ |
| 3000 V | 1500 V | 2800 V | ○ | x |

*1"DCDO" is the discharge occurrence detecting operation.
*2"LEAKAGE" is the generation or non-generation of the development leakage.

Next, the table 1 will be described. The table 1 shows the generation or non-generation of the development leakage at the Vpp set as the value during image formation with respect to the Vpp set during the discharge occurrence detecting operation in the embodiment 4 and the comparison example 1. When the image forming operation is carried out, the case where the development leakage did not generate is represented by "o", and the case where the development leakage generated is represented by "x". The generation or non-generation of the development leakage is discriminated on the basis of whether or not the toner image is printed on the recording medium (material) when a so-called whole white image of 0% in print ratio is printed on 500 sheets of LETTER-SIZE recording mediums after the discharge occurrence detecting operation. When the development leakage does not generate, the toner image is not printed on the recording medium, but when the development leakage generates, an unintended toner image is printed on the recording medium. Accordingly, on the basis of whether or not the toner image is printed on the recording medium when the whole while image is printed, the generation or non-generation of the development leakage can be discriminated.

As described above as the result of the experiment with reference to FIG. 15, the result of Vpp=3000 V is noted. When the Vpp is 3000 V, the result was such that the current value exceeds the threshold (10 μA) in the constitution of the embodiment 4, whereas the current value does not exceed the threshold in the constitution of the comparison example 1. As result, as shown in the table 1, in the embodiment 4, discrimination that the leakage generates at the set Vpp is made, and the Vpp is set at 1500 V which is a predetermined value at which the leakage does not generate reliably in the constitution of the embodiment 4. On the other hand, in the comparison example 1, although there is a risk of generation of the leakage when the change in temperature or humidity during sheet passing and the SD gap fluctuation are taken into consideration, the Vpp during image formation was set at 2800 V. The voltages Vpp were set as described above, the development leakage did not generate in the embodiment 4, but generated in the comparison example 1.

As described above, in the case of the constitution in which the time required for the operation of setting the developing bias by the CPU 40 so as to be the threshold or less is longer than the toner seal winding-up operation as in the comparison example 1, the generation or non-generation of the leakage is detected under a condition such that the leakage does not readily generate. For that reason, in the constitution in the comparison example 1, discrimination as the whether or not the leakage generates with respect to the Vpp set during image formation is erroneously made in some cases. On the other hand, in the constitution of the embodiment 4, the time required for the operation of setting the developing bias by the CPU 40 so as to be the threshold or less is shorter than the time required for the toner seal winding-up operation, and therefore, whether or not the leakage generates with respect to the Vpp set during image formation can be properly discriminated. As a result, it is possible to provide an image forming apparatus in which the leakage does not generate in long-term use.

Incidentally, as regards the SD gap, the charging bias, the developing bias, the threshold of the current value, and the like described in this embodiment, the scope of the present invention is not intended to be limited to those described herein unless otherwise specified.

An image forming apparatus according to an embodiment 5 will be described. Incidentally, this embodiment is only different in discharge detection control from the embodiment 4, and other constitutions of this embodiment are substantially similar to those of the embodiment 4. Therefore, in this embodiment, constituent elements similar to those of the embodiment 4 are represented by the same reference numerals or symbols and will be omitted from detailed description.

In the above-described embodiment 4, in the case where the leakage was detected in the discriminate occurrence detecting operation, the Vpp was set at the predetermined value at which the leakage did not generate. On the other hand, in the embodiment 5, in the case where the leakage is detected during the discharge occurrence detecting operation, the Vpp at which the leakage does not generate is detected again and then the Vpp during image formation is determined. In this embodiment, a constitution in which the developing roller 7 receives the driving force from a driving source different from the driving source for the photosensitive drum 1 and is rotationally driven independently of the photosensitive drum 1. In the following, description will be made specifically.

<Flowchart of Discharge Occurrence Detecting Operation in Embodiment 5>

With reference to FIGS. 16 and 17, a flow of control of the discharge occurrence detecting operation of the image forming apparatus according to embodiment 5 will be described. FIG. 16 is a flow chart showing an example of the flow of the control of the discharge occurrence detecting operation of the image forming apparatus according to the embodiment 6. FIG. 17 is a timing chart showing during TG of the discharge occurrence detecting operation in the embodiment 5 described above.

First, when a power source of the image forming apparatus is turned on and the discharge occurrence detecting operation is started ("START"), by an instruction of the CPU 40, drive of rotatable members such as the photosensitive drum 1 and the developing roller 7 is started by the unshown driving mechanisms (step S201). Then, a charging bias is applied to the charging roller 4, and a DC voltage of −300 V is applied to the developing roller 7 by the DC voltage applying portion 30 (step S202). From the step S202, the time (T2) in which the photosensitive drum 1 rotates through one-full-circumference elapsed (step S203), so that the surface potential of the photosensitive drum 1 becomes −500 V over a full circumference. Then, the AC voltage Vpp applied to the developing roller 7 is set. In consideration of a change in temperature and humidity during sheet passing and a fluctuation is SD gap, the AC voltage Vpp applied to the developing roller 7 is set at an AC voltage Vpp higher than the AC voltage Vpp in setting during image formation by an offset value (step S204). In this embodiment, the AC voltage Vpp applied to the developing roller 7 is set at an AC voltage Vpp 200 V higher than the AC voltage Vpp during image formation. Then, the CPU 40 discriminates whether or not when the set AC voltage Vpp is applied to the developing roller 7, the current value change amount of the current flowing between the developing roller 7 and the photosensitive drum 1 exceeded the threshold which is the predetermined value (step S205). In this embodiment, as described above with reference to FIG. 13, the CPU 40 discriminates whether or not the above-described current value when the certain time T/4 elapsed from the timing when the AC voltage changes from the negative to the positive exceeded the threshold. In this embodiment, the threshold is 10 μA.

Then, in the case where the current value exceeded the threshold in the step S205, the leakage generates between the photosensitive drum 1 and the developing roller 7, and therefore, the CPU 40 puts the AC voltage Vpp of the developing bias in an OFF state, so that the rotation drive of the developing roller 7 is stopped (step S206). At this time, the stirring shaft 10*b* and the toner seal winding-up shaft 14 are rotated in interrelation with the developing roller 7, and therefore, are stopped simultaneously with the stop of the developing roller 7. Then, in a state in which the drive of the developing roller 7 is stopped, setting of the Vpp during image formation is lowered to a value lower than the present setting (step S207). In this embodiment, the Vpp during image formation is set again at a value lowered to a voltage 200 V lower than the developing bias (AC voltage Vpp) applied to the developing roller 7 during detection of the current value. Then, when the Vpp set again is applied to the developing roller 7, the CPU 40 discriminates whether or not the current value at the time of a lapse of the certain time T/4 from the timing when the AC voltage changes from the negative to the positive exceeded the threshold (step S208).

Then, in the case where the current value exceeded the threshold in the step S208, the operation returns to the step S207 and the CPU 40 lowers stepwise the Vpp applied to the developing roller 7 and repetitively executed the above-described operation until the current value is threshold or less.

On the other hand, in the case where the current value change amount does not exceed the threshold in the step S208, i.e., in the case where the current value is the threshold or less, the operation in the step S208 is repeated in a period of the time T2 in which the photosensitive drum 1 rotates through one-full-circumference from application of the AC voltage Vpp (step S209). In the case where the current value is continuously the threshold or less in the period, the CPU 40 determines that a value lowered from the AC voltage Vpp at that time during leak detection by the offset value (200 V) is the AC voltage Vpp during image formation (step S210). Thereafter, the rotational drive of the developing roller 7 is started again (step S211). At this time, the stirring shaft 10*b* and the toner seal winding-up shaft 14 are rotated in interrelation with the developing roller 7, and therefore, rotation of these shafts is started simultaneously with the start of the drive of the developing roller 7. Then, in a period of a time (T3−T2), the developing roller 7 is rotated, and thereafter, the charging bias and the developing bias are turned off (step S212), and then, the drive of the rotatable members such as the photosensitive drum 1 and the developing roller 7 is stopped (step S213). Thus, the discharge occurrence detecting operation is ended ("END").

Incidentally, the reason why the developing roller 7 is rotationally driven again in the step S211 is that similarly as in the embodiment 4, also in the embodiment 5, the discharge occurrence detecting operation and the toner seal winding-up operation are interrelated with each other. In a stage of the step S208, as shown in FIG. 17, as regards the developing roller 7, only the time T4 elapsed, and therefore, the toner seal winding-up operation is not completed. Accordingly, in a period of the time (T3−T4), there is a need to rotationally drive the developing roller 7.

Further, in the case where the current value does not exceed the threshold in the step S205, i.e., in the case where the current value is the threshold or less, in a period of the time T2 in which the charging bias is applied to the charging roller 4 and then the photosensitive drum 1 rotates through one-full-circumference, the step S205 is repeated (step S214). In the period, in the case where the current value is continuously the threshold or less, 1.8 kV which is a value lowered from the AC voltage Vpp at that time during leak detection by the offset (200 V) is determined as the AC voltage Vpp during image formation (step S215). Thereafter, then the CPU 40 puts the developing bias and the charging bias in an OFF state (step S212), and then, causes the driving mechanisms to stop the drive of the rotatable members such as the photosensitive drum 1 and the developing roller 7 (step S213), so that the CPU 40 ends the discharge occurrence detecting operation ("END"). In this embodiment, the time required for the operation of controlling the developing bias by the CPU 40 so as to be the threshold or less is a time (T2+T2) which is the sum of the time (T2) in which the photosensitive drum 1 rotates through one-full-circumference and the time (T2) in which the photosensitive drum 1 rotates through one-full-circumference.

In this embodiment, in the case where the current value exceeds the threshold in the step S205, the Vpp is set at the value lowered by 200 V, but this decrement is not limited thereto. In order to detect the Vpp, at which the leakage does not generate, in a short time, it is also possible to increase the decrement. Further, in order to specifically check the Vpp at which the leakage generates, it is also possible to decrease the decrement.

<Experiment 2>

Here, in order to demonstrate an effect of the embodiment 5, an experiment in which the embodiment 5 is compared with the embodiment 4 and the comparison example 1 was conducted. This experiment was carried out under the same condition as that in the embodiment 4. A result of this experiment was summarized in a table 2.

TABLE 2

| Vpp (DCDO*1) | Vpp (IMAGE FORMATION) EMB. 5 | EMB. 4 | COMP. EX. 1 | LEAKAGE*2 EMB. 5 | EMB. 4 | COMP. EX. 1 |
|---|---|---|---|---|---|---|
| 1800 V | 1600 V | 1600 V | 1600 V | ○ | ○ | ○ |
| 2000 V | 1800 V | 1800 V | 1800 V | ○ | ○ | ○ |
| 2200 V | 2000 V | 2000 V | 2000 V | ○ | ○ | ○ |
| 2400 V | 2200 V | 2200 V | 2200 V | ○ | ○ | ○ |
| 2600 V | 2400 V | 2400 V | 2400 V | ○ | ○ | ○ |
| 2800 V | 2600 V | 2600 V | 2600 V | ○ | ○ | ○ |
| 3000 V | 2600 V | 1500 V | 2800 V | ○ | ○ | x |

*1"DCDO" is the discharge current detecting operation.

*2"LEAKAGE" is the generation or non-generation of the development leakage.

The table 2 shows the generation or non-generation of the development leakage at the Vpp set as the value during image formation with respect to the Vpp set during the discharge occurrence detecting operation in the embodiment 4 and the comparison example 1. When the image forming operation is carried out, the case where the development leakage did not generate is represented by "o", and the case where the development leakage generated is represented by "x". The discrimination of the generation or non-generation of the development leakage is the same as the case of the table 1. Here, the result of the Vpp=3000 V set during the detection of the discharge is noted. In the embodiment 4, discrimination that the leakage generates at the set Vpp is made, and the Vpp during image formation was set at 1500 V. In the comparison example 1, the Vpp during image formation was set at 2800 V at which there is a risk of the leakage. On the other hand, in the embodiment 5, the Vpp during image formation is set at 2600 V. This is because in the case of Vpp=3000 V set during the detection of the discharge, discrimination that the leakage generates in the state in which the toner is not interposed in the SD gap is made once similarly as in the embodiment 4, and thereafter, the generation or non-generation of the leakage is discriminated again by using the Vpp value offset by 200 V. By setting these Vpp values, in the embodiments 4 and 5, the development leakage did not generate. On the other hand, in the comparison example 1, the development leakage generated.

As described above, in the embodiment 5, the generation or non-generation of the leakage can be detected while changing the Vpp in the state in which the toner is not interposed in the SD gap. For that reason, even in the case where the leakage generation is discriminated at the value set as the Vpp during the discharge detection, it becomes possible to select a higher Vpp within a range in which the leakage does not generate. As a result, it is possible to provide an image forming apparatus in which no leakage generates in long-term use.

Incidentally, as regards the SD gap, the charging bias, the developing bias, the threshold of the current value, and the like described in this embodiment, the scope of the present invention is not intended to be limited to those described herein unless otherwise specified. In the embodiment 1, on the basis of the current value change amount which is the difference between the maximum value and the minimum value of the current value in the time T2 in which the photosensitive drum 1 rotates through one-full-circumference, the developing bias applied to the developing roller 7 was set. On the other hand, an embodiment 6 is characterized in that the developing bias is set on the basis of a magnitude of the current value in addition to the current value change amount.

As the current flowing between the photosensitive drum 1 and the developing roller 7 at the time of application of the AC voltage and the DC voltage, similarly as in the embodiment 1, the current which is rectified and which has the current value averaged in 4 ms which is the 10-period time T of the AC voltage was used.

An image forming apparatus according to the embodiment 6 will be described with reference to FIGS. 18 to 21. This embodiment is different from the embodiment 1, and other constitutions are substantially similar to those of the embodiment 1. Accordingly, in this embodiment, constituent elements similar to those in the embodiment 1 are represented by the same reference numerals or symbols and will be omitted from detailed description.

<Detection of Leak Current>

FIG. 18 is a graph showing a relationship between the AC voltage and the current value change amount (difference between the maximum value and the minimum value) in the embodiment 6. The current value of the current flowing between the developing roller 7 and the photosensitive drum 1 when the Vpp which is the peak-to-peak voltage of the AC voltage in the developing bias is changed is plotted, and in FIG. 18, the abscissa represents the voltage Vpp, and the ordinate represents the current value.

In FIG. 18, a solid line represents progression of the maximum value when the current after the rectification is averaged every AC voltage periodic time T (4 ms in this embodiment) in a time T2 (314 ms in this embodiment) until the photosensitive drum 1 rotates through one-full-circumference similarly as in the embodiment 1, and a broken line represents progression of the minimum value in the same condition. Further, a relationship between the current value change amount and the AC voltage, which is the difference between the maximum value and the minimum value, is shown in FIG. 19.

In FIG. 19, a position of a vertical broken line c represents the Vpp of a start of leakage generation (i.e., discharge start voltage Vpp), and a right-hand side of this vertical broken line c is a leakage generation region in which the leakage generates between the developing roller 7 and the photosensitive drum 1. In this leakage generation region, when leakage generates between the developing roller 7 and the photosensitive drum 1, it is understood that the current value change amount abruptly increases and reaches a peak in the neighborhood of Vpp=2300 V and thereafter decreases. At Vpp=2500 V, it is also understood that although the leakage generates, the current value change amount is comparable to that in a non-leakage generation region (on a left-hand side of the vertical broken line c).

This will be specifically described using parts (a) and (b) of FIG. 20. Part (a) of FIG. 20 show progression of the current value change amount when the voltage Vpp is changed, and a horizontal solid line a in the figure represents a change amount threshold A which is a first threshold when the leakage detection is made on the basis of a magnitude of the current value change amount. In this embodiment, the change amount threshold A which is the first threshold is 1 μA equal to that in the embodiment 1. However, the first threshold is not limited thereto. In part (a) of FIG. 20, the vertical broken line c is the voltage Vpp of the start of the leakage generation. Further a vertical broken line d in the figure represents a voltage Vpp at which the current value change amount is the first threshold or less (change amount threshold A or less) although the leakage generates. In part (a) of FIG. 20, the left-hand side of the vertical broken line c is referred to as a region I, a region between the vertical broken lines c and d is referred to as a region II, and the right-hand side of the vertical broken line d is referred to as a region III.

The region I is a region where no leakage generates at the current value change amount which is the threshold or less. The region II is a region where the leakage generates and the current value change amount exceeds the change amount threshold A as described in the embodiment 1 and is a leakage generation region.

Further, the region III is a region where the current value change amount is the change amount threshold A or less although the leakage generates. A state of this region III is formed by the current value kept at an upper limit by a phenomenon that the current value reaches the upper limit of voltage output power of the image forming apparatus. Or, the state is formed by a phenomenon that the leakage changes to continuous leakage over the entire region by further increasing the voltage Vpp from the state of the region II where the leakage between the developing roller 7 and the photosensitive drum 1 is discontinuous leakage or partial leakage.

Part (b) of FIG. 20 shows progression of the current value when the Vpp is changed and represents progression of the maximum value when the current after the rectification is averaged every periodic time T (4 ms in this embodiment). A horizontal line b represents a current threshold B which is a second threshold when the leakage detection is made on the basis of the magnitude of the current value in the region III of part (a) of FIG. 20. In this embodiment, the current threshold B which is the second threshold is set at 10 μA larger than the change amount threshold A which is the first threshold. However, the second threshold is not limited thereto.

That is, in the region III where the current value change amount is the change amount threshold A or less, compared with the region I where the current value change amount is similarly the change amount threshold A or less, the applied voltage Vpp is large, so that the current value of the current flowing between the developing roller 7 and the photosensitive drum 1 is clearly large. From this fact, comparison with the threshold is made on the basis of the magnitude of the current value in addition to the current value change amount, and setting of the developing bias at which the leakage does not generate is made. That is, even when the current value change amount is not more than the change amount threshold A which is the first threshold, in the case where the current value exceeds the current threshold B which is the second threshold, the leakage generates between the photosensitive drum 1 and the developing roller 7, and therefore, setting of the developing bias applied to the developing roller 7 is made lower than setting of the AC voltage applied to the developing roller 7 during detection of the current value. By this, the non-leakage generation region I and the leakage generation region III can be discriminated on the basis of the magnitude of the current value in addition to the current value change amount.

<Flowchart of Discharge Occurrence Detecting Operation>

Next, with reference to FIG. 21, a flow of control of the discharge occurrence detecting operation of the image forming apparatus according to embodiment 6 will be described.

FIG. 21 is a flow chart showing an example of the flow of the control of the discharge occurrence detecting operation of the image forming apparatus according to the embodiment 6. In the discharge occurrence detecting operation described below, whether or not each of the current value change amount and the current value of the current flowing between the photosensitive drum 1 and the developing roller 7 exceeded is discriminated, and on the basis of a result thereof, the developing bias applied to the developing roller 7 is set. The discharge occurrence detecting operation is executed by the CPU 40 (FIG. 2) which is the controller. Incidentally, this discharge occurrence detecting operation is executed when an installation environment of the image forming apparatus, such as atmospheric pressure, a temperature or a humidity, changes. Or, the discharge occurrence detecting operation is executed in synchronism with a driving time of the developing roller 7 or the photosensitive drum 1 (for example, sheet passing history or exchange timing of the developing device which has a possibility that the SD gap changes). Further, execution timing of the discharge occurrence detecting operation is not limited to the above-described examples, but can be appropriately set.

First, when a power source of the image forming apparatus is turned on and the discharge occurrence detecting operation is started ("START"), by an instruction of the CPU 40, drive of rotatable members such as the photosensitive drum 1 and the developing roller 7 is started by the unshown driving mechanisms (step S301). This drive of each of the rotatable members is continued until the discharge occurrence detecting operation is ended. Then, a charging bias is applied to the charging roller 4, and a DC voltage of −300 V is applied to the developing roller 7 by the DC voltage applying portion 30 (step S302). From the step S302, the time (T2) in which the photosensitive drum 1 rotates through one-full-circumference elapsed (step S303), so that the surface potential of the photosensitive drum 1 becomes −500 V over a full circumference. Then, the AC voltage Vpp applied to the developing roller 7 is set. In consideration of a change in temperature and humidity during sheet passing and a fluctuation in SD gap, the AC voltage Vpp applied to the developing roller 7 is set at an AC voltage Vpp higher than the AC voltage Vpp in setting during image formation by an offset value (step S304). In this embodiment, the AC voltage Vpp applied to the developing roller 7 is set at an AC voltage Vpp 200 V higher than the AC voltage Vpp during image formation. Then, as described above with reference to FIG. 19, the CPU 40 discriminates whether or not when the set AC voltage Vpp is applied to the developing roller 7, the current value change amount of the current flowing between the developing roller 7 and the photosensitive drum 1 exceeded the first threshold (change amount threshold A) which is the predetermined value (step S305). In this embodiment, the change amount threshold A which is the first threshold is 1 μA. Here, the current value change amount is a difference between the maximum value and the minimum value of the output value (average) of the current value detected by the detecting portion 35 in the time T2 in which the photosensitive drum 1 rotates through one-full-circumference (one full turn).

Then, in the case where the current value change amount exceeded the change amount threshold A which is the first threshold in the step S305, the leakage generates between the photosensitive drum 1 and the developing roller 7, and therefore, the CPU 40 puts the AC voltage Vpp of the developing bias in an OFF state (step S306). Thus, in the case where the leakage generates, setting of the AC voltage Vpp applied to the developing roller 7 during image formation is lowered to a voltage smaller than setting of the AC voltage applied to the developing roller 7 during detection of the current value (speed S307). In this embodiment, the CPU 40 lowers the AC voltage to a voltage (for example, 1.7 kV) 100 V lower than the AC voltage (for example, 1.8 kV) during image formation. Then, the operation returns to the step S304, the AC voltage applied to the developing roller 7 is set at an AC voltage Vpp higher than a setting-changed AC voltage during image formation by the offset value. Thus, the AC voltage applied to the developing roller 7 during leak detection is lowered from 2.0 kV to 1.9 kV. Then, in the step S305, whether or not the current value change amount exceeds the first threshold is checked again.

Incidentally, in the case where the current value change amount exceeded the first threshold in the step S305, the CPU 40 lowers stepwise the AC voltage applied to the developing roller 7 during leak detection, and repeats the above-described operation until the current value change amount is first threshold or less. That is, in the case where the CPU which is the controller detected in the step S305 that the current value change amount exceeded the first threshold, the CPU 40 lowers stepwise the AC voltage applied to the developing roller 7 and then detects again whether or not the current value change amount exceeded the first threshold.

In the case where the current value change amount does not exceed the first threshold in the step S305, i.e., in the case where the current value change amount is the first threshold or less, the CPU 40 discriminates whether or not the current value exceeds the second threshold (current threshold B) at which the current value is the predetermined value (step S308). That is, the leakage between the photosensitive drum 1 and the developing roller 7 is detected on the basis of the magnitude of the current value in addition to the current value change amount.

Then, in the step S308, in the case where the current value exceeds the second threshold, even when the current value change amount is the first threshold or less, the leakage generates between the photosensitive drum 1 and the developing roller 7. For that reason, the CPU 40 turns off the AC voltage Vpp of the developing bias (step S306). Thus, in the case where the leakage generates, as described above, setting of the AC voltage Vpp applied to the developing roller 7 during image formation is lowered to a value lower than the setting of the AC voltage applied to the developing roller 7 during the detection of the current value (step S307). Then, the operation returns to the step S304, and the AC voltage applied to the developing roller 7 is set at an AC voltage Vpp higher than the setting-changed AC voltage during image formation by the offset value. Then, the CPU 40 checks again whether or not the current value exceeds the second threshold in the step S308.

Incidentally, in the case where the current value exceeded the second threshold in the step S308, the CPU 40 lowers stepwise the AC voltage applied to the developing roller 7 during leak detection, and repeats the above-described operation until the current value is the second threshold or less. That is, in the case where the CPU 40 detects that the current value exceeded the second threshold in the step S308, the CPU 40 which is the controller lowers stepwise the AC voltage applied to the developing roller 7, and in the case where the CPU 40 detects whether or not the current value exceeded the first threshold in the step S305 and the current value does not exceed the first threshold, the CPU 40 detects again whether or not the current value exceeds the second threshold (step S308).

In the case where the current value does not exceed the second threshold in the step S308, i.e., in the case where the current value is the second threshold or less, the operations in the steps S305 and S308 are repeated in a period of the time T2 in which the photosensitive drum 1 rotates through one-full-circumference from application of the AC voltage Vpp (step S309). In the case where the current value is the first threshold and the current value is the second threshold or less in the period, the CPU 40 determines that a value lowered from the AC voltage Vpp at that time during leak detection by the offset value (200 V) is the AC voltage Vpp during image formation (step S310). That is, the CPU 40 determines the developing bias applied to the developing roller 7. Then, the CPU 40 puts the developing bias and the charging bias in an OFF state, and thereafter, causes the driving mechanisms to stop the drive of the photosensitive drum 1 and the developing roller 7 (step S311), so that the CPU 40 ends the discharge occurrence detecting operation ("END").

From the above, according to this embodiment, on the basis of the current value change amount and the current value of the current flowing between the photosensitive drum 1 and the developing roller 7 comparison with the threshold is made, and the developing bias applied to the developing roller 7 is set. By this, the time required for setting the developing bias at the developing bias at which the leakage does not generate can be shortened. At the same time, the generation or non-generation of the leakage can be detected with high accuracy. Incidentally, the SD gap, the charging bias, the developing bias, the threshold of the current value, and the like are not intended to be limited to those described herein unless otherwise specified.

Further, in this embodiment, the constitution in which the average of the current value outputted from the detecting portion 35 in the time of 10 periods (cyclic periods) of the AC voltage is calculated was described as an example, but the periodic time T of the AC voltage is not limited thereto. The periodic time may only be required to be appropriately set. For example, from the viewpoint of noise removal, the time T applied may also be increased to several tens of ms. Further, in the case where each of the peripheral speeds of the developing roller 7 and the photosensitive drum 1 or the frequency of the AC voltage is changed, the periodic time T is not limited to the above-described values.

Further, in this embodiment, the constitution in which comparison with the threshold using the current value change amount and the current value is made in the period of the time in which the photosensitive drum 1 rotates through one-full-circumference was described as an example, but the period in which the comparison with the threshold is made is not limited thereto. The period may also be a time in which the photosensitive drum 1 rotates through a plurality of full circumferences or a time in which the developing roller 7 rotates. However, the distance (SD gap) between the photosensitive drum 1 and the developing roller 7 fluctuates in a rotation period (cyclic period) of the developing roller 7 and the photosensitive drum 1, and therefore, of the developing roller 7 and the photosensitive drum 1, the member of which one rotation time is longer may preferably be rotated. Further, for the purpose of shortening the time in which the developing roller 7 or the photosensitive drum 1 is rotated may preferably be short.

Further, in this embodiment, similarly as in the above-described embodiment 1, the current flowing between the developing roller 7 and the photosensitive drum 1 during application of the AC voltage and the DC voltage therebetween was rectified and the current value averaged in the 10-period time of the AC voltage was used as the current value compared with the threshold. However, the current value compared with the threshold is not limited to the rectified current value, but may also be current values before the rectification as shown in FIGS. 22 and 23 described below.

Each of part (a) of FIG. 22 and part (a) of FIG. 23 represents a potential relationship between the photosensitive drum 1 and the developing roller 7 when the current flowing between the developing roller 7 and the photosensitive drum 1 is measured. To the developing roller 7, a developing bias in the combination form of a DC voltage Vdc=−300 V and an AC voltage Vpp=2000 V was applied.

Part (a) of FIG. 22 is a schematic view illustrating a state when the surface potential Vd of the photosensitive drum 1 during white image formation is −500 V, and part (a) of FIG. 23 is a schematic view illustrating a state when the surface potential VL during black image formation is −100 V.

The current flowing between the developing roller 7 and the photosensitive drum 1 is shown in each of part (b) of FIG. 22 and part (b) of FIG. 23. When the potential difference between the surface potential of the photosensitive drum 1 and the voltage of the developing roller 7 is large, a large current flows between the photosensitive drum 1 and the developing roller 7. That is, as shown in part (a) of FIG. 22, the surface potential Vd of the photosensitive drum 1 is larger on the positive side than the DC voltage Vdc of the developing roller 7, a potential difference between Vd and Vmin is larger than a potential difference between Vd and Vmax. For that reason, as shown in part (b) of FIG. 22, an absolute value of the current flowing in the positive side is larger than an absolute value of the current flowing in the negative side. Further, as shown in part (a) of FIG. 23, the surface potential VL of the photosensitive drum 1 is larger on the positive side than the DC voltage Vdc of the developing roller 7, a potential difference between VL and Vmax is larger than a potential difference between VL and Vmin. For that reason, as shown in part (b) of FIG. 23, an absolute value of the current flowing in the negative side is larger than an absolute value of the current flowing in the positive side.

Further, in general, on the side where the absolute value of the current becomes large, the leakage is liable to generate between the developing roller 7 and the photosensitive drum 1. For that reason, an average (current value) on this side where the absolute value is large may preferably be used as the current value compared with the threshold.

Thus, in the embodiments 1 and 6, the constitution in which the rectified current value is used for comparison with the threshold, but the current value before the rectification may also be used for the comparison with the threshold. As the current value before the rectification, either one or both of the maximum value and the minimum value may be used, or an average obtained by averaging the current value in certain time unit may also be used.

For example, the detecting portion 35 detects a first current value of the current flowing between the photosensitive drum 1 and the developing roller on a positive side of the AC voltage applied to the developing roller 7 or a second current value of the current flowing between the photosensitive drum 1 and the developing roller 7 on a negative side of the AC voltage applied to the developing roller 7. Then, the CPU 40 which is the controller sets the developing bias applied to the developing roller 7, on the basis of a difference between a maximum value and a minimum value of the first current value or a difference between a maximum value and a minimum value of the second current value and on the basis of the magnitude of the current value, which are detected by the detecting portion 35 in the time in which the developing roller 7 or the photosensitive drum 1 rotates through at least one-full-circumference. In the case where a change amount of the first current value which is the difference detect the maximum value and the minimum value or a change amount of the second current value which is the difference between the maximum value and the minimum value exceeds the first threshold, the CPU 40 lowers setting of the developing bias applied to the developing roller 7 so as to be smaller than setting of the AC voltage applied to the developing roller 7 during detection of the current value. Further, even when the first current value change amount or the second current value change amount is the first threshold or less, in the case where the first current value change amount or the second current value change amount exceeded the second threshold, setting of the developing bias applied to the developing roller 7 is made lower than setting of the AC voltage applied to the developing roller 7 during detection of the current value.

In the case where the change amount of the first current value or the change amount of the second current value is the first threshold or less and where the first current value or the second current value is the second threshold or less, the CPU 40 does not change the setting of the developing bias applied to the developing roller 7.

Or, the CPU 40 sets the developing bias applied to the developing roller 7 on the basis of a difference between a maximum value and a minimum value of the calculated first average or a difference between a maximum value and a minimum value of the calculated second average and on the basis of the magnitude of the current value, in the time in which the developing roller 7 or the photosensitive drum 1 rotates through at least one-full-circumference. In the case where a change amount of the first average which is the detected difference between the maximum value and the minimum value or a change amount of the second average which is the difference between the maximum value and the minimum value exceeds the first threshold, the CPU 40 lowers setting of the developing bias applied to the developing roller 7 so as to be smaller than setting of the AC voltage applied to the developing roller 7 during detection of the current value. Further, even when the first average change amount or the second average change amount is the first threshold or less, in the case where the first average change amount or the second average change amount exceeded the second threshold, setting of the developing bias applied to the developing roller 7 is made lower than setting of the AC voltage applied to the developing roller 7 during detection of the current value.

Further, in the case where the change amount of the first average or the change amount of the second average is the first threshold and where change amount of the first average or the change amount of the second average is the second threshold or less, the CPU 40 does not change the setting of the developing bias applied to the developing roller 7.

Even when such a constitution is employed, the CPU 40 makes comparison with the threshold by using the current value change amount and the current value and is capable of setting the developing bias applied to the developing roller 7 it is possible to shorten the time required for setting the developing bias at which the leakage does not generate. At the same time, it becomes possible to detect the generation or non-generation of the leakage with high reliability.

Further, in the embodiment 6, the calculating methods as described in the above-described modified embodiments 1 and 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2019-219647 filed on Dec. 4, 2019, 2019-219650 filed on Dec. 4, 2019 and 2019-227810 filed on Dec. 18, 2019, which are hereby incorporated by reference herein in their entirety.

What is claimed is:

1. An image forming apparatus comprising:

a rotatable image bearing member;

a charging member configured to electrically charge the image bearing member;

a rotatable developer carrying member provided so as to oppose the image bearing member in non-contact with the image bearing member and configured to carry a developer;

an applying portion configured to apply, to the developer carrying member, a developing voltage in a combination form of a DC voltage and an AC voltage;

a detecting portion configured to detect a first current value and a second current value of currents flowing between the image bearing member and the developer carrying member; and a controller configured to control the applying portion, wherein when a difference between the first current value and the second current value which are detected by the detecting portion exceeds a threshold in a state in which the image bearing member and the developer carrying member are rotated and a first developing voltage is applied to the developer carrying member, the controller controls the AC voltage applied to the developer carrying member, and wherein the first current value is a maximum value of the current value detected by the detecting portion in a state in which the first developing voltage is applied to the developer carrying member, and the second current value is a minimum value of the current value detected by the detecting portion in the state in which the first developing voltage is applied to the developer carrying member, and wherein when a difference between the maximum value and the minimum value exceeds a threshold, the controller sets the AC voltage, applied to the developer carrying member, at a value smaller than an AC voltage applied to the developer carrying member during detection of the current value.

2. An image forming apparatus according to claim 1, wherein when the detecting portion detected that the difference between the maximum value and the minimum value exceeded the threshold, the controller stepwise lowers the AC voltage applied to the developer carrying member and detects whether or not a difference between a maximum value and a minimum value of current values flowing between the image bearing member and the developer carrying member exceeds the threshold again.

3. An image forming apparatus according to claim 1, wherein the detecting portion detects a third current value of a current value flowing between the image bearing member and the developer carrying member on a positive side of the AC voltage applied to the developer carrying member or a fourth current value of a current value flowing between the image bearing member and the developer carrying member on a negative side of the AC voltage applied to the developer carrying member, and wherein when a difference between a maximum value and a minimum value of the third current value detected by the detecting portion or a difference between a maximum value and a minimum value of the fourth current value detected by the detecting portion exceeds the threshold, the controller sets the AC voltage, applied to the developer carrying member, at a value smaller than an AC applied to the developer carrying member during detection of the current value.

4. An image forming apparatus according to claim 1, wherein the detecting portion detects a third current value of a current value flowing between the image bearing member and the developer carrying member on a positive side of the AC voltage applied to the developer carrying member or a fourth current value of a current value flowing between the image bearing member and the developer carrying member on a negative side of the AC voltage applied to the developer carrying member, and wherein when the controller calculates a first average of the third current value detected by the detecting portion in a periodic time of the AC voltage or a second average of the fourth current value detected by the detecting portion in the periodic time and then a difference between a maximum value and a minimum value of the calculated first average or a difference between a maximum value and a minimum value of the calculated second average exceeds the threshold, the controller sets the AC voltage, applied to the developer carrying member, at a value smaller than an AC applied to the developer carrying member during detection of the current value.

5. An image forming apparatus according to claim 1, wherein when the difference between the maximum value and the minimum value is the threshold or less, the controller does not change setting of the AC voltage applied to the developer carrying member.

6. An image forming apparatus according to claim 1, wherein the controller controls the AC voltage applied to the developer carrying member, on the basis of the difference between the maximum value and the minimum value of the current values detected by the detecting portion in a time in which the image bearing member or the developer carrying member rotates through at least one full circumference.

7. An image forming apparatus according to claim 1, wherein the detecting portion outputs a value of a current value obtained by rectifying the current value flowing between the image bearing member and the developer carrying member, and wherein the controller outputs a value obtained by averaging the value of the current value outputted from the detecting portion in a periodic time of the AC voltage.

8. An image forming apparatus according to claim 1, wherein the controller controls the AC voltage applied to the developer carrying member in synchronism with a driving time of the image bearing member or the developer carrying member.

9. An image forming apparatus according to claim 1, wherein the controller controls the AC voltage applied to the developer carrying member when a temperature, a humidity or atmospheric pressure is changed.

10. An image forming apparatus according to claim 1, wherein the AC voltage applied to the developer carrying member has a rectangular waveform.

11. An image forming apparatus according to claim 1, wherein when the controller performs an operation in which the controller controls the AC voltage applied to the developer carrying member, the image bearing member or the developer carrying member of which one rotation time is longer than a one rotation time of the other member is rotated through at least one full circumference.

12. An image forming apparatus according to claim 1, wherein the controller controls the AC voltage applied to the developer carrying member, on the basis of a difference between the first current value and the second current value, which are detected by the detecting portion, exceeding a threshold in a state in which the image bearing member and the developer carrying member are rotated and the first developing voltage is applied to the developer carrying member, and on the basis of the first current value.

13. An image forming apparatus comprising:

a rotatable image bearing member;

a charging member configured to electrically charge the image bearing member;

a rotatable developer carrying member provided so as to oppose the image bearing member in non-contact with the image bearing member and configured to carry a developer;

a developer accommodating chamber configured to accommodate the developer;

a developing chamber in which the developer carrying member is provided so as to be rotatable;

a developing frame provided with an opening for establishing communication between the developer accommodating chamber and the developing chamber and configured to support the developer carrying member;

a rotatable member provided in the developing frame and configured to rotate in interrelation with the developer carrying member;

a sealing member configured to seal the opening provided in the developing frame and configured to be partially fixed to the rotatable member;

a process cartridge mountable to and dismountable from the image forming apparatus;

an applying portion configured to apply, to the developer carrying member, a developing voltage in a combination form of a DC voltage and an AC voltage;

a detecting portion configured to detect a first current value and a second current value of currents flowing between the image bearing member and the developer carrying member; and a controller configured to control the AC voltage so that the controller detects whether or not the current value detected by the detecting portion exceeded a threshold in a state in which the developing voltage is applied to the developer carrying member during detection of the current value and then so that the current value is the threshold or less, wherein a time required for controlling the AC voltage so that the AC voltage is the threshold or less is shorter than a time from a start of unsealing of the opening by winding up the sealing member through rotation of the rotatable member until the unsealing of the opening is ended.

14. An image forming apparatus according to claim 13, wherein the AC voltage applied to the developer carrying member has a rectangular waveform.

15. An image forming apparatus according to claim 13, wherein the controller causes the detecting portion to detect the current value when a certain time elapsed from timing when the AC voltage applied to the developer carrying member changes from a negative to a positive or from the positive to the negative.

16. An image forming apparatus according to claim 13, wherein the detecting portion detects the current value of the current flowing between the image bearing member and the developer carrying member in a region in which the AC voltage applied to the developer carrying member is a certain voltage.

17. An image forming apparatus according to claim 13, wherein the controller lowers the developing voltage applied to the developer carrying member in a case that the current value detected by the detecting portion when a certain time elapsed from timing when the AC voltage applied to the developer carrying member changes from a negative to a positive or from the positive to the negative, than a developing voltage applied to the developer carrying member during detection of the current value.

18. An image forming apparatus according to claim 13, wherein the controller does not change the developing voltage applied to the developer carrying member in a case that the current value detected by the detecting portion in a time when the image bearing member or the developer carrying member rotates through at least one full circumference.

19. An image forming apparatus according to claim 13, wherein the developer carrying member receives a driving force from a driving source different from a driving source for the image bearing member.

20. An image forming apparatus according to claim 13, wherein when the detecting portion detected that the current value exceeded the threshold, the controller stepwise lowers the AC voltage applied to the developer carrying member and detects whether or not a difference between a current value of a current value flowing between the image bearing member and the developer carrying member exceeds the threshold again, and then the controller controls the developing voltage so that the current value is the threshold or less.

* * * * *